US007121530B1

(12) United States Patent
Preta

(10) Patent No.: US 7,121,530 B1
(45) **Date of Patent: *Oct. 17, 2006**

(54) FENCE BRACKET SYSTEM AND FENCE SYSTEM USING THE FENCE BRACKET SYSTEM

(76) Inventor: John Preta, 11605 Coldstream Dr., Potomac, MD (US) 20854

( * ) Notice: Subject to any disclaimer, the term of this patent is extended or adjusted under 35 U.S.C. 154(b) by 0 days.

This patent is subject to a terminal disclaimer.

(21) Appl. No.: 10/855,605

(22) Filed: May 28, 2004

Related U.S. Application Data

(63) Continuation of application No. 10/314,369, filed on Dec. 9, 2002, now Pat. No. 6,802,496.

(51) Int. Cl.
*E04H 17/00* (2006.01)

(52) U.S. Cl. ..... 256/65.04; 256/65.01; 256/65.02; 256/65.03; 256/67

(58) Field of Classification Search ..... 256/21, 256/65.01–65.07, 67, 65.15; 248/228.1; 403/64, 174, 217–219, 2, 230, 270, 271; 411/1, 8, 301; 29/525.05; 219/98; 16/253
See application file for complete search history.

(56) References Cited

U.S. PATENT DOCUMENTS

| | | | | |
|---|---|---|---|---|
| 5,285 A | | 9/1847 | Bingham | |
| 69,444 A | | 10/1867 | Johnson | |
| 118,156 A | | 8/1871 | Rohrer | |
| 340,263 A | | 4/1886 | Weber | |
| 566,364 A | * | 8/1896 | Wilson | 256/72 |
| 712,259 A | * | 10/1902 | Carr | 256/24 |
| 859,239 A | * | 7/1907 | McFall | 256/65.06 |
| 1,136,999 A | | 4/1915 | Bondy | |
| 1,225,431 A | | 5/1917 | Gelbart | |
| 1,330,808 A | * | 2/1920 | James | 256/47 |
| 1,643,887 A | * | 9/1927 | Gougler | 52/651.05 |
| 1,803,508 A | * | 5/1931 | Rossman | 403/173 |
| 2,346,111 A | | 4/1944 | MacKenzie | |
| 2,427,723 A | * | 9/1947 | Hawkins et al. | 256/72 |
| 2,715,513 A | * | 6/1955 | Kools | 256/21 |
| 2,906,551 A | | 9/1959 | May | |
| 3,085,788 A | | 4/1963 | Hawkins | |
| 3,092,407 A | | 6/1963 | Blonder | |
| 3,410,527 A | | 11/1968 | Urosheuich | |
| 3,524,627 A | | 8/1970 | Boganton et al. | |
| 3,614,068 A | | 10/1971 | Koehl | |
| 3,648,982 A | | 3/1972 | Sabel et al. | |
| 3,767,236 A | | 10/1973 | Horgan, Jr. | |

(Continued)

OTHER PUBLICATIONS

Mitek Hinge Plate KGN18.

(Continued)

*Primary Examiner*—Daniel P. Stodola
*Assistant Examiner*—Ernesto Garcia
(74) *Attorney, Agent, or Firm*—John Preta

(57) ABSTRACT

Method of assembling a fence that includes posts and rails, wherein the method provides for placing a plurality of spaced apart posts in the ground, sliding at least two post brackets over an end of each post, sliding at least one first rail bracket over an end of a rail, sliding at least one second rail bracket over an end of another rail, connecting the projecting portion of the first rail bracket to the first projecting portion of one of the post brackets with a first fastener, and connecting the projecting portion of the second rail bracket to the second projecting portion of the one of the post brackets with a second fastener. The first and second rail brackets are movably mounted to the one of the post brackets via the first and second fasteners.

18 Claims, 34 Drawing Sheets

U.S. PATENT DOCUMENTS

| | | | | |
|---|---|---|---|---|
| 3,801,072 | A | | 4/1974 | Newberry, Jr. |
| 3,960,367 | A | | 6/1976 | Rogers |
| 3,989,226 | A | | 11/1976 | Burgess |
| 4,060,222 | A | | 11/1977 | Pitkin et al. |
| 4,074,893 | A | | 2/1978 | Coltrin |
| 4,114,861 | A | | 9/1978 | Long |
| 4,149,701 | A | | 4/1979 | Densen |
| 4,150,907 | A | | 4/1979 | Thurnauer |
| 4,174,096 | A | | 11/1979 | Campbell |
| 4,208,038 | A | | 6/1980 | Reid |
| 4,266,757 | A | | 5/1981 | Kirkwood |
| 4,526,348 | A | | 7/1985 | Cammack |
| 4,722,513 | A | | 2/1988 | Gaillard et al. |
| 4,739,971 | A | | 4/1988 | Ruane |
| 4,899,991 | A | | 2/1990 | Brunkan |
| 4,915,535 | A | | 4/1990 | Willets |
| 4,919,394 | A | | 4/1990 | Otte et al. |
| 4,923,176 | A | | 5/1990 | Heinz |
| 4,946,138 | A | | 8/1990 | Gaillard et al. |
| 4,951,925 | A | | 8/1990 | Schultz et al. |
| 4,982,933 | A | | 1/1991 | Schultz |
| 5,026,028 | A | | 6/1991 | Ooi et al. |
| 5,152,507 | A | | 10/1992 | Lee |
| 5,186,571 | A | | 2/1993 | Hentzschel |
| 5,190,268 | A | | 3/1993 | Espinueva |
| 5,192,056 | A | | 3/1993 | Espinueva |
| 5,238,321 | A | | 8/1993 | Jarjoura |
| 5,372,354 | A | | 12/1994 | Cacicedo |
| 5,402,987 | A | | 4/1995 | Duyck et al. |
| 5,438,795 | A | | 8/1995 | Galbraith |
| 5,498,098 | A | | 3/1996 | Cairns |
| 5,547,169 | A | | 8/1996 | Russell |
| 5,575,580 | A | | 11/1996 | Parrish et al. |
| 5,593,143 | A | * | 1/1997 | Ferrarin ..... 256/68 |
| 5,653,546 | A | | 8/1997 | Cronkhite et al. |
| 5,655,755 | A | | 8/1997 | Brandt |
| 5,695,174 | A | | 12/1997 | Tsai |
| 5,795,503 | A | | 8/1998 | Krake |
| 5,873,564 | A | | 2/1999 | Bisch |
| 5,873,671 | A | | 2/1999 | West |
| 5,882,001 | A | | 3/1999 | Reinbold |
| 5,913,508 | A | | 6/1999 | Eades |
| 5,961,242 | A | | 10/1999 | Leone |
| 5,964,452 | A | | 10/1999 | Summers |
| 6,029,954 | A | | 2/2000 | Murdaca |
| 6,053,481 | A | | 4/2000 | Scheide |
| 6,279,880 | B1 | | 8/2001 | Hawks, Jr. |
| 6,283,457 | B1 | | 9/2001 | Venegas, Jr. |
| 6,290,214 | B1 | | 9/2001 | De Souza |
| 6,311,955 | B1 | | 11/2001 | McGarry et al. |
| 6,341,764 | B1 | | 1/2002 | Conner |
| 6,386,519 | B1 | | 5/2002 | Priefert |
| 6,398,193 | B1 | | 6/2002 | De Souza |
| 6,779,782 | B1 | * | 8/2004 | Webb ..... 256/65.01 |
| 2001/0015427 | A1 | | 8/2001 | Berto |
| 2003/0193049 | A1 | | 10/2003 | Kim |

OTHER PUBLICATIONS

Assembly Instructions for Certainteed Handrail.
Various Hollander Slip-On Handrail Fittings.
Various Hollander Speed-Rail® and Nu-Rail® Fittings.
Machinery's Handbook 20th Edition pp. 1921-1926.
Machinery's Handbook 20th Edition pp. 474-475 1978.

* cited by examiner

Fig. 6
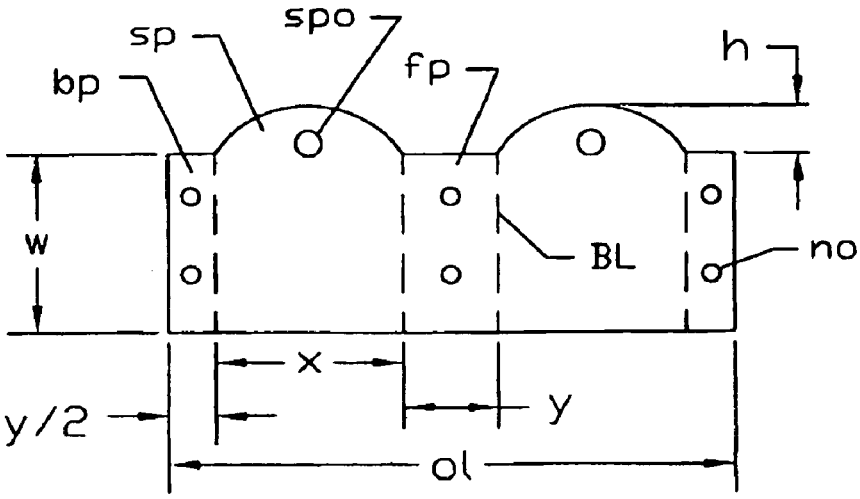
Fig. 7
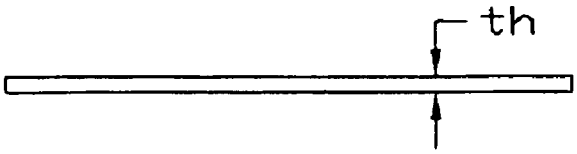
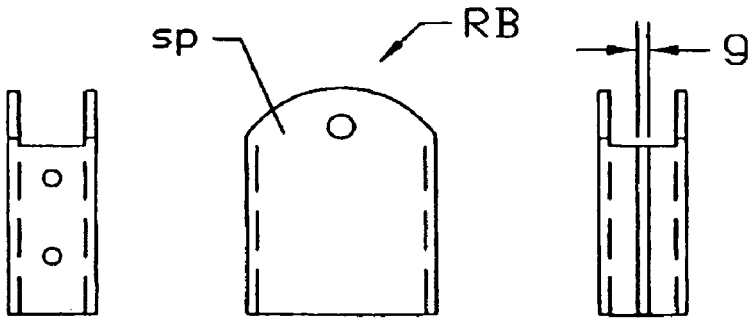
Fig. 8a Fig. 8b Fig. 8c
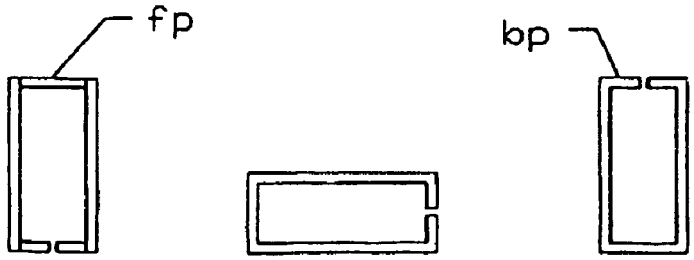
Fig. 9a Fig. 9b Fig. 9c Fig. 61
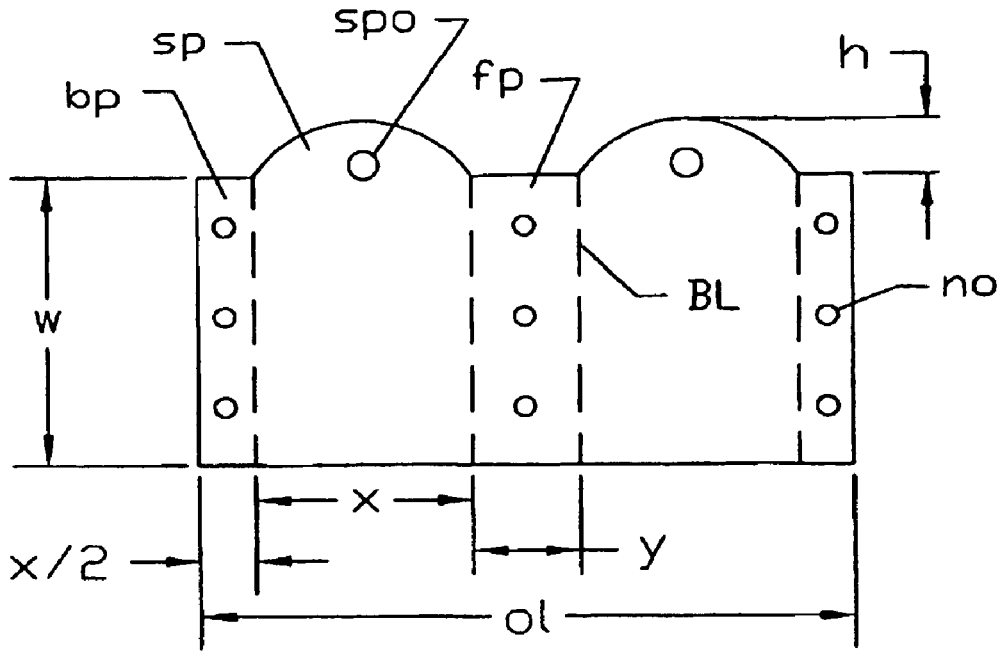
Fig. 62
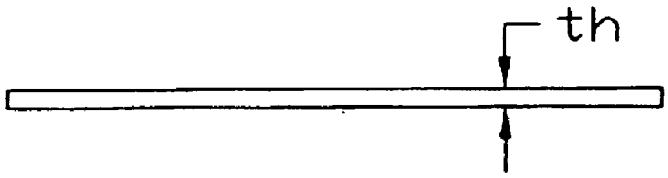
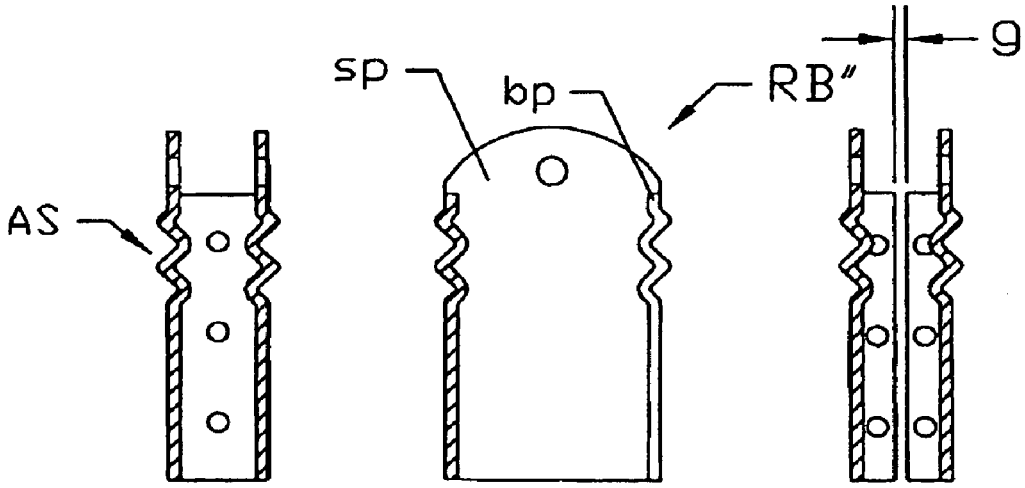
Fig. 63a Fig. 63b Fig. 63c

FENCE BRACKET SYSTEM AND FENCE SYSTEM USING THE FENCE BRACKET SYSTEM

CROSS-REFERENCE TO RELATED APPLICATIONS

The present application is a continuation of U.S. application Ser. No. 10/314,369 filed Dec. 9, 2002, which issued as U.S. Pat. No. 6,802,496 the disclosure of which is expressly incorporated by reference herein in its entirety.

BACKGROUND OF THE INVENTION

1. Field of the Invention

The invention relates to a fence bracket system and a fence system which uses the fence bracket system. A method of making the fence bracket system as well as the fence system is also described. The invention is also directed to a method of assembling and/or installing a fence on site using the fence bracket system.

2. Discussion of Background Information

Various types of fence assembly devices are known. It is also known to utilize brackets in attaching fence sections or rails to fence posts. However, none of the numerous conventional bracket systems are able to produce a fence that is very strong, while being easily adjustable and/or repairable, easy and inexpensive to make, and which can be used to efficiently assemble a fence.

SUMMARY OF THE INVENTION

The invention provides for a bracket system for assembling a fence that includes posts and rails. The bracket system comprises a post bracket including a first projecting portion and a second projecting portion, the post bracket being securable to a post. The first projecting portion extends in one direction and the second projecting portion extends a different direction. A first rail bracket includes a first end securable to the first projecting portion and a second end that is securable to a rail. A second rail bracket includes a first end securable to the second projecting portion and a second end that is securable to another rail. The post bracket has an internal opening whose size and shape generally corresponds to a size and shape of the post. Each of the first and second rail brackets is configured to lengthen or shorten a respective rail upon movement of the post bracket relative to the post. Prior to being secured thereto, the post bracket can slide up and down relative to the post.

Each of the first and second projecting portions may comprise at least one projecting tab. Each of the first and second projecting portions may comprise also two projecting tabs.

Each of the first and second projecting portions may comprise an opening, each first end of the first and second rail brackets may similarly comprise an opening, and the bracket system may further comprise two fasteners which are each arranged to connect the first and second rail brackets to the post bracket via the openings.

The first and second rail brackets may be removably secured to the first and second projecting portions via two fasteners. The first and second rail brackets may be pivotally mounted to the first and second projecting portions. The first and second rail brackets may be movably mounted to the first and second projecting portions.

Each of the first and second projecting portions may comprise two projecting tabs that each have an opening.

Each of the first and second rail brackets may similarly comprise two projecting tabs that each have an opening.

The fence may further comprise pickets or slats connected to the rails. Each of the pickets or slats may be connected to each of the rails via a single fastener, whereby the rails can move relative to the slats. Each of the pickets or slats may be connected to channel members and each channel member is securable to a rail. Each of the pickets or slats may be connected to each of the channel members via a single fastener, whereby the channel members can move relative to the slats.

The post bracket may be a unitary member formed of sheet metal. The post bracket may alternatively comprise a two piece structure. The post bracket and each of the first and second rail brackets may each comprise unitary members. The post bracket may comprise a first part and a second part, the first part being arranged above the second part, wherein the first part is removably connected to the first rail bracket and wherein the second part is removably connected to the second rail bracket. The post bracket may comprise a first part and a second part, the first part being arranged on one side of the post and the second part being arranged on another side of the post, wherein the first part is removably connected to the first rail bracket and wherein the second part is removably connected to the second rail bracket.

The invention also provides for a bracket system for assembling a fence that includes posts and fence sections having rails and slats or pickets, wherein the bracket system comprises a unitary post bracket including a first projecting portion and a second projecting portion, the post bracket being securable to a post, the first projecting portion extends in one direction and the second projecting portion extends a different direction, a unitary first rail bracket including a first end securable to the first projecting portion and a second end that is securable a rail, a unitary second rail bracket including a first end securable to the second projecting portion and a second end that is securable another rail, the post bracket having an internal opening whose size and shape generally corresponds to a size and shape of the post, each of the first and second rail brackets being configured to lengthen or shorten a respective rail upon movement of the post bracket relative to the post, a first fastener connecting the first projecting portion to the first rail bracket, and a second fastener connecting the second projecting portion to the second rail bracket.

The invention still further provides for a fence system comprising a plurality of bracket systems, each bracket system comprising a post bracket including a first projecting portion and a second projecting portion, the post bracket being securable to a post, the first projecting portion extending in one direction and the second projecting portion extending a different direction, a first rail bracket including a first end securable to the first projecting portion and a second end that is securable to a rail, a second rail bracket including a first end securable to the second projecting portion and a second end that is securable to another rail, the post bracket having an internal opening whose size and shape generally corresponds to a size and shape of a post, each of the first and second rail brackets being configured to lengthen or shorten a respective rail upon movement of the post bracket relative to the post, wherein the posts each have at least two post brackets, wherein the rails each have at least two rail brackets, and further comprising channel members that are each connected to a plurality of slats or pickets, and each of the channel members is connected to each of the rails, wherein, prior to being secured thereto, each post bracket can slide up and down relative to each of the posts.

The invention also provides for a method of making the bracket system of the type described above wherein the method comprises cutting and bending sheet metal to form the post bracket, cutting and bending sheet metal to form the first rail bracket, and cutting and bending sheet metal to form the second rail bracket.

The invention also provides for a method of making the bracket system of the type described above wherein the method comprises cutting and bending sheet metal to form the post bracket, cutting and bending sheet metal to form the first rail bracket, cutting and bending sheet metal to form the second rail bracket, and connecting each of the first and second rail brackets to the post bracket via fasteners.

The invention also provides for a method of making the bracket system of the type described above wherein the method comprises placing posts at generally equally spaced distances, mounting at least two post brackets onto each of the posts, mounting at least two rail brackets onto each of the rails, connecting the rails to the posts via the post brackets and the rail brackets, adjusting a position of each post bracket by sliding the post bracket up and down relative to a respective post, securing each post bracket to a respective post and securing each rail bracket to a respective rail.

The invention also provides for a method of assembling a fence using the bracket system described above wherein the method comprises arranging posts at generally equally spaced distances, mounting at least two post brackets onto each of the posts, mounting at least two rail brackets onto each of the rails, connecting the rails to the posts via the post brackets and the rail brackets, adjusting a position of each post bracket by sliding the post bracket up and down relative to a respective post, securing each post bracket to a respective post, securing each rail bracket to a respective rail, and securing fence sections to the rails via channel members.

The invention further provides for a bracket system for assembling a fence that includes posts and fence sections having rails and slats or pickets, the bracket system comprising a post bracket including a first projecting portion, a second projecting portion, and at least one of barbs and openings configured to receive fasteners for securing the post bracket to a post, the first projecting portion extends in one direction and the second projecting portion extends a different direction, a first rail bracket including a first end removably connected to the first projecting portion, a second end that is securable a rail, and at least one opening configured to receive a fastener for securing the rail bracket to the rail, a second rail bracket including a first end removably connected to the second projecting portion, a second end that is securable another rail, and at least one opening configured to receive a fastener for securing the rail bracket to the rail, the post bracket having an internal opening whose size and shape generally corresponds to a size and shape of the post, a first fastener connects the first projecting portion to the first rail bracket and a second fastener connects the second projecting portion to the second rail bracket.

The invention provides for a bracket system for assembling a fence that includes posts and rails. The bracket system comprises a post bracket including a first projecting portion and a second projecting portion, the post bracket being securable to a post. The first projecting portion extends in one direction and the second projecting portion extends a different direction. A first rail bracket includes a first end securable to the first projecting portion and a second end that is securable a rail. A second rail bracket includes a first end securable to the second projecting portion and a second end that is securable another rail. The post bracket has at least one barb and/or at least one opening configured to receive a securing fastener for securing the post bracket to the post. Each of the first and second rail brackets is configured to lengthen or shorten a respective rail upon movement of the post bracket relative to the post. Each of the first and second rail brackets has at least one barb and/or at least one opening configured to receive a securing fastener for securing the rail brackets to the rails. Prior to being secured thereto, the post bracket can slide up and down relative to the post.

The invention also provides for a method of making the bracket system described above, the method comprising cutting and bending sheet metal to form the post bracket, cutting and bending sheet metal to form the first rail bracket, and cutting and bending sheet metal to form the second rail bracket.

The invention further provides for a method of making the bracket system described above, the method comprising cutting and bending sheet metal to form the post bracket, cutting and bending sheet metal to form the first rail bracket, cutting and bending sheet metal to form the second rail bracket and connecting each of the first and second rail brackets to the post bracket via fasteners.

The invention also provides for a method of making the bracket system described above, the method comprising cutting and bending sheet metal to form the post bracket wherein the first projecting portion includes two tabs which are bent and arranged to be parallel to one another and wherein the second projecting portion includes two tabs which are bent and arranged to be parallel to one another, each of the tabs having an opening formed therein, cutting and bending sheet metal to form the first rail bracket that includes at least one tab which has an opening formed therein, and cutting and bending sheet metal to form the second rail bracket that includes at least one tab which has an opening formed therein.

Still further, the invention provides for a method of making the bracket system described above, the method comprising forming the post bracket as a unitary or one-piece member wherein the first projecting portion includes two tabs which are arranged to be parallel to one another and wherein the second projecting portion includes two tabs which are arranged to be parallel to one another, each of the tabs having an opening formed therein, forming the first rail bracket as a unitary or one-piece member that includes at least one tab which has an opening formed therein, forming the second rail bracket as a unitary or one-piece member that includes at least one tab which has an opening formed therein, and connecting each of the first and second rail brackets to the post bracket via fasteners.

The invention also provides for a method of making the bracket system described above, the method comprising forming the post bracket as a unitary or one-piece member wherein the post bracket includes barbs and/or openings configured to receive securing fasteners for securing the post bracket to the post, wherein each of the first and second projecting portions include at least one opening configured to receive first and second connecting fasteners, forming the first rail bracket as a unitary or one-piece member wherein the first rail bracket includes barbs and/or openings configured to receive securing fasteners for securing the first rail bracket to a rail and an opening configured to receive the first connecting fastener, forming the second rail bracket as a unitary or one-piece member wherein the second rail bracket includes barbs and/or openings configured to receive fasteners for securing the second rail bracket to a rail and an opening configured to receive the second connecting fastener, connecting each of the first and second rail brackets to the post bracket via the first and second connecting fasteners, and securing the post bracket to the post and the first and second rail brackets to the rails via the barbs and/or securing fasteners.

The invention also provides for a bracket system for assembling a fence that includes posts and rails, wherein the bracket system comprises a post bracket having a first projecting portion, a second projecting portion, and being securable to a post, the first projecting portion extending in one direction and the second projecting portion extending a different direction, a first rail bracket including a first end securable to the first projecting portion and a second end that is securable to a rail, a second rail bracket including a first end securable to the second projecting portion and a second end that is securable to another rail, the post bracket defining an internal opening whose size and shape generally corresponds to a size and shape of the post, each of the first and second rail brackets being configured to lengthen or shorten a respective rail upon movement of the post bracket relative to the post, and the post bracket and each of first and second rail brackets including at least one of openings configured to receive securing fasteners and integrally formed securing barbs, wherein, prior to being secured thereto, the post bracket can slide up and down relative to the post, and wherein, prior to being secured thereto, each of the first and second rail brackets can slide over ends of each rail.

Each of the first and second projecting portions may comprise at least one projecting tab having a width that is less than an overall width of the post bracket. Each of the first and second projecting portions may also comprise two projecting tabs and wherein the post bracket has a generally uniform thickness of between approximately 1/20 inches and 1/5 inches. Each of the first and second projecting portions may comprise an opening and wherein each first end of the first and second rail brackets comprises an opening, and wherein the bracket system further comprises two fasteners, one fastener being arranged to connect the first rail bracket to the post bracket and another fastener being arranged to connect the second rail bracket to the post bracket. The first and second rail brackets may be removably secured to the first and second projecting portions via the two fasteners. The first and second rail brackets may be pivotally mounted to the first and second projecting portions. The first and second rail brackets may be movably mounted to the first and second projecting portions. Each of the first and second projecting portions may comprise two projecting tabs that each have an opening. Each of the first and second rail brackets may comprise at least one projecting tab that has an opening.

The fence may further comprise pickets or slats connected to the rails. Each of the pickets or slats may be connected to each of the rails via a single fastener, whereby the rails can move relative to the slats. Each of the pickets or slats may be connected to channel members and each channel member is securable to a rail. Each of the pickets or slats may be connected to each of the channel members via a single fastener, whereby the channel members can move relative to the slats. The post bracket may be a unitary member formed of sheet metal. The post bracket may comprise a two piece structure. The post bracket and each of the first and second rail brackets may each comprise unitary members. The post bracket may also comprise a first part and a second part, the first part being arranged above the second part, the first part being removably connected to the first rail bracket, and the second part being removably connected to the second rail bracket. The post bracket may comprise a first part and a second part, the first part being arranged on one side of the post and the second part being arranged on another side of the post, the first part being removably connected to the first rail bracket, and the second part being removably connected to the second rail bracket.

The invention also provides for a bracket system for assembling a fence that includes posts and fence sections having rails and slats or pickets, wherein the bracket system comprises a post bracket including a first projecting portion, a second projecting portion, and at least one barb and/or opening configured to receive a fastener for securing the post bracket to a post, the first projecting portion extending in one direction and the second projecting portion extending a different direction, a first rail bracket including a first end removably connected to the first projecting portion, a second end that is securable a rail, and at least one barb and/or opening configured to receive a fastener for securing the rail bracket to the rail, a second rail bracket including a first end removably connected to the second projecting portion, a second end that is securable another rail, and at least one barb and/or opening configured to receive a fastener for securing the rail bracket to the rail, the post bracket defining an internal opening that is sized and shaped to generally correspond to a size and shape of the post, each of the first and second rail brackets being configured to lengthen or shorten a respective rail upon movement of the post bracket relative to the post, a first fastener connecting the first projecting portion to the first rail bracket, a second fastener connecting the second projecting portion to the second rail bracket.

The invention also provides for a fence system comprising a plurality of bracket systems, each bracket system comprising a post bracket that includes a first projecting portion and a second projecting portion, the post bracket being securable to a post via fasteners, the first projecting portion extending in one direction and the second projecting portion extending a different direction, a first rail bracket including a first end securable to the first projecting portion and a second end that is securable to a rail, a second rail bracket including a first end is securable to the second projecting portion and a second end that is securable to another rail, the post bracket defining an internal opening whose size and shape generally corresponds to a size and shape of a post, each of the first and second rail brackets being securable to a rail via fasteners and being configured to lengthen or shorten a respective rail upon movement of the post bracket relative to the post, wherein the fence system further comprises posts each having at least two post brackets and rails each having at least two rail brackets, wherein, prior to being secured thereto, each post bracket can slide up and down relative to each of the posts.

The fence system may further comprise channel members that are each connected to a plurality of slats or pickets and wherein each of the channel members is connected to each of the rails.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 6 shows a stock sheet metal part which will form a first embodiment rail bracket used in the first embodiment bracket system shown in FIGS. 2*a–b*. The figure illustrates the relative shape and size of the sheet metal part as well as the approximate relative position of the holes and bend-lines;

FIG. 7 shows a side view of the stock sheet metal part shown in FIG. 6;

FIGS. 8*a*, 8*b*, and 8*c* show top, side and bottom side views of the first embodiment rail bracket. The rail bracket is formed from the stock sheet metal part shown in FIG. 6. The formed rail bracket has been pierced with holes and also bent along the bend-lines;

FIGS. 9*a*, 9*b*, and 9*c* show three end views of the rail bracket shown in FIGS. 8*a*–8*c*. The views correspond to the views shown in FIGS. 8*a*–8*c;*

FIG. 41*a* shows that 2" by 4" long foam, plastic or wood spacer devices can be positioned near the ends of the rail channels (e.g., 4 per fence section) to prevent the rail channels from deflecting out of shape. Alternatively, no spacers need be used to ensure that the rail channels are not damaged while the fence sections are stacked on top of one another, as shown in FIG. 41*b;*

FIG. 42*b* shows that no spacers need be used to ensure that the rail channels are not damaged while stacked on top of one another;

FIG. 61 shows a stock sheet metal part which will form a third embodiment rail bracket which can be used in place of the first embodiment. The figure illustrates the relative shape and size of the sheet metal part as well as the position of the holes and bend-lines;

FIG. 62 shows a side view of the stock sheet metal part shown in FIG. 61;

FIGS. 63*a*. 63*b*, and 63*c* show top, side and bottom cross-sectional side views of the third embodiment rail bracket that can be made from the sheet stock shown in FIG. 61. The rail bracket is formed with an accordion type section that allows the rail bracket to be bent or deflected laterally and/or up and down. The formed rail bracket has been pierced with holes, formed with the accordion section, and also bent along the bend-lines;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Moreover, the various embodiments are shown having relative scale (i.e., enabling one to compare relative sizes of the various features) for the purpose of illustrating various preferred embodiments. However, the invention contemplates numerous variations in sizes as well as relative sizes of the various features.

Figure 1:
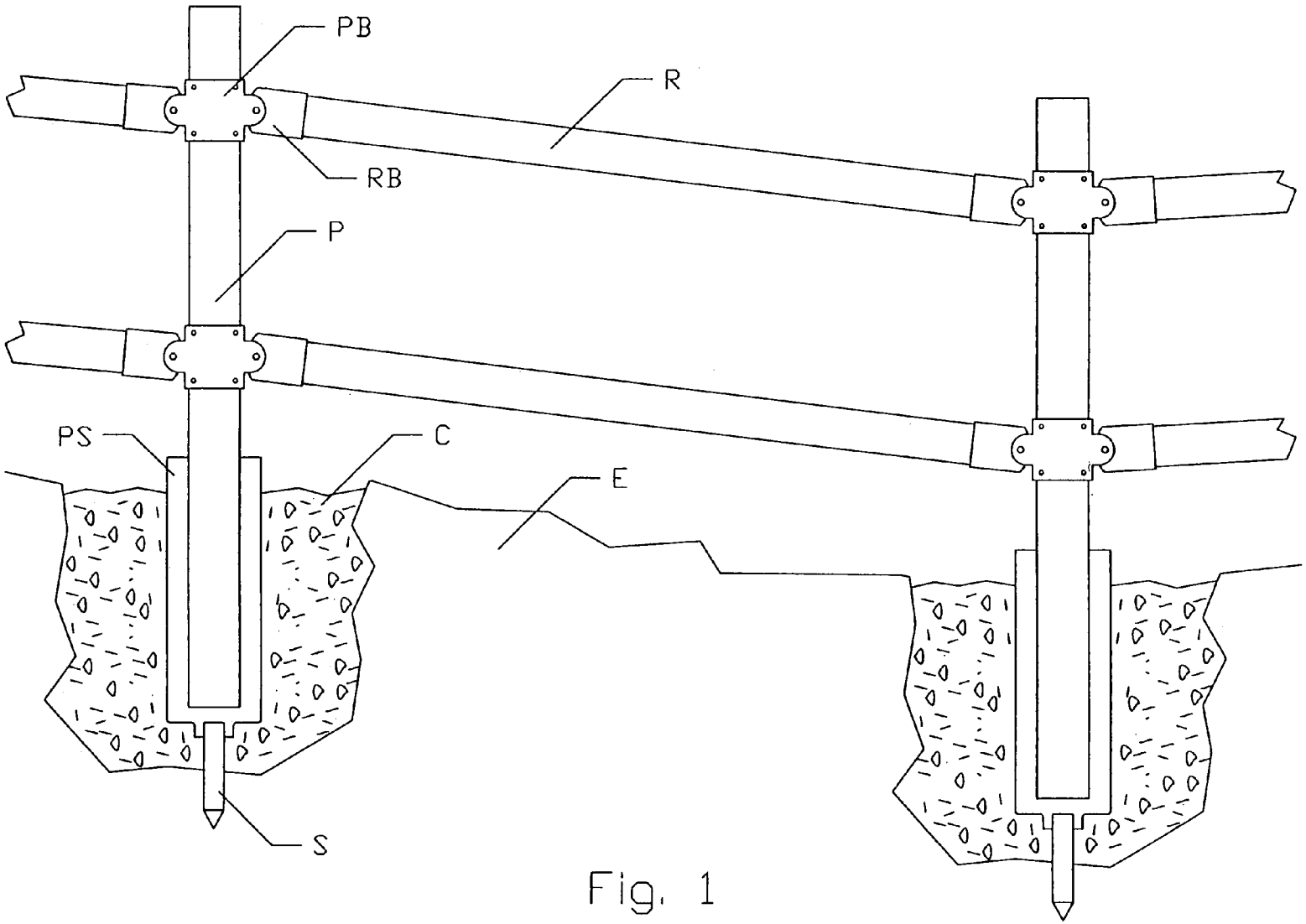
FIG. 1 shows a side view representation of a simple post and rail fence installed on site and utilizing a first embodiment bracket system of the invention. The fasteners which would secure the post brackets to the posts and those which would secure the tail brackets to the post brackets are not shown, but the openings that would receive the fasteners are shown.

FIG. 1 shows one embodiment of a fence according to the invention. The fence includes a plurality of fence posts P and rails R. The rails R and posts P can be solid or tubular and can have any cross-sectional shape (e.g., square, rectangular, round, oval, etc), size and length, and can be made of any material, whether conventionally used in fence construction or otherwise, and can be made of, e.g., plastic, metal or wood. In this embodiment, the posts P are five foot long 4×4 pressure treated wood posts, which means that they have a square cross-sectional shape that is approximately 3.5 inches by 3.5 inches square. The posts P are fixed to the ground or earth E on site by digging holes therein, placing a bottom end of the post P into each opening, and pouring concrete C into the openings. The concrete C surrounds the posts P and ensures that they are securely fixed to the ground E. As is typical, the posts P are leveled in position and become well secured to the ground E once the concrete C is fully cured. The invention, however, improves the prior art by providing the posts P with protective sleeves PS. These sleeves PS can be made of, e.g., plastic or synthetic resin. The protective sleeves PS are designed to slide over an end of each post P so as to prevent moisture in the concrete C from penetrating into the posts P. In this regard, it is preferred that the sleeves PS have an external diameter of approximately 6" and an internal opening whose size and shape is slightly larger, i.e., approximately 1/16" larger, than that of the post P. It is also preferred that the sleeves be sufficiently long, e.g., 12" to 24" or more long not including the stake S, to accept therein between 8" and 1.5 feet or more of the post P. To facilitate proper installation of the posts P in the ground E, a stake S is attached to a bottom part of the protective sleeve PS. The stake S can be either removably attached or fixed to the sleeve PS. Using this arrangement, the posts P can be leveled and held in position temporarily without resort to concrete C, i.e., if the stakes S penetrate the earth E by approximately 6", they should be able maintain the posts P in vertical orientation without any concrete C. Preferably, the stakes S are in the range of 8" to 18" inches or more long.

Thus, the invention contemplates that the entire fence can be assembled on site (as will be more fully described herein) without the posts P being initially set in the ground E with concrete C. Once the fence is fully assembled on site, concrete C can then be poured into each of the openings surrounding the posts P. Conventionally, the posts P are leveled and set into the ground with concrete on one day and then the fence is assembled to the posts P on another day, i.e., once the concrete C has set to a significant extent. However, with the invention, the entire fence can assembled on the same day, so that when the concrete C is finally poured into the post openings, the fence becomes securely fixed to the ground. The workmen installing the fence would only have to come back to the site on another day to remove any bracing (which may be used to ensure that the fence is not disturbed by the wind or by inadvertent contact therewith) and to preform any required cleaning and/or backfilling, as necessary.

In assembling the simple post and rail fence shown in FIG. 1, the invention provides for a bracket system that can couple or connect the rails R to the posts P. The bracket system includes post brackets PB, rail brackets RB and bolts B (not shown) connecting the rail brackets RB to each post bracket PB. Each post bracket PB is made of a thin material such as, e.g., sheet metal or extruded plastic, and is designed to generally surround the post P. Each post bracket PB has an internal opening that is shaped (e.g., square, rectangular, round, oval, etc), and sized to slide snugly over the post P. In this way, the post bracket PB slide up and down on the post P depending on a desired positioning. Once in position, each post bracket PB can be fastened to the post P via, e.g., nails, barbs or screws. To facilitate this fastening, a number of barbs and/or through holes (four holes being shown on each front surface) can be provided in each post bracket PB. In the embodiment shown in FIG. 1, two posts brackets PB are used on each post P.

Each post bracket PB has a wide middle or central portion and two narrower side projecting portions which each engage with a rail bracket RB. The rail brackets RB are slid over the ends of each rail R. Each rail bracket RB also has an internal opening that is shaped (e.g., square, rectangular, round, oval, etc., depending on the shape of the rail), and sized to slide snugly over the end of the rail R. In this way, the rail bracket RB can be used to adjust the length of the rail R depending on a movement of the post bracket PB, as will be more fully described herein. Each rail bracket RB also has a projecting portion that engages the projecting portions of the post bracket PB. Once in position on a rail R, each rail bracket RB can be fastened to the rail R via, e.g., nails, barbs or screws. To facilitate this fastening, a number of barbs and/or through holes (not shown) are provided in each rail bracket RB. In the embodiment shown in FIG. 1, two rail brackets RB are coupled to opposite sides of each post bracket PB.

The rail bracket RB is similarly made of a thin material such as, e.g., sheet metal, and surrounds the end of the rail R. As will be more clearly described later on, each rail bracket RB has one or two opposite facing projecting portions or tabs which each have an opening and a curved end. Similarly, each of the projecting portions of the post bracket PB has an opening and a curved end. In assembling the rails R to the posts P, the openings of the rail brackets RB are aligned with the openings of the post brackets PB. Then, bolts B (see e.g., FIG. 2*a*) are installed in the openings to connect each rail bracket RB to a post bracket PB. Once it is determined that the fence is fully and correctly aligned with the ground, that all of the rails R are aligned with one another, and/or that the entire fence has the desired overall appearance, the rail brackets RB and the post brackets PB can be fully fastened to the rails R and posts P via nails, barbs or screws. This step essentially completes the assembly of the rails R to the posts P. Of course, to finish the fence, it may also be necessary to cut down the overall height of the posts P and, perhaps, to cap them off with a decorative post cap (not shown). Finally, the concrete C can be poured to complete the fence installation on site. Of course, the fence bracket system can be used to make the fence in any other desired manner, whether conventional or otherwise.

Just as with the posts P, the rails R can have any cross-sectional shape, size and length and can be made of any material, whether conventionally used in fence construction or otherwise, such as, e.g., plastic, metal or wood. However, in this embodiment (with the posts P being arranged approximately 8 feet on center), the rails R are approximately seven foot six inches long 2×3 pressure treated wood rails. This means that they have a rectangular cross-sectional shape that is approximately 1.5 inches by 2.5 inches. Additionally, it should be noted that while FIG. 1 shows a fence that uses only posts P and rails R, i.e., having no pickets or slats, it should be apparent that the invention can also be practiced with fences that utilize fence sections—with each fence section having two or more rails R and slats or pickets attached to the rails. Such a fence would resemble the one shown in, e.g., FIGS. 30 and 31.

The advantage of the bracket system of the invention is that the fence can be made much stronger that those which are merely nailed or screwed together, those which use basic side-attaching L-brackets, and/or those which merely insert the ends of the rails into lateral openings in the posts P. Moreover, a fence that is made using the bracket system of the invention can be easily repaired and/or adjusted, i.e., by removing the fasteners which secure the rail brackets RB to the rails R and the post brackets PB to the posts P, and by moving the post brackets PB up and down. Additionally, the length of the rails R can be adjusted quickly and easily without significantly affecting strength of the fence. In this regard, two rail brackets RB can lengthen or shorten a rail R a certain significant extent (up to approximately 3 inches or more depending on the length and size of the rail brackets RB). This adjustment results from the fact that the rail brackets RB are slidably mounted to the ends of the rails R and act to extend or shorten the rails R depending on the relative position of the rail brackets RB on the rails R. This also results in the advantage that the rails R need not be cut on site to a precise and custom length, i.e., often dictated by the exact distance between adjacent posts P, as in the prior art. This also means that the ends of the rails R do not have to be precisely shaped or angled (i.e, using the bracket system of the invention, they can have perpendicular ends and yet be angled with respect to the posts P), especially when the rails R are not oriented perpendicular to the posts P. Mitering of the rail ends is often employed in the prior art when the ends of the rails R are angled so that they can be butted-up against the posts P and nailed thereto.

Figure 2A:
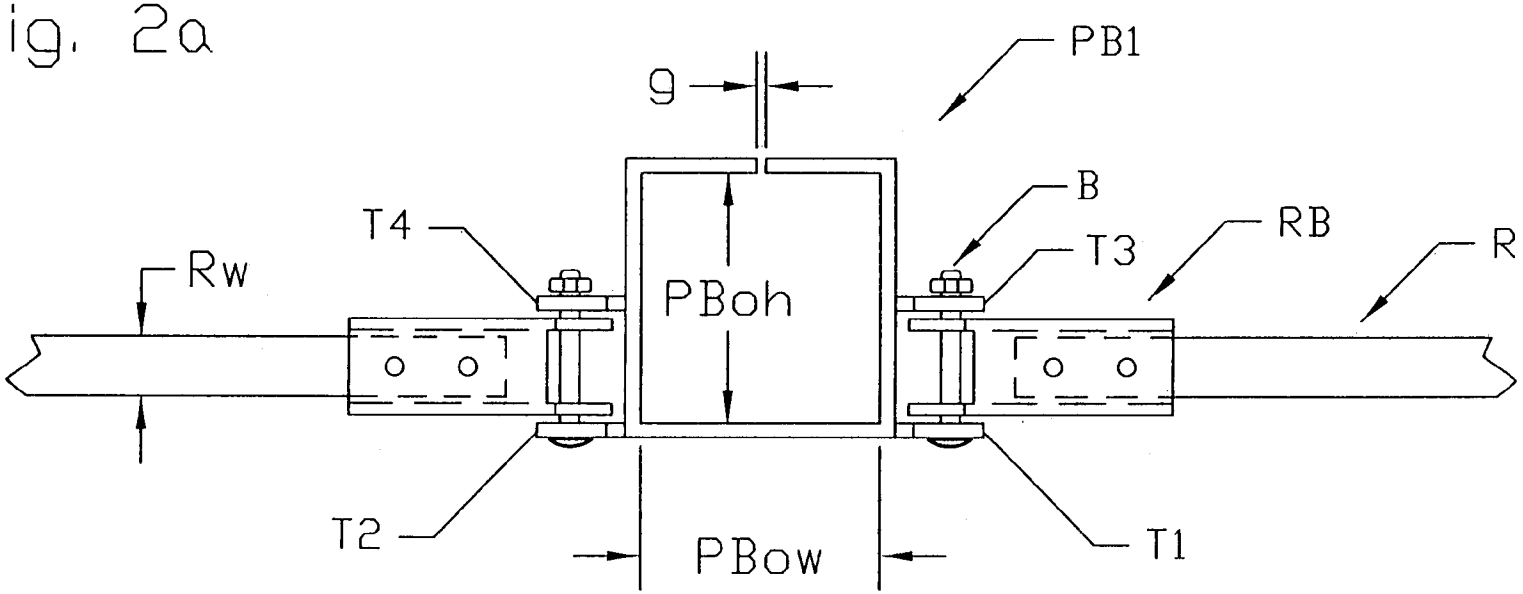
FIG. 2*a* shows a top view of a first embodiment of the bracket system of the invention. The rails are shown installed in the rail brackets, but the fence post is not shown installed in the post bracket. The fasteners which would secure the rail brackets to the rails are not shown, but the openings that would receive the fasteners are shown.
Figure 2B:
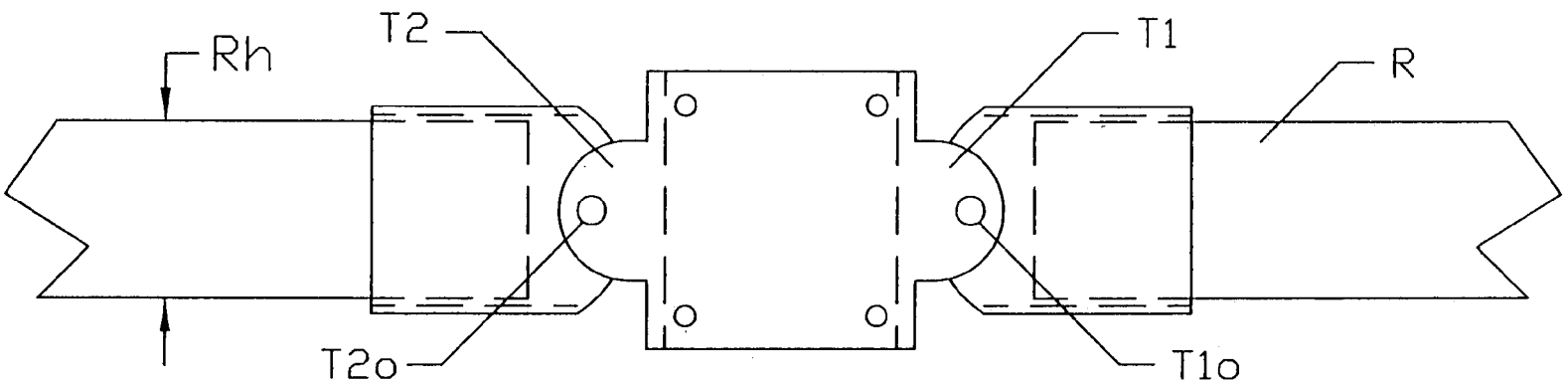
FIG. 2*b* shows a side view of the embodiment shown in FIG. 2*a*, except that the bolts securing the rail brackets to the post bracket have been removed.

FIGS. 2*a–b* show one embodiment of the bracket system according to the invention. The bracket system uses a unitary or one-piece post bracket PB1 that has a square-shaped opening that is sized and shaped to slide over a fence post P (not shown). In this case, the fence post would have a 4×4 cross-sectional square shape, which means that the square shaped opening defined by the post bracket PB1 is slightly larger than 3.5 inches by 3.5 inches. It is preferred that the square shaped opening of the post bracket PB1 be approximately 1/16 inches larger than the post P, i.e., the opening should have the following dimensions, PBow=3*frax*;9;16 inches and PB*oh*=3 9/16 inches. In this way, the post bracket PB1 can slide up and down on the post P until it is secured thereto by fasteners such as, e.g., nails, barbs or screws (not shown). The post bracket PB1 can be made in any desired way and can be made of any desired material such as plastic or metal. However, it is preferred that it be made of sheet metal and specifically galvanized sheet metal. The post bracket PB1 should also be made thin, but not so thin that strength is sacrificed to a significant extent. In this regard, it is preferred that the post bracket PB 1 have a thickness TH (see FIG. 4) in the range of approximately 1/32 inches to approximately 1/8 inches or more depending on the size of the fence. A particular preferred material and thickness TH is in the range of between 22 gage and 11 gage, with 12 gage (approximately 1/10" thick) galvanized sheet metal being preferred. Of course, the post bracket PB1 can also be made of plastic and formed as a unitary structure having a shape that resembles that of FIG. 5, but without gap "g", i.e., it can be cast, molded or extruded as in the embodiment shown in FIGS. 66*a–b*, but have the shape shown in FIG. 5 and with or without the gap "g".

Again, with reference to FIGS. 2*a–b*, the post bracket PB1 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness TH of the remaining part of the post bracket PB1. As can be seen in FIG. 2*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts B to withstand environmental conditions. It is also preferred that galvanized nuts be used with the bolts B. Alternatively, rivets or other fasteners can be used to connect the rail brackets RB to the post bracket PB.

A left side rail bracket RB formed as a unitary or one-piece member is connected to the tabs T2 and T4 of the post bracket PB via the bolt B. Similarly, a right side rail bracket RB formed as a unitary or one-piece member is connected to the tabs T1 and T3 of the post bracket PB1 via the other bolt B. Each rail bracket RB has one end that receives therein an end of a rail R and another end that connects to the post bracket PB1. In this regard, each rail bracket RB has two tabs that each have an opening that receive the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=11.5" and Rh=2.5". In this way, each rail bracket RB can slide over the end of each rail R until it is secured thereto by fasteners such as, e.g., nails, barbs or screws (not shown). The two rail brackets RB are generally identical to each other and can be fabricated in any desired way. They can also be made of any desired material such as plastic or metal. However, it is preferred that they be made of sheet metal and specifically galvanized sheet metal of the same type as that used to make the post bracket PB. The rail bracket RB should thus be made thin, but not so thin that strength is sacrificed to a significant extent. In this regard, it is preferred that each rail bracket RB have a thickness "th" (see FIG. 7) in the range of approximately 1/32 inches to approximately 1/8 inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure having a shape that resembles that of FIG. 8, but without gap "g", i.e., it can be cast, molded or extruded as a one-piece member, but have the shape shown in FIG. 8 and with or without the gap "g". The invention also contemplates using spacers of the type shown in, e.g., FIG. 65*a*, in the embodiment shown in FIGS. 2*a–b*.

In FIG. 2*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 as well as with the two openings in the left-side rail bracket RB. This is evident in FIG. 2*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment tabs T1–T4 are arranged near the outside portion of the post bracket PB1. As a result, tabs T1 and T2 are arranged to be generally flush with the outer wall of post bracket PB1. The inner wall of post bracket PB1 includes the two edges of the post bracket PB1 with a space being provided between these two edges. This space is defined by gap "g" and results from the fact that the post bracket PB1 is bent from a one piece sheet metal blank. The gap "g" should be made as small as possible, preferably in the range of between approximately 1/16" and 1/4". The gap "g" can serve an important purpose in that it allows for a variation in dimension PBow in order to account for any variations in the cross-sectional size and shape of the post P. This way, any clearances between the post bracket PB1 and the post P can be reduced.

In the embodiment just described (using a 4×4 post P and 2×3 rails R), the tabs T1–T4 may project from each of the opposite sides of the post bracket PB1 in the range of between approximately 1" and 1.5". The bolts B may be 1/4" diameter and may have a length in the range of between approximately 2" and 2.5". The openings in the tabs T1–T4, and the openings in the tabs of the rail brackets RB, should have approximately 5/16" diameter to accommodate the 1/4" bolts B. The rail brackets RB may have a length (measured from the curved edge to the opposite straight edge) in the range of between approximately 2" and 5", with 3" being preferred. The post bracket PB1 may have a width W (see FIG. 3) that is in the range of between approximately 3.5" and 5", with 4" being preferred when PBow and PBoh are each approximately 3 9/16". The distance between the inner parallel surfaces of tabs T2 and T4, as well as between the inner parallel surfaces of tabs T1 and T3, should be in the range of between approximately 1 11/16" and 1 3/4". The width of the tabs T1–T4 should be in the range of between 1.5" to 3" depending on the width W of the post bracket PB1. Preferably, the width of the tabs T1–T4 should be in the range of between approximately 25% to approximately 75% of the width W of the post bracket PB1. The openings No (see FIG. 3) of the post bracket PB1 and the openings "no" (see FIG. 6) of the rail brackets RB can be between approximately 1/16" to approximately 3/16" diameter or more to receive fasteners such as nails or screws, and may be counter-sunk or counter-bored, if desired. Integrally formed barbs can also be provided on the rail brackets RB or on the post bracket PB1 as in the embodiment shown in, e.g., FIGS. 58*a–b*.

Figure 3:
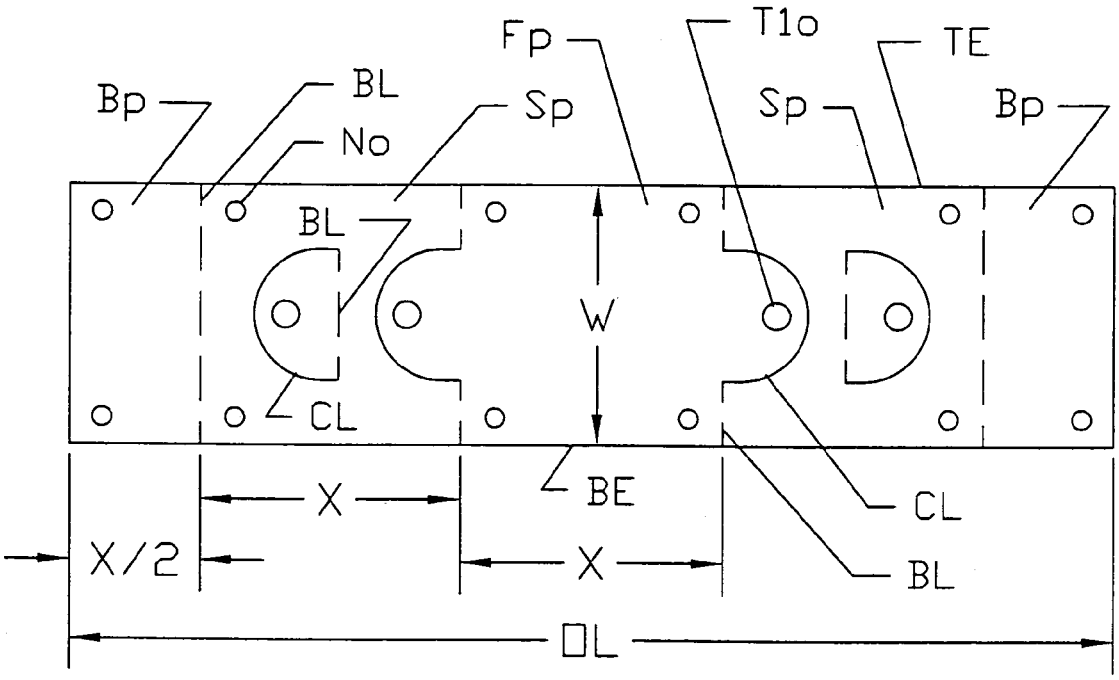
FIG. 3 shows a stock sheet metal part which will form the post bracket used in the first embodiment bracket system shown in FIGS. 2*a–b* The figure illustrates the relative shape and size of the sheet metal part as well as the approximate relative position of the holes, bend-lines, and cut-lines.

FIG. 3 illustrates the layout of a piece of sheet metal which can be used to form the post bracket PB1. The various features are not drawn to scale. However, the general arrangement or positions of the bend lines, holes and cut lines are shown to illustrate their general locations. The sheet metal piece has a generally rectangular shape with an upper or top edge TE and a lower or bottom edge BE. To form the generally square shaped bracket PB1 shown in FIG. 5, the sheet metal piece has five sections which are defined by four bend lines BL that extend from edge TE to edge BE. Beginning from the left side, left section Bp is defined by the left side edge of the rectangular sheet metal piece and the first bend-line BL. Left section or left side back panel Bp will form approximately 1/29 of the back wall of the post bracket PB1. As a result, the length of this section Bp (measured between left edge and the first bend-line BL) is approximately half of X, where X is the length of sections Sp and section Fp. As can be seen in FIG. 3, left-side back section or panel Bp has two openings No which can receive fasteners for securing the post bracket PB1 to a post P. These through openings No are arranged in the area of two of the corners of the left back section Bp. Of course, the openings No can be arranged anywhere on the post bracket PB1 and in any desired configuration, and need not even be arranged on the left back section Bp, if desired. The holes can have any desired shape and can even have the shape of slots instead of circular holes.

The next section is left section or side panel Sp which will form the left side wall of the post bracket PB1. The first and second bend-lines BL that define left section Sp have a length X. As can be seen in FIG. 3, left section Sp has two tabs which each have a curved edge and two small straight edges that are each cut or severed from the section Sp. The cut-line CL for each tab extends to the bend-line BL of each tab to define the entire perimeter of the tabs. In this way, after left section Sp is bent along the second bend-line BL, and after the outer most left-side tab T4 is bent outwards at a right angle along the tab bend-line BL, the tabs T2 and T4 shown in FIG. 5, will be formed. Each tab T1–T4 also has a through opening formed therein, e.g., tab T1 has opening T1*o*. As can be seen in FIG. 3, left section Sp has two openings No which can receive fasteners for securing the post bracket PB 1 to a post P. These through openings No are arranged in the area of two of the corners of the left section Sp, if desired. Of course, the openings No can be arranged anywhere on the post bracket PB1 and in any desired configuration, and need not even be arranged on the left section Sp. They can have any shape such as, e.g., slots instead of circular holes.

The next section is front section or front panel Fp which will form the front side wall of the post bracket PB1. As can be seen in FIG. 3, front section Fp has four openings No which can receive fasteners for securing the post bracket PB 1 to a post P. These through openings No are arranged in the area of the corners of the front section Fp. Of course, the openings No can be arranged anywhere on the post bracket PB 1 and in any desired configuration, and need even not be arranged on the front section Fp. They can even have the shape of slots instead of circular holes. In this embodiment, the inner most tabs T1 and T2 actually extend from and are arranged on the same plane as the front section Fp (see e.g., FIG. 5). The second and third bend-lines BL that define front section Fp have a length X. In this way, after left and right sections Sp are bent along the second and third bend-lines BL, and after the outer most left-side and right-side tabs T4 and T3 are bent outwards at a right angle along the tab bend-lines BL, the tabs T2 and T4 and T1 and T3 shown in FIG. 5, will be formed.

The next section is right section or side panel Sp which will form the right side wall of the post bracket PB1. The third and fourth bend-lines BL that define right section Sp have a length X. As can be seen in FIG. 3, right section Sp also has two tabs which each have a curved edge and two small straight edges that are each cut or severed from the section Sp. The cut-line CL for each tab extends to the bend-line BL of each tab to define the entire perimeter of the tabs. In this way, after right section Sp is bent along the third bend-line BL, and after the outer most right-side tab T3 is bent outwards at a right angle along bend-line BL, the tabs T1 and T3 shown in FIG. 5, will be formed. As can be seen in FIG. 3, right section Sp has two openings No which can receive fasteners for securing the post bracket PB1 to a post P. These through openings No are arranged in the area of two of the corners of the right section Sp. Of course, the openings No can be arranged anywhere on the post bracket PB1 and in any desired configuration, and need not even be arranged on the right section Sp, if desired. They can even have the shape of slots instead of circular holes.

The last section is the right side back section Bp and is defined by the right side edge of the rectangular sheet metal piece and the fourth bend-line BL. Right back section or back panel Bp will form approximately ½ of the back wall of the post bracket PB1. As a result, the length of this section Bp (measured between right edge and the fourth bend-line BL) is approximately half of X, where X is the length of sections Sp and section Fp. As can be seen in FIG. 3, right-side back section or panel Bp has two openings No which can receive fasteners for securing the post bracket PB 1 to a post P. These through openings No are arranged in the area of two of the corners of the right back section Bp. Of course, the openings No can be arranged anywhere on the post bracket PB1 and in any desired configuration, and need not even be arranged on the left back section Bp. They can even have the shape of slots instead of circular holes.

The dimensions X and W can be configured to match the requirements of a particular fence and may depend on the post P size and the thickness TH (see FIG. 4) of the sheet metal piece. However, for a fence that uses 4×4 wooden posts and with a sheet metal thickness of approximately 1/10" or less, these dimensions can be W being about 3 to 5", with 4" being preferred and with X being about 3 9/16". The overall length OL will, of course, depend on the bend radii used in the four section bends (with radii of between 1/64" and 1/8" being preferred), the sheet metal thickness TH, the dimensions PBow and PBoh, and the desired gap "g". This information can be developed using standard formulas and bending machinery which account for bend allowances. Such information is well known to those who work with sheet metal fabrication. To facilitate an understanding of bend allowances, Machinery's Handbook (Twentieth Edition) is hereby incorporated by reference with at least pages 1921–1926 being expressly incorporated by reference for this purpose.

Figure 4:
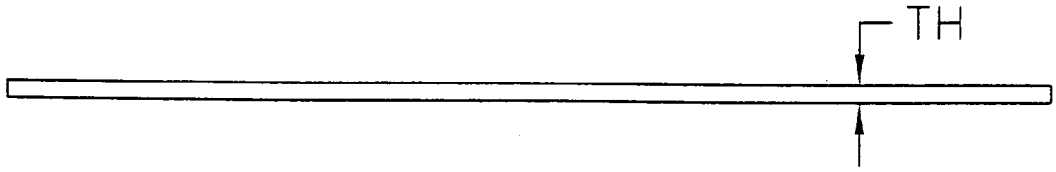
FIG. 4 shows a side view of the stock sheet metal part shown in FIG. 3.
Figure 5:
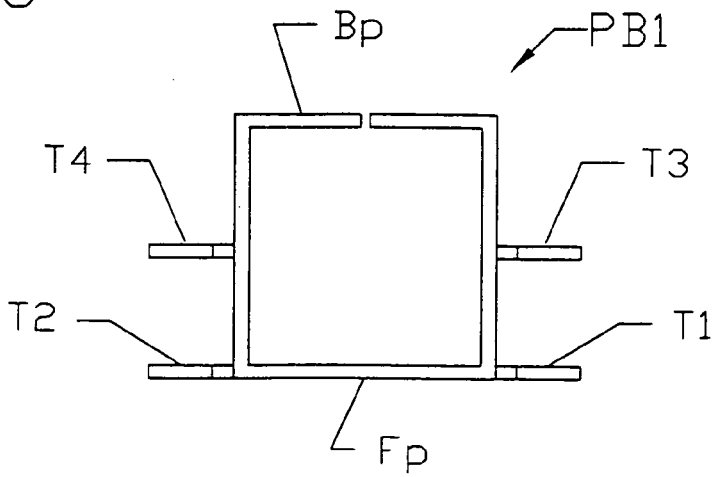
FIG. 5 shows a top view of the first embodiment of the fence post bracket which is formed from the stock sheet metal part shown in FIG. 3. The formed post bracket has been pierced with holes and also cut and bent along the cut-lines and bend-lines.

In forming the post bracket PB1 shown in FIG. 5, any number of desired and cost-effective methods and devices can be used. The state of the art in sheet metal fabrication includes devices which can form the openings No and cut-lines CL by punching, water-jet cutting, laser cutting, plasma cutting. Today's equipment also includes manual cutting and bending devices, in addition to Computer Numerical Control (CNC) punch presses, as well as CNC plasma and laser cutters. One inexpensive way of forming the post bracket shown in FIGS. 3–5, is to use a punch press to form the plate shown in FIG. 3 with the holes No and T1*o*–T4*o*, and cut-lines CL being cut in the punch press. One or more secondary operations can then be used to form the bends resulting in the post bracket shown in FIG. 5. It is desirable to make the post bracket PB1 as cheaply as possible, since a typical fence may require dozens of post brackets PB1, yet strength and ease of use should not be sacrificed to a significant extent. Accordingly, it is believed that forming the post brackets PB1 from a one-piece sheet metal piece satisfies these requirements. Of course, an alternative way of forming the bracket shown in FIG. 5, can be by molding, casting or extrusion, whether the post bracket PB1 is to be made of metal or plastic, or even plastic coated metal. For example, today's equipment can extrude substantially the shape shown in FIG. 5, with or without the gap "g". Thereafter, the tabs T1–T4 and holes No and T1*o*–T4*o* can be precisely formed or shaped with cutting devices by milling, shaping, cutting, punching, and drilling, etc.

FIG. 6 illustrates the layout of a piece of sheet metal which can be used to form first embodiment rail bracket RB. The various features are not drawn to scale. However, the general arrangement or positions of the bend lines and holes are shown to illustrate their general locations. The sheet metal piece has a generally rectangular shape with an upper or top edge having tab portions which extend therefrom and a lower or bottom edge. To form the generally rectangular shaped rail bracket RB shown in FIGS. 8 and 9, the sheet metal piece has five sections which are defined by four bend lines BL which extend from the top edge to the bottom edge. Beginning from the left side, left back section "bp" is defined by the left side edge of the rectangular sheet metal piece and the first bend-line BL. Left section or left side back panel "bp" will form approximately ½ of the bottom wall of the rail bracket RB. As a result, the length of this section "bp" (measured between left edge and the first bend-line BL) is approximately half of "y", where "y" is the length of section "fp". As can be seen in FIG. 6, left-side back section or panel "bp" has two openings "no" which can receive fasteners for securing the rail bracket RB to a rail R. These through openings "no" are arranged in the area of the center of the left back section "bp". Of course, the openings "no" can be arranged anywhere on the rail bracket RB and in any desired configuration, and need not even be arranged on the left back section "bp". They can have any desired shape such as the shape of slots instead of circular holes.

The next section is left section or side panel "sp" which will form an inner side wall of the rail bracket RB. The first and second bend-lines BL that define left section "sp" have a length "x". As can be seen in FIG. 6, left section "sp" has a tab portion with a curved edge that extends from a top edge of the sheet metal piece by a distance "h". The tab also has a through opening "spo" formed therein. Left section "sp" does not have any openings "no" for receiving fasteners that secure the rail bracket RB to a rail R. However, such through openings "no" can be arranged, if desired, anywhere on the section "sp". Of course, as with the openings No of the post bracket PB1, the openings "no" can be arranged anywhere on the rail bracket RB and in any desired configuration. They can even have the shape of slots instead of circular holes.

The next section is the front section or panel "fp" which will form the upper side wall of the rail bracket RB. As can be seen in FIG. 6, front section "fp" has two openings "no" which can receive fasteners for securing the rail bracket RB to a rail R. These through openings "no" are arranged in the area of the center of the front section "fp". Of course, the openings "no" can be arranged anywhere on the rail bracket RB and in any desired configuration, and need even not be arranged on the front section "fp". They can even have the shape of slots instead of circular holes. The second and third bend-lines BL defines front section "fp" which has a length "y". In this way, after left and right sections "sp" are bent along the second and third bend-lines BL, the tabs will be arranged parallel to one another, as shown in FIGS. 8 and 9.

The next section is right section or side panel "sp" which will form the outer side wall of the rail bracket RB. The third and fourth bend-lines BL that define right section "sp" have a length "x". As can be seen in FIG. 6, right section "sp" has a tab portion with a curved edge that extends from a top edge of the sheet metal piece by a distance "h". The tab also has a through opening "spo" formed therein. Right section "sp" does not have any openings "no" for receiving fasteners that secure the rail bracket RB to a rail R. However, such through openings "no" can be arranged, if desired, anywhere on the section "sp". Of course, as with the openings No of the post bracket PB1, the openings "no" can be arranged anywhere on the rail bracket RB and in any desired configuration. They can even have the shape of slots instead of circular holes.

The last section is the right side back section "bp" and is defined by the right side edge of the rectangular sheet metal piece and the fourth bend-line BL. Right back section or back panel "bp" will form approximately ½ of the bottom wall of the rail bracket RB. As a result, the length of this section "bp" (measured between right edge and the fourth bend-line BL) is approximately half of "y", where "y" is the length of section "fp". As can be seen in FIG. 6, right-side back section or panel "bp" has two openings "no" which can receive fasteners for securing the rail bracket RB to a rail R. These through openings "no" are arranged in the area of the center of the right back section "bp". Of course, the openings "no" can be arranged anywhere on the rail bracket RB and in any desired configuration, and need not even be arranged on the left back section "bp". They can even have the shape of slots instead of circular holes.

The dimension "x", "y", "w" and "h" can be configured to match the requirements of a particular fence and may depend on the thickness "th" (see FIG. 7) of the sheet metal piece. However, for a fence that uses 2×3 wooden rails and with a sheet metal thickness of approximately 1/10" or less, these dimensions can be "w" being about 2 to 4", with 3" being preferred, with "y" being approximately 1 9/16", with "h" being between approximately ½" and approximately ¾", and with "x" being about 2 9/16". The overall length "ol" will, of course, depend on the bend radii used in the four section bends (with radii of between 1/64" and ⅛" being preferred), the sheet metal thickness "th", the dimensions Rw and Rh, and the desired gap "g". This information can be developed using standard formulas and bending machinery which account for bend allowances. Such information is well known to those who work with sheet metal fabrication.

In forming the rail bracket RB shown in FIGS. 8*a*, 8*b*, and 8*c* and 9*a*, 9*b*, and 9*c*, any number of desired and cost-effective methods and devices can be used. The state of the art in sheet metal fabrication includes devices which can form the openings "no" and "spo" by punching, waterjet cutting, laser cutting, plasma cutting, etc. Today's equipment also includes manual cutting and bending devices in addition to Computer Numerical Control (CNC) punch presses, as well as CNC plasma and laser cutters. One inexpensive way of forming the rail bracket RB shown in FIGS. 6–9, is to use a punch press to form the plate shown in FIG. 6 with the holes "no" and "spo" being cut in the punch press. One or more secondary operations can then be used to form the bends resulting in the rail bracket shown in FIGS. 8*a*, 8*b*, and 8*c* and 9*a*, 9*b*, and 9*c*. It is desirable to make the rail bracket RB as cheaply as possible, since a typical fence may require dozens of rail brackets RB, yet strength and ease of use should not be sacrificed to a significant extent. Accordingly, it is believed that forming the rail brackets RB from a one-piece sheet metal piece satisfies these requirements. Of course, an alternative way of forming the bracket shown in FIGS. 8*a*. 8*b*, and 8*c* and 9*a*, 9*b*, and 9*c*, can be by molding, casting or extrusion, whether the rail bracket RB is to be made of metal or plastic, or even plastic coated metal. For example, today's equipment can extrude substantially the shape shown in FIGS. 9*a*–9*c*, with or without the gap "g". Thereafter, the tabs and holes "no" and "spo" can be formed or shaped with cutting devices by milling, shaping, cutting, punching, and drilling, etc.

Figure 10A:
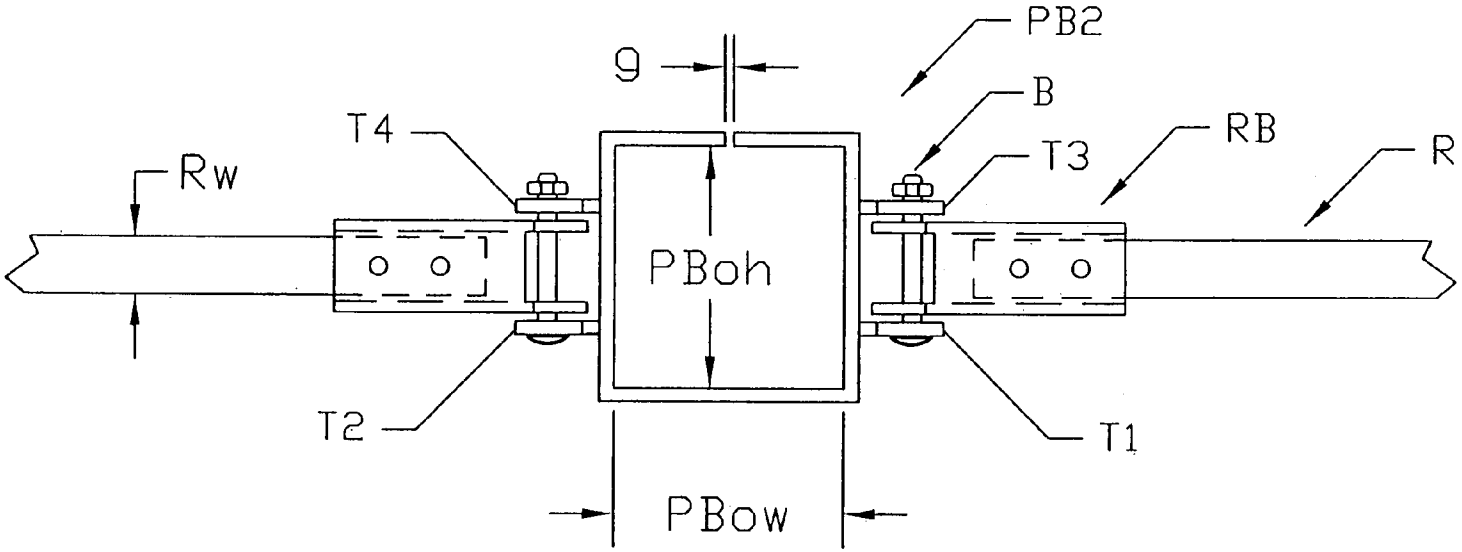
FIG. 10*a* shows a top view of a second embodiment of the bracket system of the invention. The rails are shown installed in the rail brackets, but the fence post is not shown installed in the post bracket. The fasteners which would secure the rail brackets to the rails are not shown, but the openings that would receive the fasteners are shown.
Figure 10B:
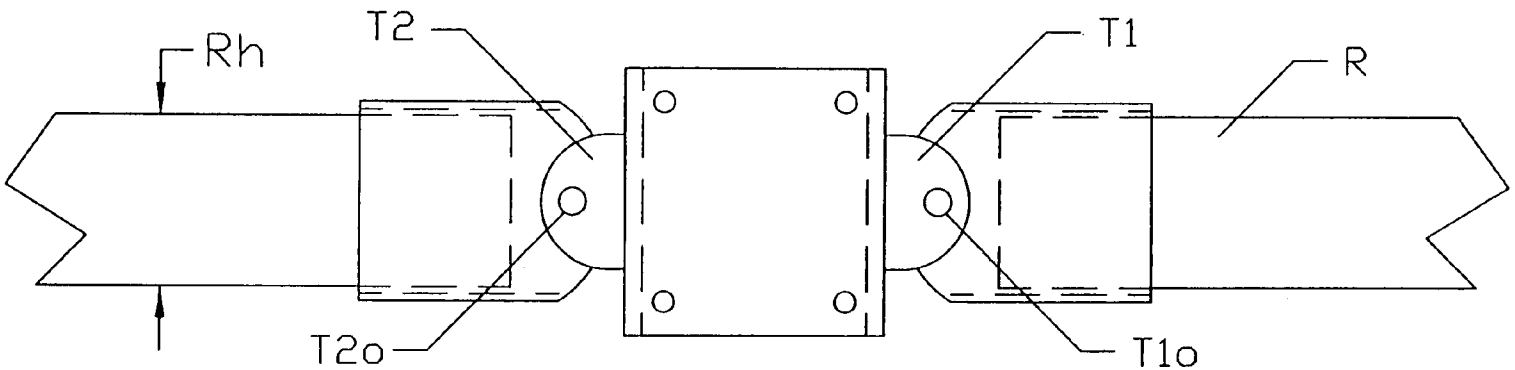
FIG. 10*b* shows a side view of the embodiment shown in FIG. 10*a*, except that the bolts securing the rail brackets to the post bracket have been removed.

FIGS. 10*a*–*b* show another embodiment of the bracket system according to the invention. The bracket system uses a unitary or one-piece post bracket PB2 that has a square-shaped opening that is sized and shaped to slide over a fence post P (not shown). In this case, the fence post would have a 4×4 cross-sectional square shape, which means that the square shaped opening defined by the post bracket PB2 is slightly larger than 3.5 inches by 3.5 inches. It is preferred that the square shaped opening of the post bracket PB2 be approximately 1/16 inches larger, i.e., the opening should have the following dimensions, PBow=approximately 3 9/16 inches and PBoh=approximately 3 9/16 inches. In this way, the post bracket PB2 can slide up and down on the post P until it is secured thereto by fasteners such as, e.g., nails, barbs or screws (not shown). The post bracket PB2 can be made in any desired way and can be made of any desired material such as plastic or metal. However, it is preferred that it be made of sheet metal and specifically galvanized sheet metal. The post bracket PB2 should also be made thin, but not so thin that strength is sacrificed to a significant extent. In this regard, it is preferred that the post bracket PB2 have a thickness TH (see FIG. 12) in the range of approximately 1/32 inches to approximately ⅛ inches or more depending on the size of the fence. A particular preferred material and thickness TH is in the range of between 22 gage and 11 gage, with 12 gage (approximately 1/10" thick) galvanized sheet metal being preferred. Of course, the post bracket PB2 can also be made of plastic and formed as a unitary structure having a shape that resembles that of FIG. 13, but without gap "g", i.e., it can be cast, molded or extruded as in the embodiment shown in FIGS. 66*a–b*, but have the shape shown in FIG. 13 and with or without the gap "g".

Again, with reference to FIGS. 10*a–b*, the post bracket PB2 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness of the remaining part of the post bracket PB2. As can be seen in FIG. 10*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts to withstand environmental conditions. It is also preferred that galvanized nuts be used with the bolts B.

A left side rail bracket RB of the type shown in FIGS. 6–9 is connected to the tabs T2 and T4 of the post bracket PB2 via the bolt B. Similarly, a right side rail bracket RB of the type shown in FIGS. 6–9 is connected to the tabs T1 and T3 of the post bracket PB1 via the other bolt B. Each rail bracket RB has one end that receives therein an end of a rail R and another end that connects to the post bracket PB2. In this regard, each rail bracket RB has two tabs which each have an opening that receives the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB can slide over the end of each rail R until it is secured thereto by fasteners such as, e.g., nails, barbs or screws (not shown). The two rail brackets RB are generally identical to each other and can be fabricated in any desired way. They can also be made of any desired material such as plastic or metal. However, it is preferred that they be made of sheet metal and specifically galvanized sheet metal of the same type as that used to make the post bracket PB2. The rail bracket RB should thus be made thin, but not so thin that strength is sacrificed to a significant extent. In this regard, it is preferred that each rail bracket RB have a thickness "th" (see FIG. 7) in the range of approximately 1/32 inches to approximately 1/8 or more inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure as described above. Spacers of the type shown in FIG. 65*a* can also be used in this embodiment.

In FIG. 10*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 and with the two openings in the left-side rail bracket RB. This is evident in FIG. 10*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment tabs T1–T4 are centrally arranged on the left and right walls of the post bracket PB2. The inner wall of post bracket PB2 includes the two edges of the post bracket PB2 with a space being provided between these two edges. This space is defined by gap "g" and results from the fact that the post bracket PB2 is bent from a one piece sheet metal blank. The gap "g" should be made as small as possible, preferably in the range of between approximately 1/16" and 1/4". The gap "g" can also serve an important purpose in that it allows for a variation in dimension PBow to account for any variations in the cross-sectional size and shape of the post P. This way, any clearances between the post bracket PB2 and the post P can be reduced.

In the embodiment just described (using a 4×4 post P and 2×3 rails R), the tabs T1–T4 may project from each of the opposite sides of the post bracket PB2 in the range of between approximately 1" and 1.5". The bolts B may be 1/4" diameter and may have a length in the range of between approximately 2" and 2.5". The openings T1*o*–T4*o* in the tabs T1–T4, and the openings "spo" in the tabs of the rail brackets RB, should have approximately 5/16" diameter to accommodate the 1/4" bolts B. The rail brackets RB may have a length (measured from the curved edge to the opposite straight edge) in the range of between approximately 2" and 5". The post bracket PB2 may have a width W (see FIG. 11) that is in the range of between approximately 3.5" and 5", with 4" being preferred when PBow and PBoh are each approximately 3-9/16". The distance between the inner parallel surfaces of tabs T2 and T4, as well as between the inner parallel surfaces of tabs T1 and T3, should be in the range of between approximately 1 11/16" and 1 3/4". The width of the tabs T1–T4 should be in the range of between 1.5" to 3" depending on the width W of the post bracket PB2. Preferably, the width of the tabs T1–T4 should be in the range of between approximately 25% to approximately 75% of the width W of the post bracket PB2. The openings No (see FIG. 11) of the post bracket PB2 and the openings "no" (see FIG. 6) of the rail brackets RB can be between approximately 1/16" to approximately 3/16" diameter or more to receive fasteners such as nails or screws, and may be counter-sunk or counter-bored, if desired. Integrally formed barbs similar to those used in the embodiment of FIGS. 58*a–b* can also be used on the rail brackets RB and the post bracket PB2.

Figure 11:
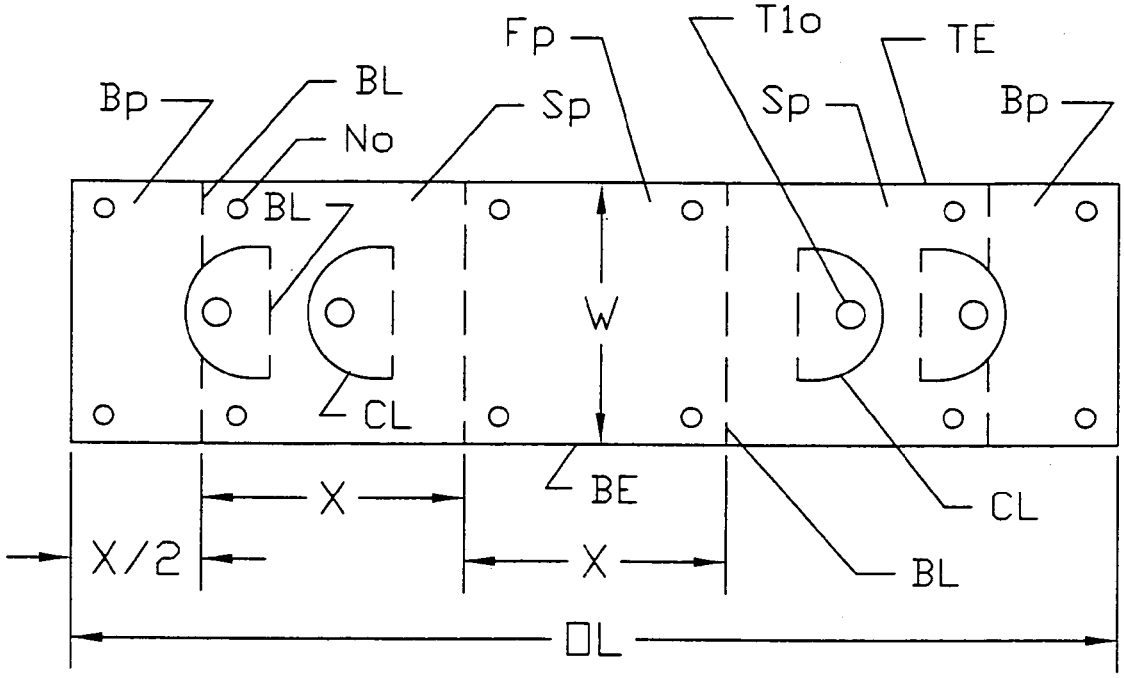
FIG. 11 shows a stock sheet metal part which will form the post bracket used in the second embodiment bracket system shown in FIGS. 10*a–b* The figure illustrates the relative shape and size of the sheet metal part as well as the approximate relative position of the holes, bend-lines, and cut-lines.

FIG. 11 illustrates the layout of a piece of sheet metal which can be used to form the post bracket PB2. The various features are not drawn to scale. However, the general arrangement or positions of the bend lines, holes and cut lines are shown to illustrate their general locations. The sheet metal piece has a generally rectangular shape with an upper or top edge TE and a lower or bottom edge BE. To form the generally square shaped bracket PB2 shown in FIG. 13, the sheet metal piece has five sections which are defined by four bend lines BL that extend from edge TE to edge BE. The location of the tabs T2 and T4 have been changed (from those shown in FIG. 3) so that tabs T2 and T4 can be centered on left side wall of post bracket PB2. Similarly, the location of the tabs T1 and T3 have been changed so that tabs T1 and T3 can be centered on right side wall of post bracket PB2. Otherwise, the post bracket PB2 can be formed in a manner similar to that described above with regard to FIGS. 3–5.

Figure 12:
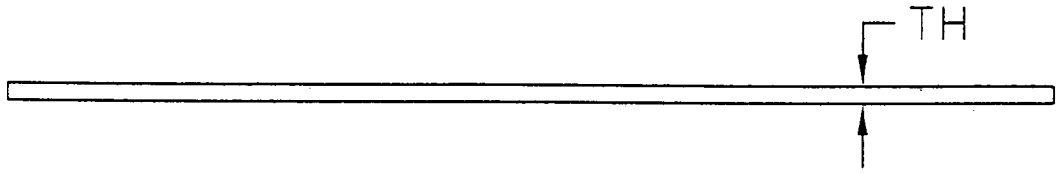
FIG. 12 shows a side view of the stock sheet metal part shown in FIG. 11.
Figure 13:
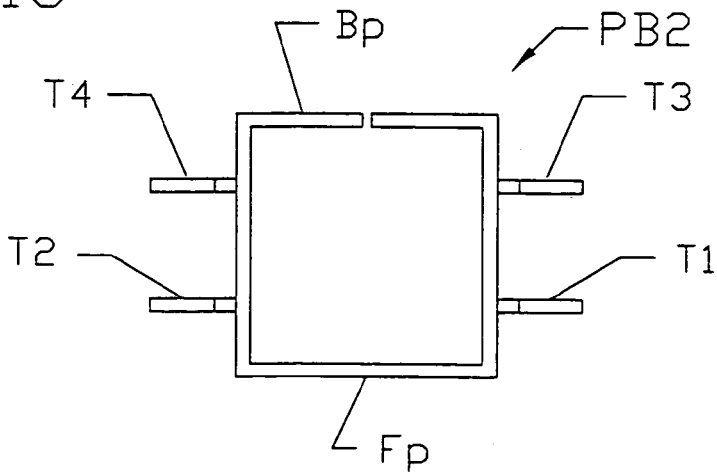
FIG. 13 shows a top view of the second embodiment of the fence post bracket which is formed from the stock sheet metal part shown in FIG. 11. The formed post bracket has been pierced with holes and also cut and bent along the cut-lines and bend-lines.

In forming the post bracket PB2 shown in FIG. 13, any number of desired and cost-effective methods and devices can be used. The state of the art in sheet metal fabrication includes devices which can form the openings No and T1*o*–T4*o*, and cut-lines CL by punching, water-jet cutting, laser cutting, plasma cutting, etc. Today's equipment also includes manual cutting and bending devices, in addition to Computer Numerical Control (CNC) punch presses, as well as CNC plasma and laser cutters. One inexpensive way of forming the post bracket shown in FIGS. 11–13, is to use a punch press to form the plate shown in FIG. 11 with the holes No and T1*o*–T4*o*, and cut-lines CL being cut in the punch press. One or more secondary operations can then be used to form the bends resulting in the post bracket shown in FIG. 13. It is desirable to make the post bracket PB2 as cheaply as possible, since a typical fence may require dozens of post brackets PB2, yet strength and ease of use should not be sacrificed to a significant extent. Accordingly, it is believed that forming the post brackets PB2 from a one-piece sheet metal piece satisfies these requirements. Of course, an alternative way of forming the bracket shown in FIG. 13, can be by molding, casting or extrusion, whether the post bracket PB2 is to be made of metal or plastic, or even plastic coated metal. For example, today's equipment can extrude substantially the shape shown in FIG. 13, with or without the gap "g". Thereafter, the tabs T1–T4 and holes No and T1*o*–T4*o* can be formed or shaped with cutting devices by milling, shaping, cutting, punching, and drilling, etc.

Figure 14A:
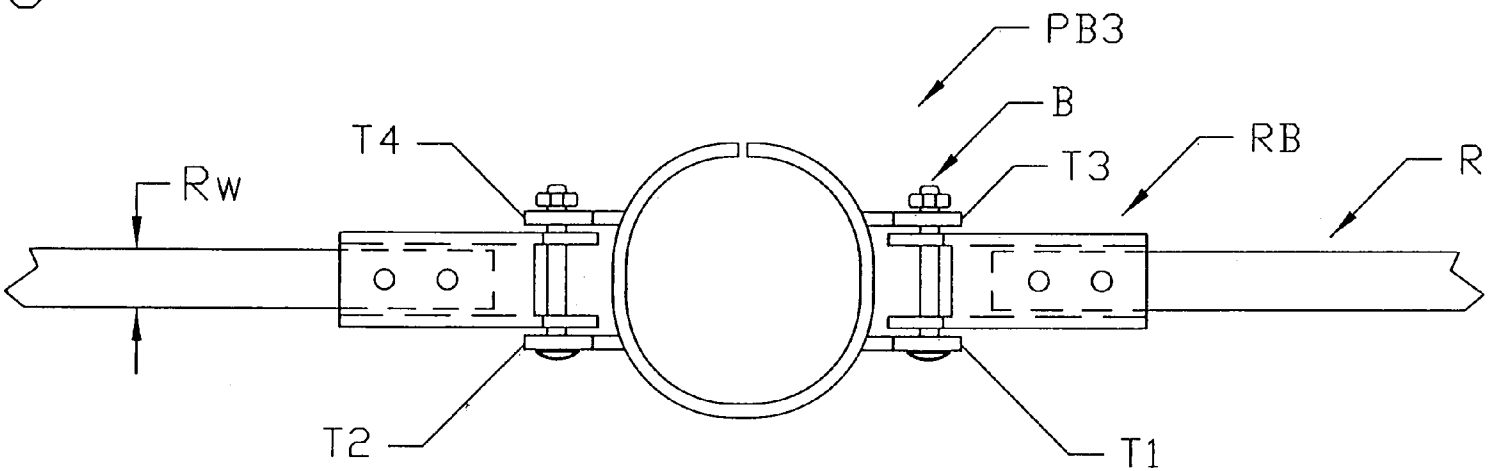
FIG. 14*a* shows a top view of a third embodiment of the bracket system of the invention. The rails are shown installed in the rail brackets, but the fence post is not shown installed in the post bracket. The fasteners which would secure the rail brackets to the rails are not shown, but the openings that would receive the fasteners are shown.
Figure 14B:
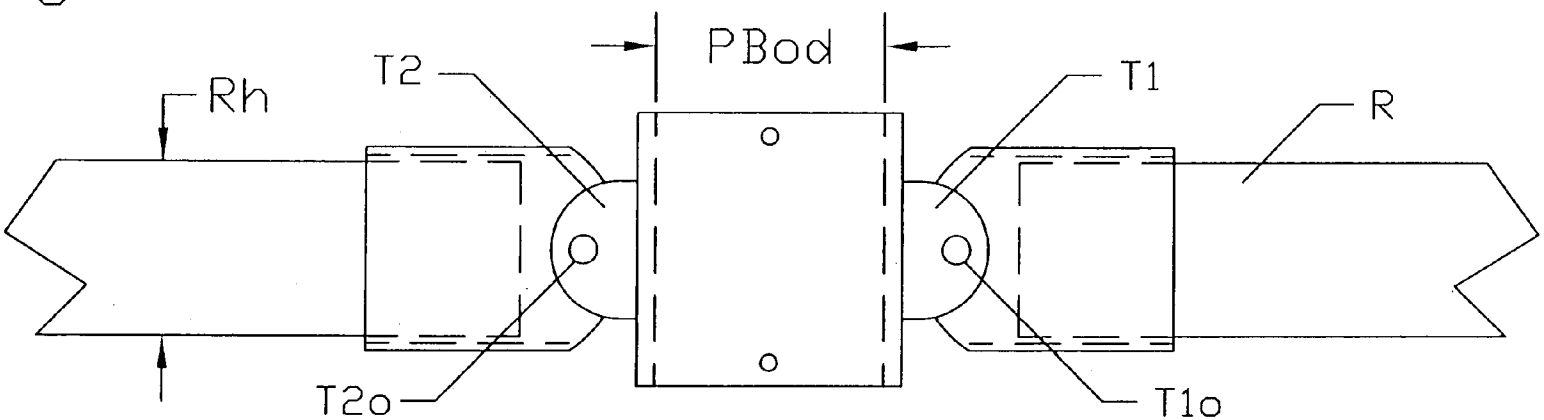
FIG. 14*b* shows a side view of the embodiment shown in FIG. 14*a*, except that the bolts securing the rail brackets to the post bracket have been removed.

FIGS. 14*a*–*b* show another embodiment of the bracket system according to the invention. The bracket system uses a unitary or one-piece post bracket PB3 that has a generally circular or round-shaped opening that is sized and shaped to slide over a fence post P (not shown). In this case, the fence post would have a 4" cross-sectional round shape, which means that the round shaped opening defined by the post bracket PB3 is slightly larger than 4 inches in diameter. It is preferred that the round shaped opening of the post bracket PB3 be approximately 1/16 inches larger, i.e., the opening should have the following dimensions, PBod=4 1/16 inches. In this way, the post bracket PB3 can slide up and down on the post P until it is secured thereto by fasteners such as, e.g., nails, barbs or screws (not shown). The post bracket PB3 can be made in any desired way and can be made of any desired material such as plastic or metal. However, it is preferred that it be made of sheet metal and specifically galvanized sheet metal. The post bracket PB3 should also be made thin, but not so thin that strength is sacrificed to a significant extent. In this regard, it is preferred that the post bracket PB3 have a thickness TH (see FIG. 16) in the range of approximately 1/32 inches to approximately 1/8 inches or more depending on the size of the fence. A particular preferred material and thickness TH is in the range of between 22 gage and 11 gage, with 12 gage (approximately 1/10" thick) galvanized sheet metal being preferred. Of course, the post bracket PB3 can also be made of plastic and formed as a unitary structure having a shape that resembles that of FIG. 17, but without gap "g", i.e., it can be cast, molded or extruded as in the embodiment shown in FIGS. 66*a*–*b*, but have the shape shown in FIG. 17 and with or without the gap "g".

Again, with reference to FIGS. 14*a*–*b*, the post bracket PB3 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness of the remaining part of the post bracket PB3. As can be seen in FIG. 14*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts B to withstand environmental conditions. It is also preferred that galvanized nuts be used with the bolts B.

A left side rail bracket RB of the type shown in FIGS. 6–9 is connected to the tabs T2 and T4 of the post bracket PB3 via the bolt B. Similarly, a right side rail bracket RB of the type shown in FIGS. 6–9 is connected to the tabs T1 and T3 of the post bracket PB3 via the other bolt B. Each rail bracket RB has one end that receives therein an end of a rail R and another end that connects to the post bracket PB3. In this regard, each rail bracket RB has two tabs which each have an opening that receives the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=11.5" and Rh=2.5". In this way, each rail bracket RB can slide over the end of each rail R until it is secured thereto by fasteners such as, e.g., nails, barbs or screws (not shown). The two rail brackets RB are essentially identical to each other and can be fabricated in any desired way. They can also be made of any desired material such as plastic or metal. However, it is preferred that they be made of sheet metal and specifically galvanized sheet metal of the same type as that used to make the post bracket PB3. The rail brackets RB should thus be made thin, but not so thin that strength is sacrificed to a significant extent. In this regard, it is preferred that each rail bracket RB have a thickness "th" (see FIG. 16) in the range of approximately 1/32 inches to approximately 1/8 inches or more depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure as described above.

In FIG. 14*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 and with the two openings in the left-side rail bracket RB. This is evident in FIG. 14*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment, tabs T1–T4 are arranged near the center portions of the post bracket PB3. The curved inner wall of post bracket PB3 has the two edges of the post bracket PB3 with a space being provided between these two edges. This space is defined by gap "g" and results from the fact that the post bracket PB3 is bent from a one piece sheet metal blank. The gap "g" should be made as small as possible, preferably in the range of between approximately 1/16" and 1/4". The gap "g" also serves an important purpose in that it allows for a variation in dimension PBod to account for any variations in the cross-sectional size and shape of the post P. This way, any clearances between the post bracket PB3 and the post P can be reduced. Spacers of the type shown in FIG. 65*a* can also be used in this bracket system.

In the embodiment just described (using a 4" post P and 2×3 rails R), the tabs T1–T4 may project from each of the opposite sides of the post bracket PB3 in the range of between approximately 1" and 1.5". The bolts B may be ¼" diameter and may have a length in the range of between approximately 2" and 2.5". The openings T1*o*–T4*o* in the tabs T1–T4, and the openings "spo" in the tabs of the rail brackets RB, should have approximately 5/16" diameter to accommodate the ¼" bolts B. The rail brackets RB may have a length (measured from the curved edge to the opposite straight edge) in the range of between approximately 2" and 5". The post bracket PB3 may have a width W (see FIG. 15) that is in the range of between approximately 3.5" and 5", with 4" being preferred when PBod is approximately 4 1/16". The distance between the inner parallel surfaces of tabs T2 and T4, as well as between the inner parallel surfaces of tabs T1 and T3, should be in the range of between approximately 1 11/16" and 1¾". The width of the tabs T1–T4 should be in the range of between 1.5" to 3" depending on the width W of the post bracket PB3. Preferably, the width of the tabs T1–T4 should be in the range of between approximately 25% to approximately 75% of the width W of the post bracket PB3. The openings No (see FIG. 15) of the post bracket PB3 and the openings "no" (see FIG. 6) of the rail brackets RB can be between approximately 1/16" to approximately 3/16" diameter to receive fasteners such as nails or screws, and may be counter-sunk or counter-bored, if desired.

Figure 15:
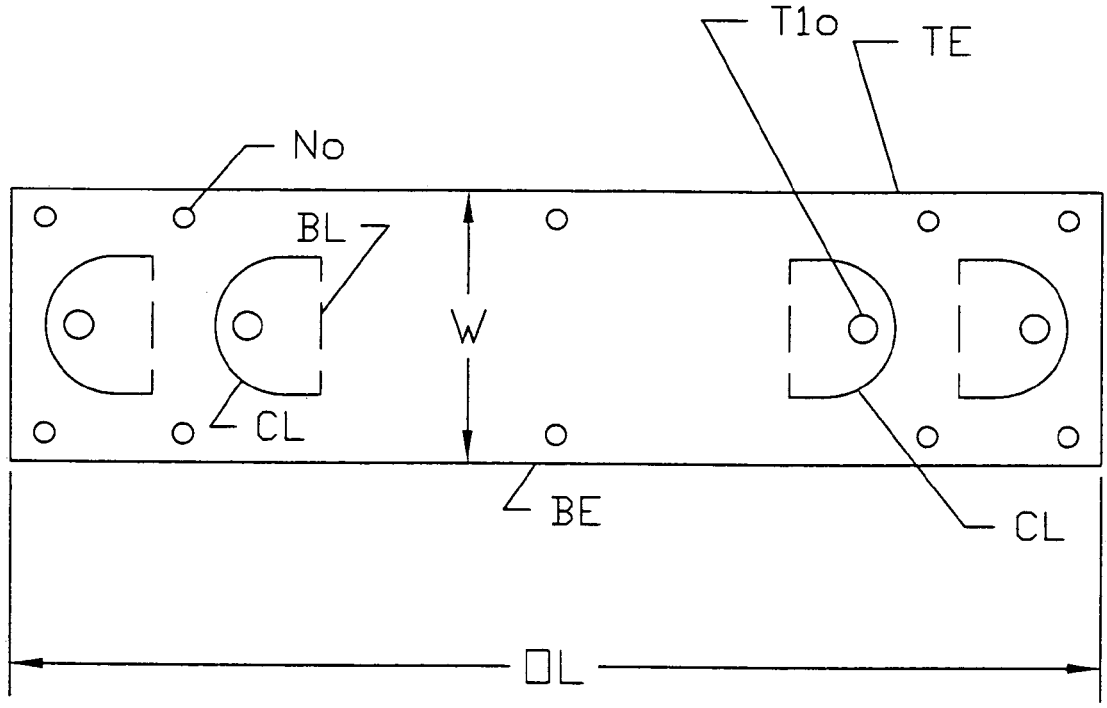
FIG. 15 shows a stock sheet metal part which will form the post bracket used in the third embodiment bracket system shown in FIGS. 14*a–b* The figure illustrates the relative shape and size of the sheet metal part as well as the approximate relative position of the holes, bend-lines, and cut-lines.

FIG. 15 illustrates the layout of a piece of sheet metal which can be used to form the post bracket PB3. The various features are not drawn to scale. However, the general arrangement or positions of the bend lines, holes and cut lines are shown to illustrate their general locations. The sheet metal piece has a generally rectangular shape with an upper or top edge TE and a lower or bottom edge BE. To form the generally round shaped bracket PB3 shown in FIG. 17, the sheet metal piece has one continuous section which is defined by a continuous bend extending from edge TE to edge BE. The location of the tabs T2 and T4 have been changed (relative to tabs T2 and T4 in FIGS. 3 and/or 11) so that tabs T2 and T4 can be centered on curved left side wall of post bracket PB3. Similarly, the location of the tabs T1 and T3 have been changed so that tabs T1 and T3 can be centered on curved right side wall of post bracket PB3. Otherwise, the post bracket PB3 can be formed in a manner similar to that described above with regard to FIGS. 3–5. Note that the one-piece sheet metal part shown in FIG. 15 has fewer holes No than the ones shown in FIGS. 3 and 11. Of course, the holes No can be located in any desired configuration or arrangement, and may be supplemented or replaced with integrally formed barbs of the type shown in FIGS. 58*a*–*b*.

Figure 16:
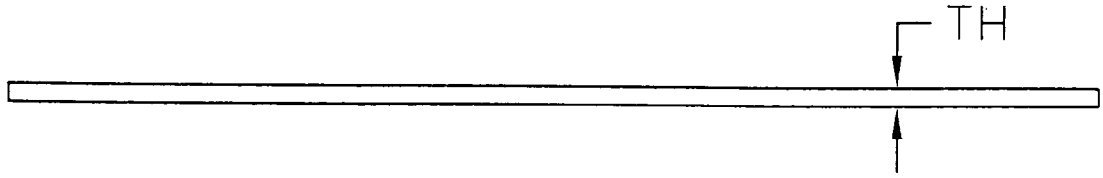
FIG. 16 shows a side view of the stock sheet metal part shown in FIG. 15.
Figure 17:
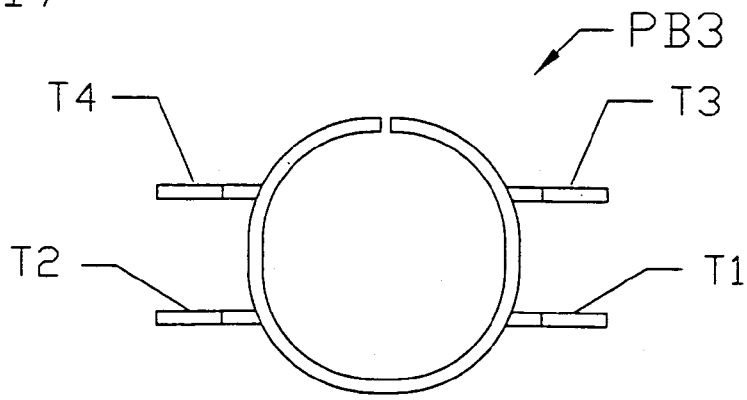
FIG. 17 shows a top view of the third embodiment of the fence post bracket which is formed from the stock sheet metal part shown in FIG. 15. The formed post bracket has been pierced with holes and also cut and bent along the cut-lines and bend-lines.

In forming the post bracket PB3 shown in FIG. 17, any number of desired and cost-effective methods and devices can be used. The state of the art in sheet metal fabrication includes devices which can form the openings No and T1*o*–T4*o*, and cut-lines CL by punching, water-jet cutting, laser cutting, plasma cutting, etc. Today's equipment also includes manual cutting and bending devices, in addition to Computer Numerical Control (CNC) punch presses, as well as CNC plasma and laser cutters. One inexpensive way of forming the post bracket shown in FIGS. 15–17, is to use a punch press to form the plate shown in FIG. 15 with the holes No and T1*o*–T4*o*, and cut-lines CL being cut in the punch press. One or more secondary operations can then be used to form the bends resulting in the post bracket shown in FIG. 17. It is desirable to make the post bracket PB3 as cheaply as possible, since a typical fence may require dozens of post brackets PB3, yet strength and ease of use should not be sacrificed to a significant extent. Accordingly, it is believed that forming the post brackets PB3 from a one-piece sheet metal piece satisfies these requirements. Of course, an alternative way of forming the bracket shown in FIG. 17, can be by molding, casting or extrusion, whether the post bracket PB3 is to be made of metal or plastic, or even plastic coated metal. For example, today's equipment can extrude substantially the shape shown in FIG. 17, with or without the gap "g". Thereafter, the tabs T1–T4 and holes No and T1*o*–T4*o* can be formed or shaped with cutting devices by milling, shaping, cutting, punching, and drilling, etc.

Figure 18A:
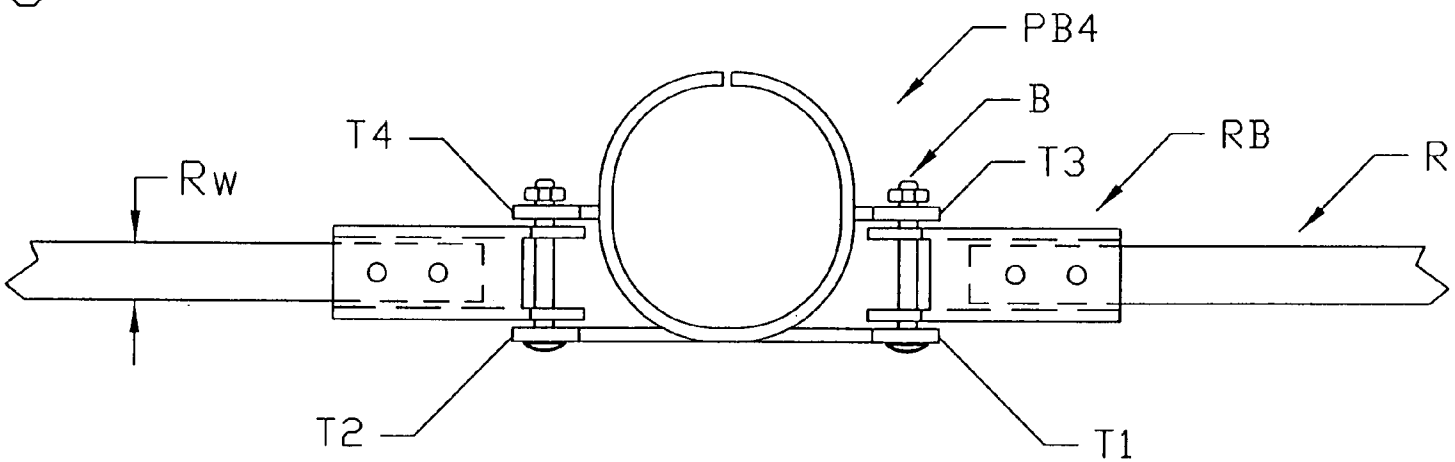
FIG. 18*a* shows a top view of a fourth embodiment of the bracket system of the invention. The rails are shown installed in the rail brackets, but the fence post is not shown installed in the post bracket. The fasteners which would secure the rail brackets to the rails are not shown, but the openings that would receive the fasteners are shown.
Figure 18B:
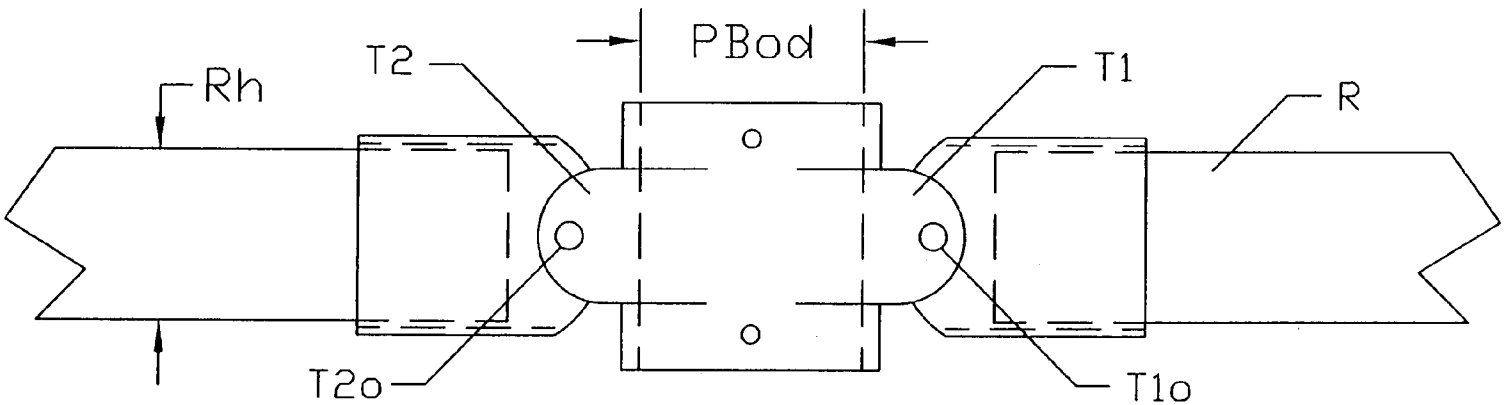
FIG. 18*b* shows a side view of the embodiment shown in FIG. 18*a*, except that the bolts securing the rail brackets to the post bracket have been removed.
Figure 20:
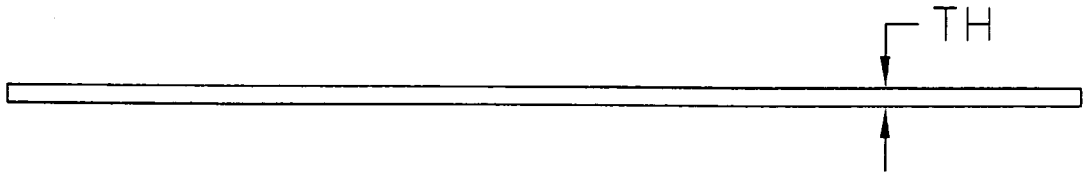
FIG. 20 shows a side view of the stock sheet metal part shown in FIG. 19.

FIGS. 18*a*–*b* show still another embodiment of the bracket system according to the invention. The bracket system uses a unitary or one-piece post bracket PB4 that has a generally circular or round-shaped opening that is sized and shaped to slide over a fence post P (not shown). In this case, the fence post would have a 4" cross-sectional round shape, which means that the round shaped opening defined by the post bracket PB4 is slightly larger than 4 inches in diameter. It is preferred that the round shaped opening of the post bracket PB4 be approximately 1/16 inches larger, i.e., the opening should have the following dimensions, PBod=4 1/16 inches. In this way, the post bracket PB4 can slide up and down on the post P until it is secured thereto by fasteners such as, e.g., nails, barbs or screws (not shown). The post bracket PB4 can be made in any desired way and can be made of any desired material such as plastic or metal. However, it is preferred that it be made of sheet metal and specifically galvanized sheet metal. The post bracket PB4 should also be made thin, but not so thin that strength is sacrificed to a significant extent. In this regard, it is preferred that the post bracket PB4 have a thickness TH (see FIG. 20) in the range of approximately 1/32 inches to approximately ⅛ inches or more depending on the size of the fence. A particular preferred material and thickness TH is in the range of between 22 gage and 11 gage, with 12 gage (approximately 1/10" thick) galvanized sheet metal being preferred. Of course, the post bracket PB4 can also be made of plastic and formed as a unitary structure having a shape that resembles that of FIG. 21, but without gap "g", i.e., it can be cast, molded or extruded as in the embodiment shown in FIGS. 66*a*–*b*, but have the shape shown in FIG. 21 and with or without the gap "g".

Again, with reference to FIGS. 18*a*–*b*, the post bracket PB4 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness of the remaining part of the post bracket PB4. As can be seen in FIG. 18*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts to withstand environmental conditions. It is also preferred that galvanized nuts be used with the bolts B.

A left side rail bracket RB of the type shown in FIGS. 6–9 is connected to the tabs T2 and T4 of the post bracket PB4 via the bolt B. Similarly, a right side rail bracket RB of the type shown in FIGS. 6–9 is connected to the tabs T1 and T3 of the post bracket PB4 via another bolt B. Each rail bracket RB has one end that receives therein an end of a rail R and another end that connects to the post bracket PB4. In this regard, each rail bracket RB has two tabs which each have an opening that receive the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=11.5" and Rh=2.5". In this way, each rail bracket RB can slide over the end of each rail R until it is secured thereto by fasteners such as, e.g., nails, barbs or screws (not shown). The two rail brackets RB are essentially identical to each other and can be fabricated in any desired way. They can also be made of any desired material such as plastic or metal. However, it is preferred that they be made of sheet metal and specifically galvanized sheet metal of the same type as that used to make the post bracket PB4. The rail bracket RB should thus be made thin, but not so thin that strength is sacrificed to a significant extent. In this regard, it is preferred that each rail bracket RB have a thickness "th" (see FIG. 16) in the range of approximately 1/32 inches to approximately 1/8 inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure as described above. Spacers of the type shown in FIG. 65*a* can also be used in this bracket system, if desired.

In FIG. 18*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 and with the two openings in the left-side rail bracket RB. This is evident in FIG. 18*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment, tabs T1–T4 are arranged near the curved front side of the post bracket PB4. As a result, tabs T1 and T2 are arranged to be generally flush with respect to curved outer wall of post bracket PB4. The inner curved wall of post bracket PB4 includes the two edges of the post bracket PB4 with a space being provided between these two edges. This space is defined by gap "g" and results from the fact that the post bracket PB4 is bent from a one piece sheet metal blank. The gap "g" should be made as small as possible, preferably in the range of between approximately 1/16" and 1/4". The gap "g" also serves an important purpose in that it allows for a variation in dimension PBod to account for any variations in the cross-sectional size and shape of the post P. This way, any clearances between the post bracket PB4 and the post P can be reduced.

In the embodiment just described (using a 4" post P and 2×3 rails R), the tabs T1–T4 may project from each of the opposite sides of the post bracket PB4 in the range of between approximately 1" and 1.5". The bolts B may be 1/4" diameter and may have a length in the range of between approximately 2" and 2.5". The openings T1*o*–T4*o* in the tabs T1–T4, and the openings "spo" in the tabs of the rail brackets RB, should have approximately 5/16" diameter to accommodate the 1/4" bolts B. The rail brackets RB may have a length (measured from the curved edge to the opposite straight edge) in the range of between approximately 2" and 5". The post bracket PB4 may have a width W (see FIG. 19) that is in the range of between approximately 3.5" and 5", with 4" being preferred when PBod is approximately 4 1/16". The distance between the inner parallel surfaces of tabs T2 and T4, as well as between the inner parallel surfaces of tabs T1 and T3, should be in the range of between approximately 1 11/16" and 1 3/4". The width of the tabs T1–T4 should be in the range of between 1.5" to 3" depending on the width W of the post bracket PB4. Preferably, the width of the tabs T1–T4 should be in the range of between approximately 25% to approximately 75% of the width W of the post bracket PB4. The openings No (see FIG. 19) of the post bracket PB4 and the openings "no" (see FIG. 6) of the rail brackets RB can be between approximately 1/16" to approximately 3/16" diameter or more to receive fasteners such as nails or screws, and may be counter-sunk or counter-bored, if desired.

Figure 19:
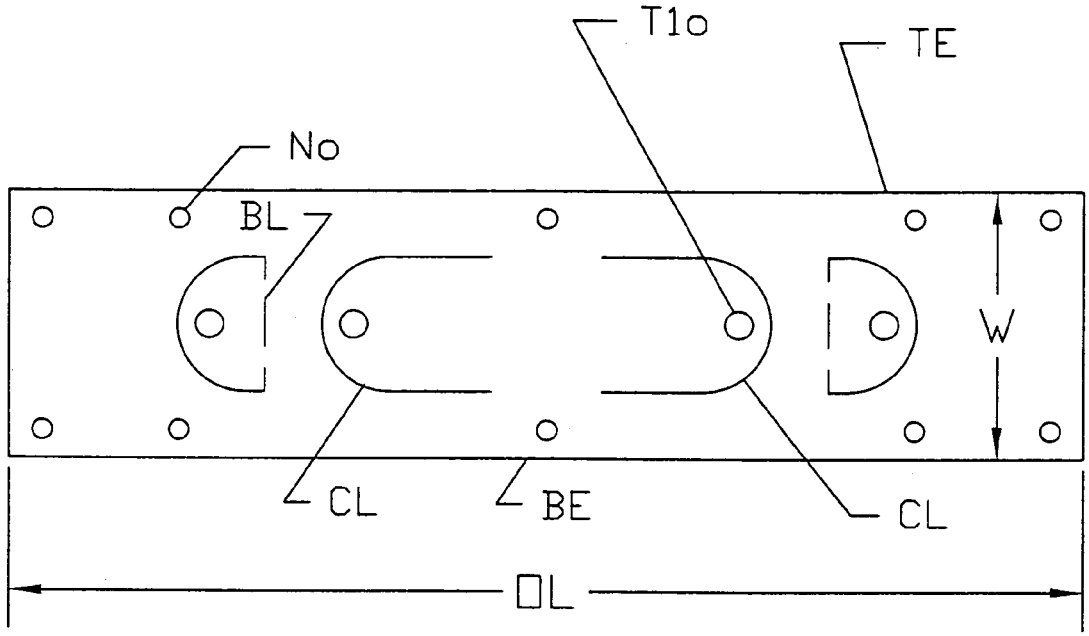
FIG. 19 shows a stock sheet metal part which will form the post bracket used in the fourth embodiment shown in FIGS. 18*a–b* The figure illustrates the relative shape and size of the sheet metal part as well as the approximate relative position of the holes, bend-lines, and cut-lines.

FIG. 19 illustrates the layout of a piece of sheet metal which can be used to form the post bracket PB4. The various features are not drawn to scale. However, the general arrangement or positions of the bend lines, holes and cut lines are shown to illustrate their general locations. The sheet metal piece has a generally rectangular shape with an upper or top edge TE and a lower or bottom edge BE. To form the generally square shaped bracket PB4 shown in FIG. 21, the sheet metal piece is designed to be bent essentially continuously to form the round profile shown in FIG. 21. The location of the tabs T2 and T4 have been changed (relative to tabs T2 and T4 in FIGS. 3 and/or 11) so that tabs T2 and T4 can be arranged off-centered on curved left side wall of post bracket PB4. Similarly, the location of the tabs T1 and T3 have been changed so that tabs T1 and T3 can be off-centered on curved right side wall of post bracket PB4. Otherwise, the post bracket PB4 can be formed in a manner similar to that described above with regard to FIGS. 3–5. Note that the one-piece sheet metal part shown in FIG. 19, like the one shown in FIG. 15, has fewer holes No than the ones shown in FIGS. 3 and 11.

Figure 21:
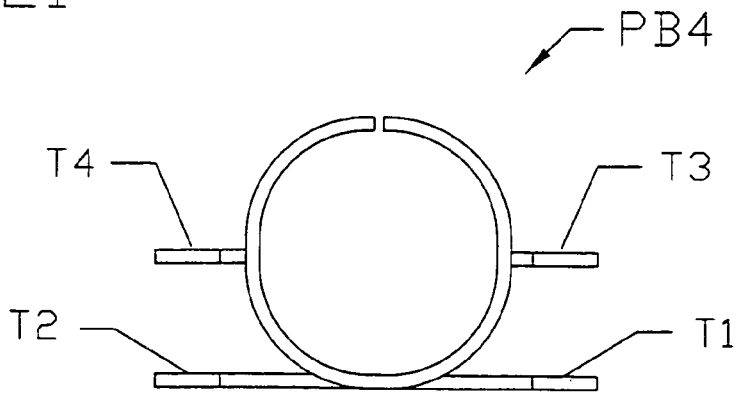
FIG. 21 shows a top view of the fourth embodiment of the fence post bracket which is formed from the stock sheet metal part shown in FIG. 19. The formed post bracket has been pierced with holes and also cut and bent along the cut-lines and bend-lines.

In forming the post bracket PB4 shown in FIG. 21, any number of desired and cost-effective methods and devices can be used. The state of the art in sheet metal fabrication includes devices which can form the openings No and T1*o*–T4*o*, and cut-lines CL by punching, water-jet cutting, laser cutting, plasma cutting, etc. Today's equipment also includes manual cutting and bending devices in addition to Computer Numerical Control (CNC) punch presses, as well as CNC plasma and laser cutters. One inexpensive way of forming the post bracket shown in FIGS. 19–2 1, is to use a punch press to form the plate shown in FIG. 19 with the holes No and T1*o*–T4*o*, and cut-lines CL being cut in the punch press. One or more secondary operations can then be used to form the bends resulting in the post bracket shown in FIG. 21. It is desirable to make the post bracket PB4 as cheaply as possible, since a typical fence may require dozens of post brackets PB4, yet strength and ease of use should not be sacrificed to a significant extent. Accordingly, it is believed that forming the post brackets PB4 from a one-piece sheet metal piece satisfies these requirements. Of course, an alternative way of forming the bracket shown in FIG. 21, can be by molding, casting or extrusion, whether the post bracket PB4 is to be made of metal or plastic, or even plastic coated metal. For example, today's equipment can extrude substantially the shape shown in FIG. 21, with or without the gap "g". Thereafter, the tabs T1–T4 and holes No and T1*o*–T4*o* can be formed or shaped with cutting devices by milling, shaping, cutting, punching, and drilling, etc.

Figure 22:
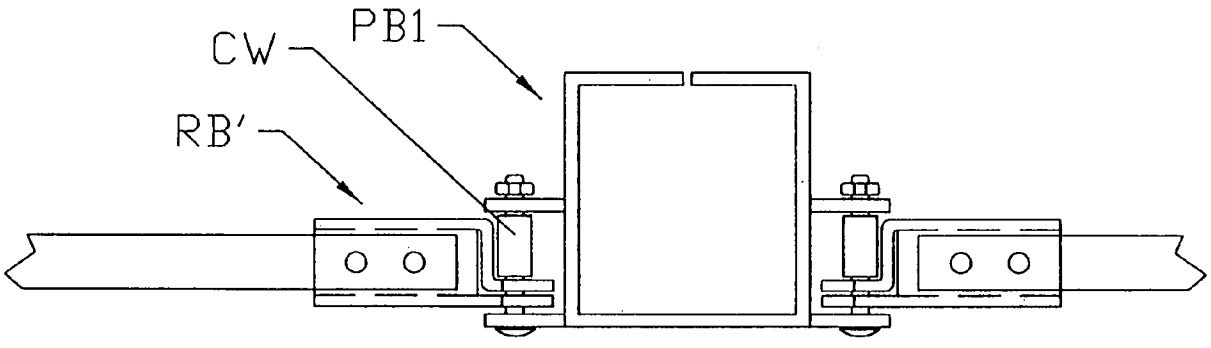
FIG. 22 shows a top view of a fifth embodiment of the bracket system of the invention. This embodiment uses the first embodiment post bracket. However, the rail brackets used are those of a second embodiment that is different from the rail brackets used in the previous embodiments. A spacer or cylindrical washer is utilized to adapt the second embodiment rail brackets to the first embodiment post bracket. The rails are shown installed in the rail brackets, but the fence post is not shown installed in the post bracket. The fasteners which would secure the rail brackets to the rails are not shown, but the openings that would receive the fasteners are shown.

FIG. 22 shows another embodiment of the bracket system according to the invention. The bracket system uses the unitary or one-piece post bracket PB 1 of the type shown in FIGS. 2*a*–*b*. The post bracket PB 1 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness TH of the remaining part of the post bracket PB 1. As was explained with regard to FIG. 2*b*, each tab also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts to withstand environmental conditions. It is also preferred that galvanized nuts be used with the bolts B.

A left side rail bracket RB' formed as a unitary or one-piece member is connected to the tabs T2 and T4 of the post bracket PB1 via the bolt B. Similarly, a right side rail bracket RB' formed as a unitary or one-piece member is connected to the tabs T1 and T3 of the post bracket PB1 via the other bolt B. These rail brackets RB' are different from the embodiment shown in e.g., 2*a*, 2*b*, 6–9, 10*a*, 10*b*, 14*a*, 14*b*, 18*a* and 18*b*. Each rail bracket RB' has one end that receives therein an end of a rail R and another end that connects to the post bracket PB1. In this regard, each rail bracket RB' has two tabs which each have an opening "spo" (see FIG. 23) that receive the bolt B. The rail brackets RB' also have an internal rectangular opening that is sized and shaped to be similar to that of the rail R. In this case, the rectangular opening of each rail bracket RB' is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB' can slide over the end of each rail R until it is secured thereto by fasteners such as, e.g., nails, barbs or screws (not shown). The two rail brackets RB' are essentially identical to each other and can be fabricated in any desired way. They can also be made of any desired material such as plastic or metal. However, it is preferred that they be made of sheet metal and specifically galvanized sheet metal of the same type as that used to make the post bracket PB 1. The rail bracket RB' should thus be made thin, but not so thin that strength is sacrificed to a significant extent. In this regard, it is preferred that each rail bracket RB' have a thickness "th" (see FIG. 24) in the range of approximately 1/32 inches to approximately 1/8 inches depending on the size of the fence. A particular preferred material and thickness is in the range of between 22 gage and 11 gage, with 12 gage (approximately 1/10" thick) galvanized sheet metal being preferred. Of course, the rail brackets RB' can also be made of plastic and formed as a unitary structure having a shape that resembles that of FIG. 22, but without gap "g", i.e., it can be cast or molded, etc, as a one-piece member, but have the shape shown in FIG. 22 and with or without the gap "g".

In FIG. 22, it can be noted that the bolts B pass through spacers or cylindrical washers CW. The purpose of these spacers CW is prevent tabs T2 and T4 and tabs T1 and T3 from deflecting too much towards each other when the bolts B are tightened. The spacers CW also serve to adapt the second embodiment rail bracket RB' to a post bracket PB1 that is adapted to receive the first embodiment post bracket PB1. The spacers CW can have any desired form or shape. However, it is preferred that they be galvanized metal sleeves to withstand environmental conditions. It is also preferred that they have an internal opening that whose size and shape accommodate the bolt B. Just as in the previous rail bracket RB embodiment, it should be apparent that opening T2*o* of tab T2 is aligned with the opening T4*o* (not shown) of tab T4 and with the two openings in the left-side rail bracket RB'. This is evident in FIG. 22 where it is apparent that the bolt B passes through these four openings and through the spacer CW. Similarly, the two respective openings of the tabs T1 and T3 are aligned with the two openings formed in the right side rail bracket RB' so that the bolt B can pass through these four openings and through spacer CW.

In the embodiment just described (using a 4×4 post P and 2×3 rails R), the tabs T1–T4 may project from each of the opposite sides of the post bracket PB1 in the range of between approximately 1" and 1.5". The bolts B may be 1/4" diameter and may have a length in the range of between approximately 2" and 2.5". The openings in the tabs T1–T4, those of spacers CW, and the openings in the tabs of the rail brackets RB', should have approximately *frax*;5;16" diameter to accommodate the 1/4" bolts B. The rail brackets RB' may have an after bending length (measured from the curved edge to the opposite straight edge) in the range of between approximately 2" and 5" with 4" being preferred. The post bracket PB1 may have a width W (see FIG. 3) that is in the range of between approximately 3.5" and 5", with 4" being preferred when PBow and PBoh are each approximately 3 9/16". The distance between the inner parallel surfaces of tabs T2 and T4, as well as between the inner parallel surfaces of tabs T1 and T3, should be in the range of between approximately 1 11/16" and 1 3/4". The width of the tabs T1–T4 should be in the range of between 1.5" to 3" depending on the width W of the post bracket PB1. Preferably, the width of the tabs T1–T4 should be in the range of between approximately 25% to approximately 75% of the width W of the post bracket PB1. The openings No (see FIG. 3) of the post bracket PB 1 and the openings "no" (see FIG. 23) of the rail brackets RB' can be between approximately 1/16" to approximately 3/16" diameter or more to receive fasteners such as nails or screws, and may be counter-sunk or counter-bored, if desired.

Figure 23:
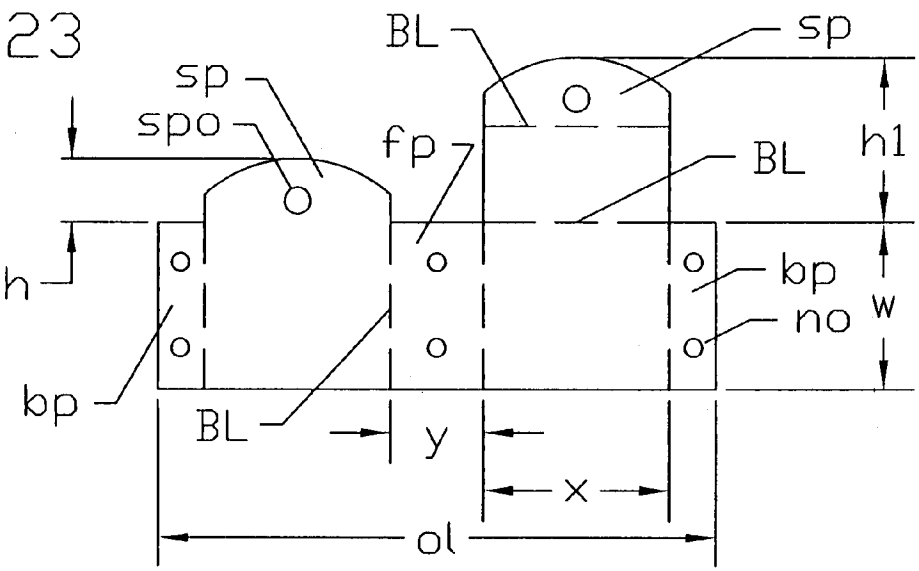
FIG. 23 shows a stock sheet metal part which will form the second embodiment rail bracket used in the bracket system shown in FIG. 22. The figure illustrates the relative shape and size of the sheet metal part as well as the approximate relative position of the holes and bend-lines.
Figure 24:
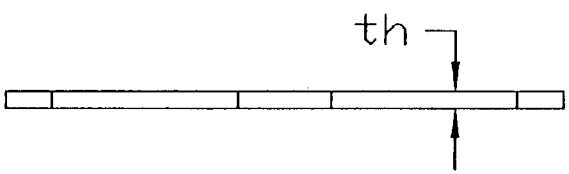
FIG. 24 shows a side view of the stock sheet metal part shown in FIG. 24.

FIG. 23 illustrates the layout of a piece of sheet metal which can be used to form each rail bracket RB'. The various features are not drawn to scale. However, the general arrangement or positions of the bend lines and holes are shown to illustrate their general locations. The sheet metal piece has a generally rectangular shape with an upper or top edge from which two tab portions of different lengths extend and a lower or bottom edge. To form the generally rectangular shaped rail bracket RB' shown in FIG. 22, the sheet metal piece shown in FIG. 23 has five sections which are defined by four bend lines BL which extend from the top edge to the bottom edge. Beginning from the left side, left back section "bp" is defined by the left side edge of the rectangular sheet metal piece and the first bend-line BL. Left section or left side back panel "bp" will form approximately 1/2 of the bottom wall of the rail bracket RB'. As a result, the length of this section "bp" (measured between left edge and the first bend-line BL) is approximately half of "y", where "y" is the length of section "fp". As can be seen in FIG. 23, left-side back section or panel "bp" has two openings "no" which can receive fasteners for securing the rail bracket RB' to a rail R. These through openings "no" are arranged in the area of the center of the left back section "bp". Of course, the openings "no" can be arranged anywhere on the rail bracket RB' and in any desired configuration, and need not even be arranged on the left back section "bp". They can even have any desired shape such as the shape of slots instead of circular holes.

The next section is left section or side panel "sp" which will form an inner side wall of the rail bracket RB'. The first and second bend-lines BL that define left section "sp" have a length "x". As can be seen in FIG. 23, left section "sp" has a short tab portion with a curved edge that extends from a top edge of the sheet metal piece by a distance "h". The tab also has a through opening "spo" formed therein. Left section "sp" does not have any openings "no" for receiving fasteners that secure the rail bracket RB' to a rail R. However, such through openings "no" can be arranged, if desired, anywhere on the section "sp". Of course, as with the openings No of the post bracket PB1, the openings "no" can be arranged anywhere on the rail bracket RB' and in any desired configuration. They can even have the shape of slots instead of circular holes.

The next section is the front section or panel "fp" which will form the upper side wall of the rail bracket RB'. As can be seen in FIG. 23, front section "fp" has two openings "no" which can receive fasteners for securing the rail bracket RB' to a rail R. These through openings "no" are arranged in the area of the center of the front section "fp". Of course, the openings "no" can be arranged anywhere on the rail bracket RB' and in any desired configuration, and need even not be arranged on the front section "fp". They can even have the shape of slots instead of circular holes. The second and third bend-lines BL that define front section "fp" have a length "y". In this way, after left and right sections "sp" are bent along the second and third bend-lines BL and after the long tab of the right side section "sp" is bent along the two bend-lines BL, the tabs will be arranged parallel to one another, as shown in FIG. 22.

The next section is right section or side panel "sp" which will form the outer side wall of the rail bracket RB'. The third and fourth bend-lines BL that define right section "sp" have a length "x". As can be seen in FIG. 23, right section "sp" has a long tab portion with a curved edge that extends from a top edge of the sheet metal piece by a distance "h1". The tab also has two bend-lines BL and a through opening "spo" formed therein. Right section "sp" does not have any openings "no" for receiving fasteners that secure the rail bracket RB' to a rail R. However, such through openings "no" can be arranged, if desired, anywhere on the section "sp". Of course, as with the openings No of the post bracket PB1, the openings "no" can be arranged anywhere on the rail bracket RB' and in any desired configuration. They can even have the shape of slots instead of circular holes.

The last section is the right side back section "bp" and is defined by the right side edge of the rectangular sheet metal piece and the fourth bend-line BL. Right back section or back panel "bp" will form approximately ½ of the bottom wall of the rail bracket RB'. As a result, the length of this section "bp" (measured between right edge and the fourth bend-line BL) is approximately half of "y", where "y" is the length of section "fp". As can be seen in FIG. 23, right-side back section or panel "bp" has two openings "no" which can receive fasteners for securing the rail bracket RB' to a rail R. These through openings "no" are arranged in the area of the center of the right back section "bp". Of course, the openings "no" can be arranged anywhere on the rail bracket RB' and in any desired configuration, and need not even be arranged on the left back section "bp". They can even have the shape of slots instead of circular holes.

The dimension "x" "w", "h" and "h1" can be configured to match the requirements of a particular fence and may depend on the thickness "th" (see FIG. 24) of the sheet metal piece. However, for a fence that uses 2×3 wooden rails and with a sheet metal thickness of approximately 1/10", these dimensions can be "w" being about 2 to 4", with 3" being preferred, with "h" being between approximately ½" and approximately ¾", with "h1" being between approximately 2" and approximately 2¼", with "y" being between approximately 1 9/16", and with "x" being about 2-9/16". The overall length "ol" will, of course, depend on the bend radii used in the four section bends (with radii of between 1/64" and ⅛" being preferred), the sheet metal thickness "th", the dimensions Rw and Rh, and the desired gap "g". This information can be developed using standard formulas and bending machinery which account for bend allowances. Such information is well known to those who work with sheet metal fabrication.

In forming the rail bracket RB' shown in FIG. 22, any number of desired and cost-effective methods and devices can be used. The state of the art in sheet metal fabrication includes devices which can form the openings "no" and "spo" by punching, water-jet cutting, laser cutting, plasma cutting, etc. Today's equipment also includes manual cutting and bending devices in addition to Computer Numerical Control (CNC) punch presses, as well as CNC plasma and laser cutters. One inexpensive way of forming the rail bracket RB' shown in FIG. 22, is to use a punch press to form the plate shown in FIG. 23 with the holes "no" and "spo" being cut in the punch press. One or more secondary operations can then be used to form the bends resulting in the rail bracket RB' shown in FIG. 22. It is desirable to make the rail bracket RB' as cheaply as possible, since a typical fence may require dozens of rail brackets RB', yet strength and ease of use should not be sacrificed to a significant extent. Accordingly, it is believed that forming the rail brackets RB' from a one-piece sheet metal piece satisfies these requirements. Of course, an alternative way of forming the bracket shown in FIG. 22, can be by molding, casting, etc., whether the rail bracket RB' is to be made of metal or plastic, or even plastic coated metal. For example, today's equipment can mold substantially the shape shown in FIG. 22, with or without the gap "g". Thereafter, if necessary, the tabs and holes "no" and "spo" can be formed or shaped with cutting devices by milling, shaping, cutting, punching, and drilling, etc.

Figure 25:
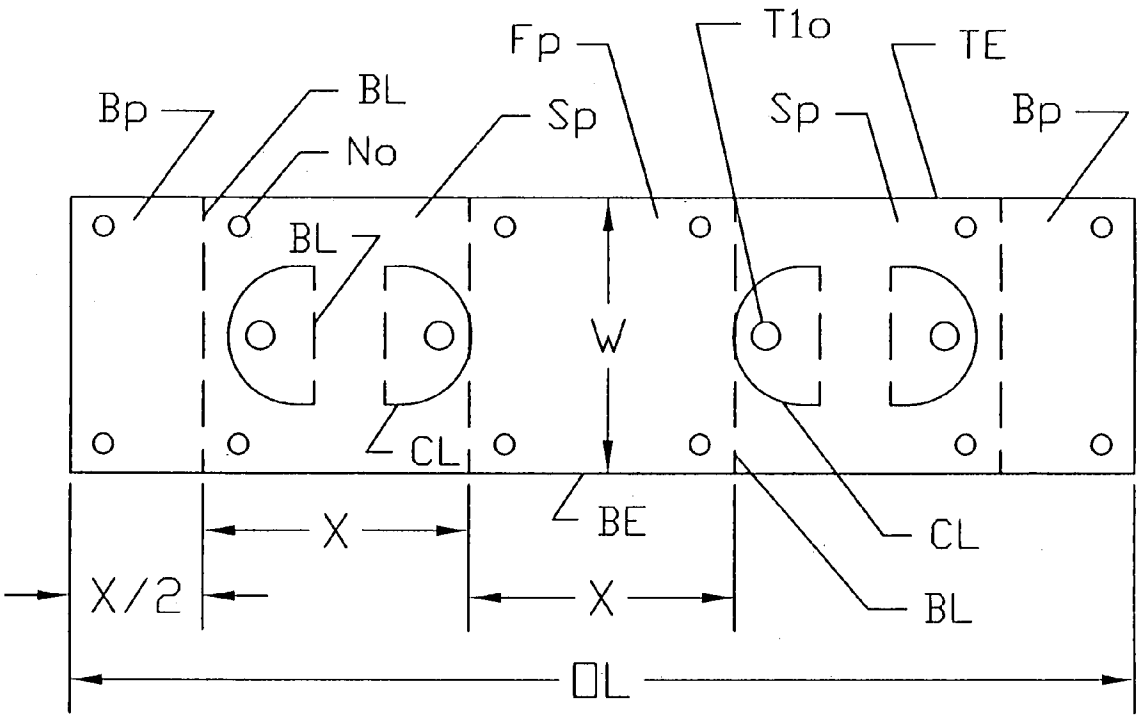
FIG. 25 shows a stock sheet metal part which will form the post bracket used in a sixth embodiment bracket system shown in FIG. 26. The figure illustrates the relative shape and size of the sheet metal part as well as the approximate relative position of the holes, bend-lines, and cut-lines.
Figure 26:
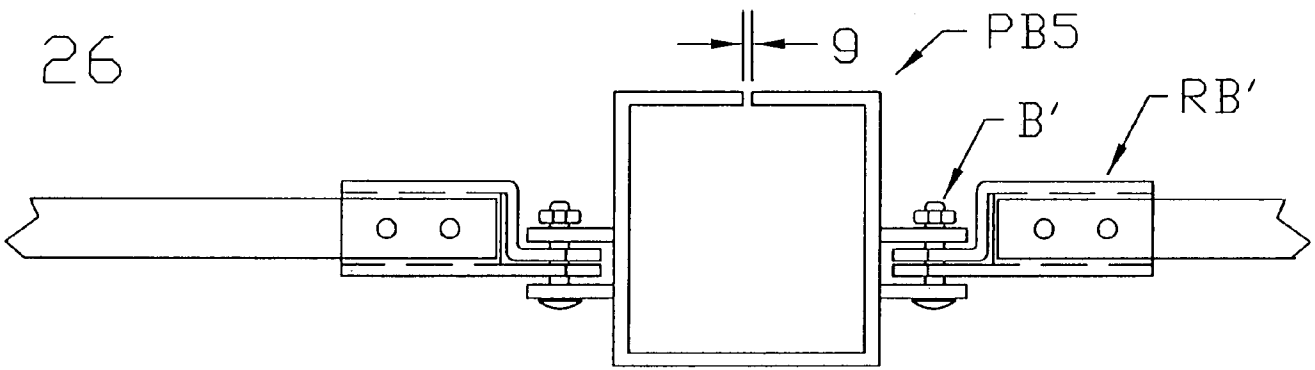
FIG. 26 shows a top view of the sixth embodiment bracket system of the invention. This embodiment uses a fifth embodiment post bracket formed from the sheet metal part shown in FIG. 25. However, the rail brackets used are the second embodiment rail brackets shown in FIGS. 22–24. The rails are shown installed in the rail brackets, but the fence post is not shown installed in the post bracket. The fasteners which would secure the rail brackets to the rails are not shown, but the openings that would receive the fasteners are shown.

FIGS. 25–26 show another embodiment of the bracket system according to the invention. The bracket system uses a unitary or one-piece post bracket PB5 that has a generally square shaped opening that is sized and shaped to slide over a fence post P (not shown). In this case, the fence post would have a 4×4 cross-sectional square shape, which means that the square shaped opening defined by the post bracket PB5 is slightly larger than 3.5 by 3.5" inches. It is preferred that the square shaped opening of the post bracket PB5 be approximately 1/16 inches larger, i.e., the opening should have the following dimensions, 3 9/16 by 3 9/16 inches. In this way, the post bracket PB5 can slide up and down on the post P until it is secured thereto by fasteners such as, e.g., nails, barbs or screws (not shown). The post bracket PB5 can be made in any desired way and can be made of any desired material such as plastic or metal. However, it is preferred that it be made of sheet metal and specifically galvanized sheet metal. The post bracket PB5 should also be made thin, but not so thin that strength is sacrificed to a significant extent. In this regard, it is preferred that the post bracket PB5 have a thickness in the range of approximately 1/32 inches to approximately ⅛ inches or more depending on the size of the fence. A particular preferred material and thickness is in the range of between 22 gage and 111 gage, with 12 gage (approximately 1/10" thick) galvanized sheet metal being preferred. Of course, the post bracket PB5 can also be made of plastic and formed as a unitary structure having a shape that resembles that shown in FIG. 26, but without gap "g", i.e., it can be cast, molded or extruded as in the embodiment shown in FIGS. 66*a–b*, but have the shape shown in FIG. 26 and with or without the gap "g".

Again, with reference to FIG. 26, the post bracket PB5 has a left side projecting portion and a right side projecting portion. The left side projecting portion includes two tabs T2 and T4 and the right side projecting portion includes two tabs T1 and T3. Each of these tabs T1–T4 are formed from a portion of the sheet material that is bent outwards. Thus, they have a thickness that is the same as the thickness of the remaining part of the post bracket PB5. As can be seen in FIG. 25, each tab also includes an opening, e.g., tabs T1 and T2 have openings T1*o* and T2*o*. The openings of left-side tabs T2 and T4 receive a fastener or bolt B'. Similarly, the openings of right-side tabs T1 and T3 receive another fastener or bolt B'. The bolts B' may be of any desired type. However, it is preferred that they be galvanized threaded metal bolts to withstand environmental conditions. It is also preferred that galvanized nuts be used with the bolts B'.

A left side rail bracket RB' of the type shown in FIGS. 22–23 is connected to the tabs T2 and T4 of the post bracket PB5 via the bolt B'. Similarly, a right side rail bracket RB' of the type shown in FIGS. 22–23 is connected to the tabs T1 and T3 of the post bracket PB5 via the other bolt B'. Each rail bracket RB' has one end that receives therein an end of a rail R and another end that connects to the post bracket PB5. In this regard, each rail bracket RB' has two tabs which each have an opening that receive the bolt B'. The rail brackets RB' also have an internal rectangular opening that is sized and shaped to be similar to that of the rail R. In this case, the rectangular opening of each rail bracket RB' is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB' can slide over the end of each rail R until it is secured thereto by fasteners such as, e.g., nails, barbs or screws (not shown). The two rail brackets RB' are essentially identical to each other and can be fabricated in any desired way. They can also be made of any desired material such as plastic or metal. However, it is preferred that they be made of sheet metal and specifically galvanized sheet metal of the same type as that used to make the post bracket PB5. The rail bracket RB' should thus be made thin, but not so thin that strength is sacrificed to a significant extent. In this regard, it is preferred that each rail bracket RB' have a thickness "th" (see FIG. 24) in the range of approximately 1/32 inches to approximately 1/8 inches depending on the size of the fence. A particular preferred material and thickness is in the range of between 22 gage and 11 gage, with 12 gage (approximately 1/10" thick) galvanized sheet metal being preferred. Of course, the rail brackets RB' can also be made of plastic and formed as a unitary structure having a shape that resembles that shown in FIG. 26, but without gap "g", i.e., it can be cast, molded, etc., as a one-piece member, but have the shape shown in FIG. 26 and with or without the gap "g".

In FIG. 26, a bolt B' is shown in the respective openings T1*o* and T2*o* of the tabs T1 and T2. Thus, it should be apparent that opening T2*o* of tab T2 is aligned with the opening T4*o* (not shown) of tab T4 and with the two openings in the left-side rail bracket RB'. This is evident in FIG. 26 where it is apparent that the bolt B' passes through these four openings. Similarly, the two respective openings of the tabs T1 and T3 are aligned with the two openings formed in the right side rail bracket RB' so that the bolt B' can pass through these four openings. Moreover, in this embodiment tabs T1–T4 are arranged near the center of the post bracket PB5. As a result, tabs T1–T4 are arranged to be generally slightly off-centered with respect to inner and outer walls of post bracket PB5. The inner wall of post bracket PB5 has the two edges of the post bracket PB5 and a space is provided between these two edges. This space is defined by gap "g" and results from the fact that the post bracket PB5 is bent from a one piece sheet metal blank. The gap "g" should be made as small as possible, preferably in the range of between approximately 1/16" and 1/4". The gap "g" may also serves an important purpose in that it allows for a variation in dimension of the internal opening to account for any variations in the cross-sectional size and shape of the post P. This way, clearances between the post bracket PB5 and the post P can be reduced.

In the embodiment just described (using a 4×4 post P and 2×3 rails R), the tabs T1–T4 may project from each of the opposite sides of the post bracket PB5 in the range of between approximately 1" and 1.5". The bolts B' may be 1/4" diameter and may have a length in the range of between approximately 3/4" and 1 1/4". The openings T1*o*–T4*o* in the tabs T1–T4, and the openings "spo" in the tabs of the rail brackets RB', should have approximately 5/16" diameter to accommodate the 1/4" bolts B'. The rail brackets RB' may have a after bending length (measured from the curved edge to the opposite straight edge) in the range of between approximately 2" and 4". The post bracket PB5 may have a width W (see FIG. 25) that is in the range of between approximately 3.5" and 5", with 4" being preferred when the internal opening is approximately 3 9/16" by 3 9/16". The distance between the inner parallel surfaces of tabs T2 and T4, as well as between the inner parallel surfaces of tabs T1 and T3, should be in the range of between approximately 1/5" and 1/2" depending on the thickness TH of the post bracket PB5 and the thickness "th" of the rail bracket RB'. The width of the tabs T1–T4 should be in the range of between 1.5" to 3" depending on the width W of the post bracket PB5. Preferably, the width of the tabs T1–T4 should be in the range of between approximately 25% to approximately 75% of the width W of the post bracket PB5. The openings No (see FIG. 25) of the post bracket PB5 and the openings "no" (see FIG. 23) of the rail brackets RB' can be between approximately 1/16" to approximately 3/16" diameter to receive fasteners such as nails or screws, and may be counter-sunk or counter-bored, if desired.

FIG. 25 illustrates the layout of a piece of sheet metal which can be used to form the post bracket PB5. The various features are not drawn to scale. However, the general arrangement or positions of the bend lines, holes and cut lines are shown to illustrate their general locations. The sheet metal piece has a generally rectangular shape with an upper or top edge TE and a lower or bottom edge BE. To form the generally square shaped bracket PB5 shown in FIG. 26, the sheet metal piece has five sections which are defined by four bend lines BL which extend from edge TE to edge BE. The location of the tabs T2 and T4 have been changed (relative to tabs T2 and T4 in, e.g., FIGS. 3 and/or 11) so that tabs T2 and T4 can be located closer to each other and can be slightly off-centered on left side wall of post bracket PB5. Similarly, the location of the tabs T1 and T3 have been changed so that tabs T1 and T3 can be located nearer each other and can be centered on right side wall of post bracket PB5. Otherwise, the post bracket PB5 can be formed in a manner similar to that described above with regard to FIGS. 3–5.

In forming the post bracket PB5 shown in FIG. 26, any number of desired and cost-effective methods and devices can be used. The state of the art in sheet metal fabrication includes devices which can form the openings No and T1*o*–T4*o*, and cut-lines CL by punching, water-jet cutting, laser cutting, plasma cutting, etc. Today's equipment also includes manual cutting and bending devices in addition to Computer Numerical Control (CNC) punch presses, as well as CNC plasma and laser cutters. One inexpensive way of forming the post bracket shown in FIGS. 25–26, is to use a punch press to form the plate shown in FIG. 25 with the holes No and T1*o*–T4*o*, and cut-lines CL being cut in the punch press. One or more secondary operations can then be used to form the bends resulting in the post bracket PB5 shown in FIG. 26. It is desirable to make the post bracket PB5 as cheaply as possible, since a typical fence may require dozens of post brackets PB5, yet strength and ease of use should not be sacrificed to a significant extent. Accordingly, it is believed that forming the post brackets PB5 from a one-piece sheet metal piece satisfies these requirements. Of course, an alternative way of forming the bracket shown in FIG. 26, can be by molding, casting or extrusion, whether the post bracket PB5 is to be made of metal or plastic, or even plastic coated metal. For example, today's equipment can extrude substantially the post bracket shape shown in FIG. 26, with or without the gap "g". Thereafter, the tabs T1–T4 and holes No and T1*o*–T4*o* can be shaped with cutting devices by milling, shaping, cutting, punching, and drilling, etc.

Figure 27:
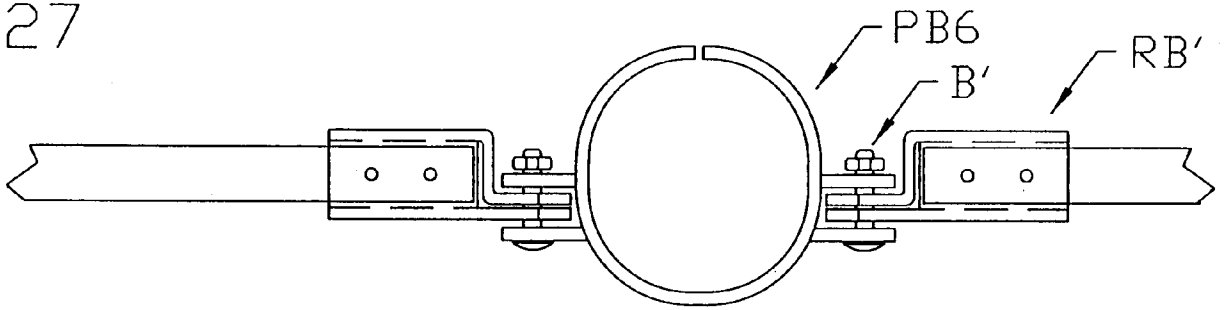
FIG. 27 shows a top view of a seventh embodiment bracket system of the invention. The post bracket is a sixth embodiment post bracket and the rail brackets used are the second embodiment rail brackets shown in FIGS. 22–24. The rails are shown installed in the rail brackets, but the fence post is not shown installed in the post bracket. The fasteners which would secure the rail brackets to the rails are not shown, but the openings that would receive the fasteners are shown.

FIG. 27 illustrates another embodiment of a bracket system. This embodiment shown a post bracket PB6 which can be made in a similar manner to that already described with regard to FIGS. 14–17, except that the position of the tabs T1–T4 correspond to a position, with respect to the post P and rails R, similar to that shown in FIGS. 25–26. This bracket system embodiment uses the second embodiment rail brackets RB' shown in, e.g., FIGS. 22–24 and the bolts B' shown in FIG. 26.

Figure 28:
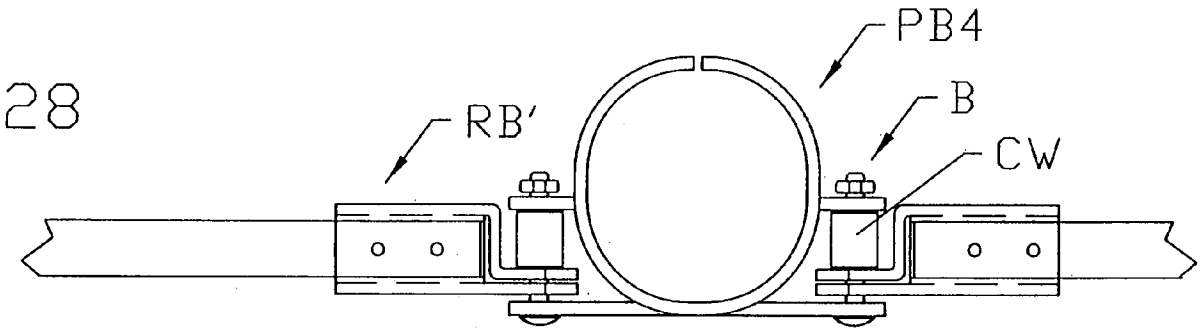
FIG. 28 shows a top view of an eighth embodiment bracket system of the invention. This embodiment uses the post bracket from the fourth embodiment. However, the rail brackets used are those of the second embodiment type. A spacer or cylindrical washer is utilized to adapt the second embodiment rail brackets to the fourth embodiment post bracket. The rails are shown installed in the rail brackets, but the fence post is not shown installed in the post bracket. The fasteners which would secure the rail brackets to the rails are not shown, but the openings that would receive the fasteners are shown.

FIG. 28 illustrates another embodiment of a bracket system. This embodiment shown a post bracket PB4 which can be made in a similar manner to that already described with regard to FIGS. 18–21. This bracket system embodiment uses the second embodiment rail brackets RB' shown in, e.g., FIGS. 22–24 as well as the bolts B and spacers CW shown in FIG. 22.

Figure 29:
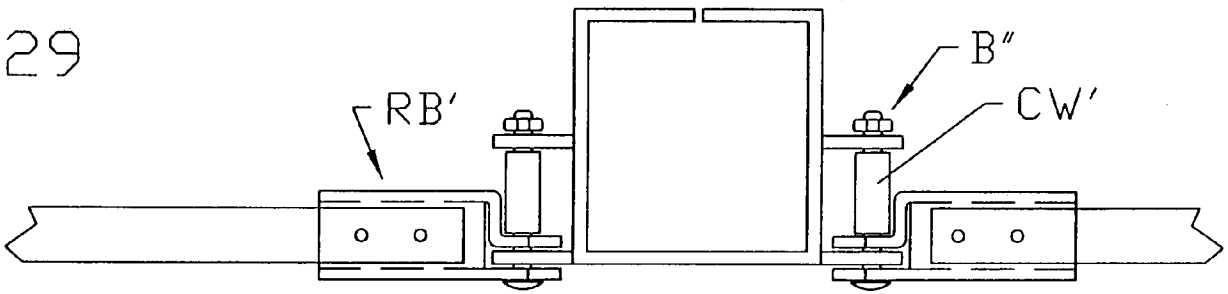
FIG. 29 shows a top view of a ninth embodiment of the bracket system of the invention. This embodiment uses the first embodiment post bracket. However, the rail brackets used are those of the second embodiment type. A spacer or cylindrical washer is utilized to adapt the second embodiment rail brackets to the first embodiment post bracket. The rails are shown installed in the rail brackets, but the fence post is not shown installed in the post bracket. The fasteners which would secure the rail brackets to the rails are not shown, but the openings that would receive the fasteners are shown.

FIG. 29 illustrates still another embodiment of a bracket system. This embodiment shown a post bracket PB1 which can be made in a similar manner to that already described with regard to FIGS. 2–5. This bracket system embodiment uses the second embodiment rail brackets RB' shown in, e.g., FIGS. 22–24 as well as the bolts B shown in FIG. 22. However, the spacers CW' in this embodiment are slightly longer than those used in FIG. 22, i.e., the extra length being a function of the thickness "th" of the rail bracket RB'.

Figure 30:
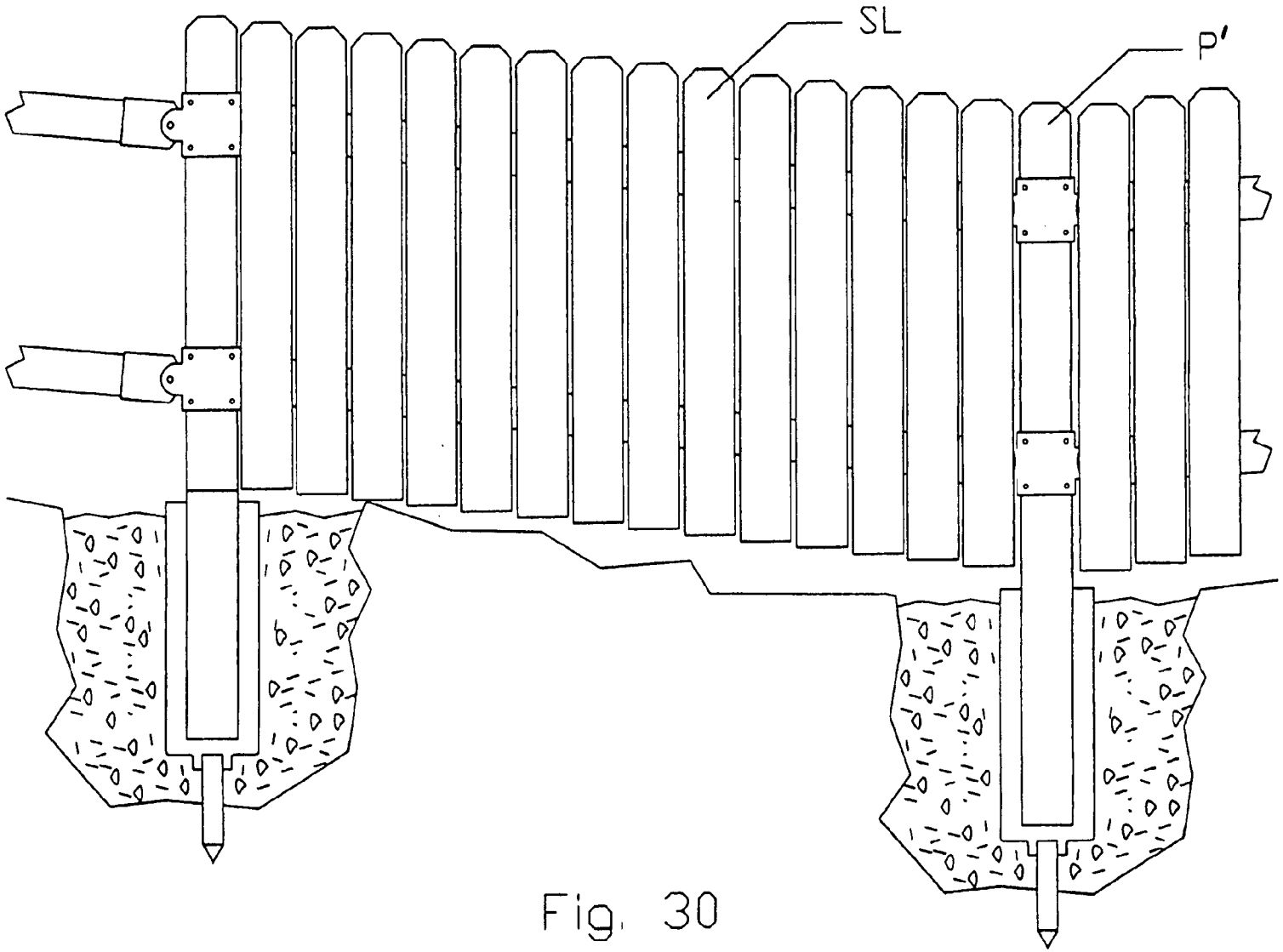
FIG. 30 shows an outer side view representation of a simple post and picket type fence installed on site and utilizing the first embodiment bracket system shown in FIGS. 2*a*–*b*. The fasteners which would secure the post brackets to the posts are not shown, but the openings that would receive the fasteners are shown.

FIG. 30 shows another embodiment of a fence according to the invention. Just as in the fence shown in FIG. 1, the fence includes a plurality of fence posts P', rails R and pickets or slats SL. The slats SL, rails R and posts P' can have any cross-sectional shape (e.g., square, rectangular, round, oval, etc), size and length and can be made of any material, whether conventionally used in fence construction or otherwise, and can be, e.g., solid or tubular and/or made of plastic, metal or wood. In this embodiment, the posts P' are five foot long 4×4 pressure treated wood posts, which means that they have a square cross-sectional shape that is approximately 3.5 inches by 3.5 inches square. The posts P' are fixed to the ground or earth E on site by digging holes therein, placing a bottom end of the post P' into each opening, and pouring concrete C into the openings. The concrete C surrounds the posts P' and ensures that they are securely fixed to the ground E. As is typical, the posts P' are leveled in position and well secured to the ground E once the concrete C is fully cured. The invention, however, improves the prior art by providing the posts P' with protective sleeves PS. These sleeves PS can be made of, e.g., plastic or synthetic resin. The protective sleeves PS are designed to slide over an end of each post P' so as to prevent moisture in the concrete C from penetrating into the posts P'. In this regard, it is preferred that the sleeves PS have an internal opening whose size and shape just slightly larger, i.e., 1/16" larger, than that of the post P'. It is also preferred that the sleeves be sufficiently long, e.g., 12" to 24" long not including the stake S, to accept therein between 8" and 1.5 feet of the post P'. To facilitate proper installation of the posts P' in the ground E, a stake S is attached to a bottom part of the protective sleeve PS. The stake S can be either removably attached or fixed to the sleeve PS. Using this arrangement, the posts P' can be leveled and held in position temporarily without resort to concrete C, i.e., if the stakes S penetrate the earth E by approximately 6" to 12", they should be able maintain the posts P' in vertical orientation without any concrete C. Preferably, the stakes S are in the range of 8" to 12" inches long.

Thus, the invention contemplates that the entire fence can be assembled on site (as will be more fully described herein) without the posts P' being initially set in the ground E with concrete C. Once the fence is fully assembled on site, concrete C can then be poured into each of the openings surrounding the posts P'. Conventionally, the posts P' are leveled and set into the ground with concrete on one day and then the fence, i.e., the rails R and the slats SL, are assembled to the posts P' on another day, i.e., once the concrete C has set to a significant extent. However, with the invention, the entire fence can assembled on the same day, so that when the concrete C is finally poured into the post openings, the fence becomes securely fixed to the ground. The workmen installing the fence would only have to come back to the site on another day to remove any bracing (which may be used to ensure that the fence is not disturbed by the wind or by inadvertent contact therewith) and to preform any required cleaning and/or backfilling, as necessary.

In assembling the simple post and rail fence shown in FIG. 30, the invention provides for a bracket system that can couple or connect the rails R to the posts P'. The bracket system includes post brackets PB, rail brackets RB and bolts B (not shown) connecting the rail brackets RB to the post bracket PB. Each post bracket PB is made of a thin material such as, e.g., sheet metal or extruded plastic, and is designed to surround the post P'. Each post bracket PB has an internal opening that is shaped (e.g., square, rectangular, round, oval, etc), and sized to slide snugly over the post P'. In this way, the post bracket PB can be slid up and down on the post P' depending on a desired positioning. Once in position, each post bracket PB can be fastened to the post P' via, e.g., nails, barbs or screws. To facilitate this fastening, a number of barbs and/or through holes (four holes being shown on each front surface) are provided in each post bracket PB. In the embodiment shown in FIG. 30, two posts brackets PB are used on each post P'.

Each post bracket PB has a wide middle portion and two narrower side projecting portions which each engage with a rail bracket RB. The rail brackets RB are slid over the ends of each rail R. Each rail bracket RB also has an internal opening that is shaped (e.g., square, rectangular, round, oval, etc., depending on the shape of the rail), and sized to slide snugly over the end of the rail R. In this way, the rail bracket RB can be used to adjust the length of the rail R depending on a movement of the post brackets PB, as described with regard to FIG. 1. Each rail bracket RB also has a projecting portion that engages a projecting portion of the post bracket PB. Once in position on a rail R, each rail bracket RB can be fastened to the rail R via, e.g., nails, barbs or screws. To facilitate this fastening, a number of barbs and/or through holes (not shown) are provided in each rail bracket RB. In the embodiment shown in FIG. 30, two rail brackets RB are coupled to opposite sides of each post bracket PB.

The rail bracket RB is similarly made of a thin material such as, e.g., sheet metal, and surrounds the end of the rail R. As will be more clearly described later on, each rail bracket RB has two opposite facing projecting portions which each have an opening and a curved end. Similarly, each of the projecting portions of the post bracket PB has openings and curved ends. In assembling the rails R to the posts P', the openings of the rail brackets RB are aligned with the openings of the post brackets PB. Then, bolts B (see e.g., FIGS. 2*a*, 10*a*, 14*a*, 22 and 26–29) are installed in the openings to connect each rail bracket RB to a post bracket PB. Once it is determined that the fence is fully and correctly aligned with the ground, that all of the rails R are aligned with one another, and/or the entire fence has the desired overall appearance, the rail brackets RB and the post brackets PB can be fully fastened respectively to the rails R and posts P' via barbs, nails or screws. This step essentially completes the assembly of the rails R to the posts P'. The slats SL can then be fastened to the rails R. Of course, to finish the fence, it may also be necessary to cut down the overall height of the posts P' and, perhaps, to cap them off with a decorative post cap (not shown). Finally, the concrete C can be poured to complete the fence installation on site.

Just as with the posts P', the rails R and slats SL can have any cross-sectional shape, size and length and can be made of any material, whether conventionally used in fence construction or otherwise, such as, e.g., tubular or solid and/or made of plastic, metal or wood. However, in this embodiment (with the posts P' being arranged approximately 8 feet on center), the rails R can be approximately seven foot six inches long 2×3 pressure treated wood rails. This means that they have a rectangular cross-sectional shape that is approximately 1.5 inches by 2.5 inches. Additionally, it should be noted that while FIG. 30 shows a fence that uses posts P', rails R and pickets or slats SL, it should be apparent that the invention can also be practiced with fence sections, i.e., with each fence section having two or more rails R and slats or pickets SL already attached to the rails R. Such a fence would resemble that shown in FIGS. 38 and 48.

The advantage of the bracket system of the invention is that the fence is made much stronger that those which are merely nailed together, those which use basic side-attaching L-brackets, and/or those which merely insert the ends of the rails R into lateral openings in the posts P'. Moreover, a fence that is made using the bracket system of the invention can be easily repaired and/or adjusted, i.e., by removing the fasteners which secure the rail brackets RB and post brackets PB and by moving the post brackets PB up and down. Additionally, the length of the rails R can be adjustable quickly and easily without significantly affecting its strength. In this regard, two rail brackets RB can lengthen or shorten a rail R a certain significant extent (up to approximately 3 inches or more depending on the length and size of the rail brackets RB). This adjustment results because the rail brackets RB are slidably mounted to the ends of the rails R and act to extend or shorten the rails R depending on the relative position of the rail brackets RB on the rails R. This also results in the advantage that the rails R need not be cut on site to a precise and custom length, i.e., often dictated by the exact distance between adjacent posts P', as in the prior art. This also means that the ends of the rails R do not have to be precisely shaped or angled (i.e, they can have perpendicular ends and be angled with respect to the posts), especially when the rails R are not oriented perpendicular to the posts P'. This is usually the case in the prior art when the ends of the rails R must be angled to so that they can be butted-up against the posts P' and nailed thereto.

Figure 31:
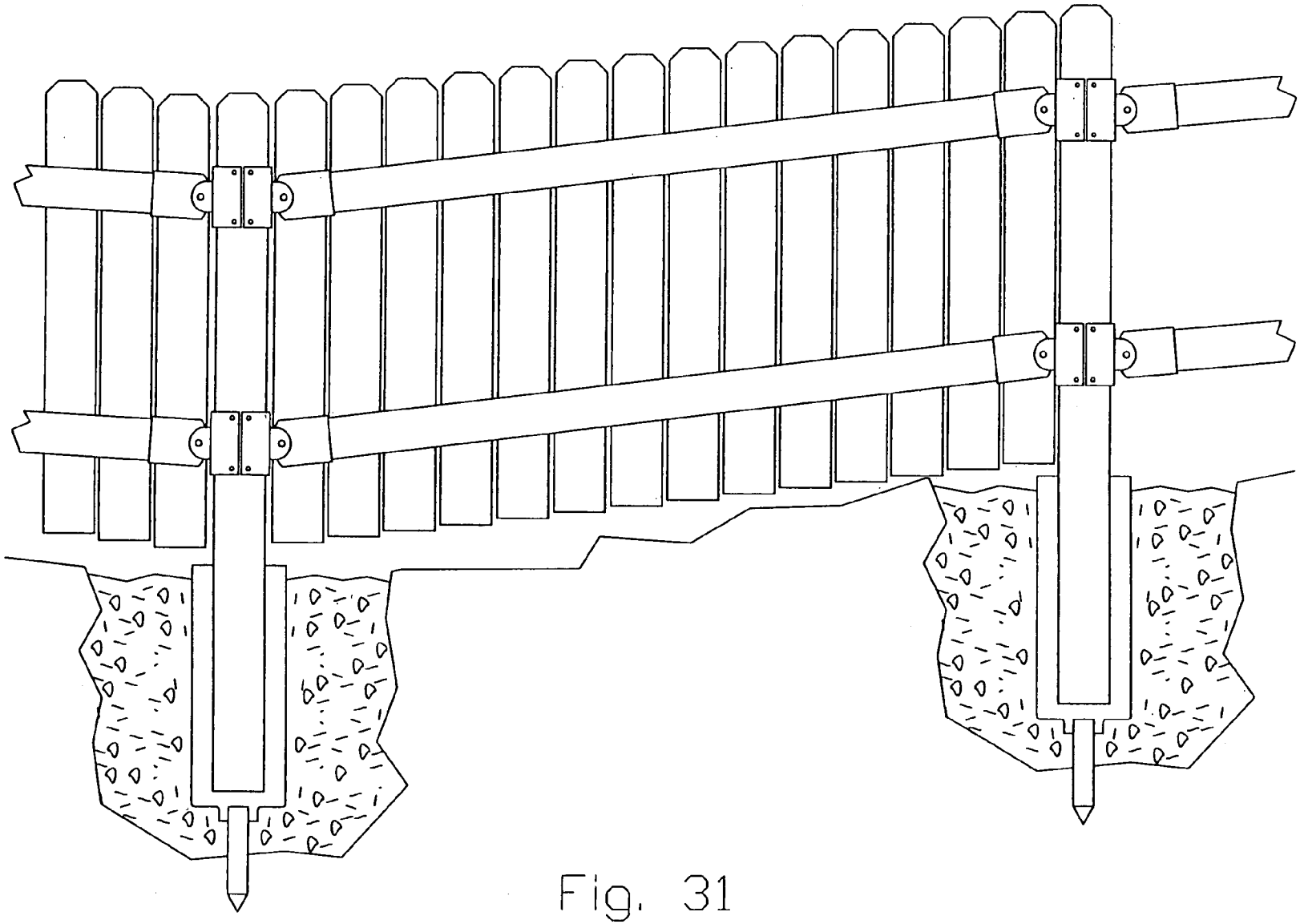
FIG. 31 shows a inner side view representation of the simple post and picket type fence shown in FIG. 30. The fasteners which would secure the post brackets to the posts are not shown, but the openings that would receive the fasteners are shown.

FIG. 31 shows a inner side view representation of the simple post and picket type fence shown in FIG. 30. The fasteners which would secure the post brackets PB to the posts P' are not shown, but the openings that would receive the fasteners are shown. The pickets or slats SL can be secured to the rails R in any desired way. They also can be secured to the rails R either before or after the rails R are secured to the rail brackets RB and before or after the post brackets PB are secured to the posts P'.

Figure 32A:
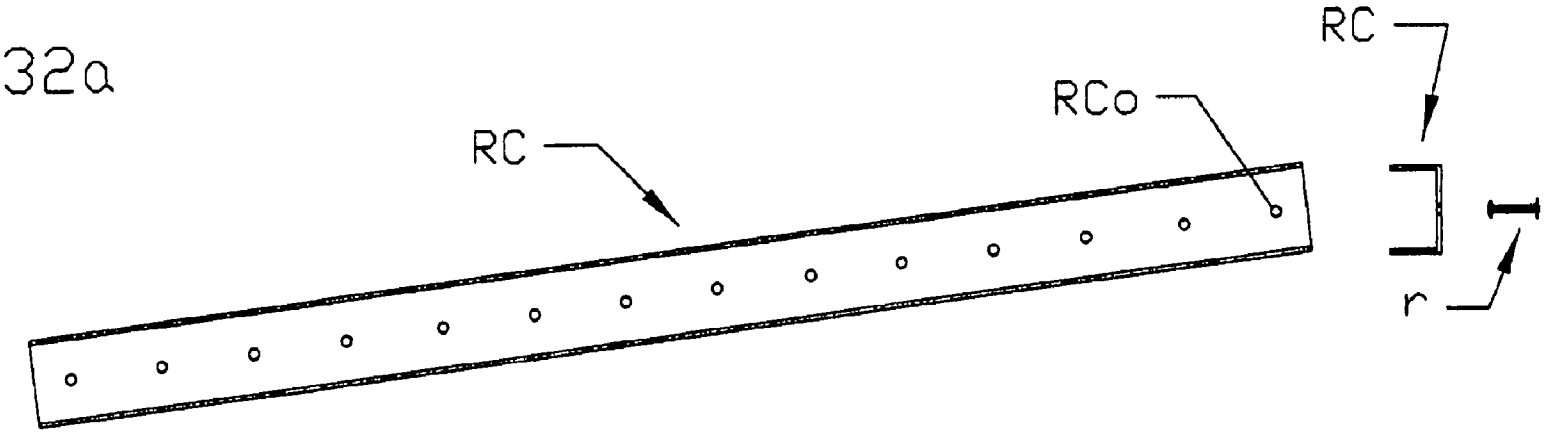
FIG. 32*a* shows an angled side view and an end view a rail channel. A rivet is shown for use in attaching the rail channel to each of the pickets or slats.

FIG. 32*a* shows an angled side view and an end view a rail channel RC. The rail channel RC has a U-shaped profile can be made of plastic, metal or plastic coated metal. However, it is preferred that it be made of sheet metal and specifically galvanized sheet metal of the same type as that used to make the post brackets PB and rail brackets RB. The rail channel RC should be made thin, but not so thin that strength is sacrificed to a significant extent. In this regard, it is preferred that each rail channel RC have a thickness RCth (see e.g., FIG. 39) in the range of approximately 1/32 inches to approximately 1/8 inches depending on the size of the fence. A particular preferred material and thickness is in the range of between 22 gage and 11 gage, with 12 gage (approximately 1/10" thick) galvanized sheet metal being preferred. Of course, the rail channels RC can also be made of plastic and formed as a unitary structure having a shape that resembles that shown in FIG. 32*a*, i.e., it can be cast, molded, or extruded as a one-piece member and thereafter the rivet holes RCo and the fastener holes Fo (see FIG. 35) can be formed therein. A rivet "r" is shown for use in attaching each of the slats SL to the rail channel RC. The rivet openings RCo of the rail channel RC and the fastener openings Fo can be between approximately 1/16" to approximately 1/4" or more in diameter to receive fasteners such as nails or screws, and may be counter-sunk or counter-bored, if desired. Integrally formed barbs can also be provided on the rail channels RC in place of or in addition to the fastener openings Fo.

Figure 32B:
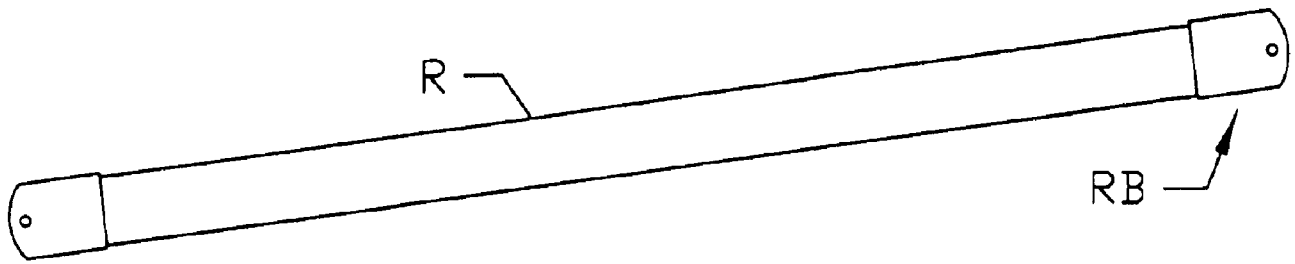
FIG. 32*b* shows an angled side view of a rail with rail brackets installed thereon.

FIG. 32*b* shows an angled side view of a rail R with rail brackets RB installed thereon. The figure illustrates that the rail brackets RB can be slid over the ends of the rail R before it is secured to the post brackets PB.

Figure 33:
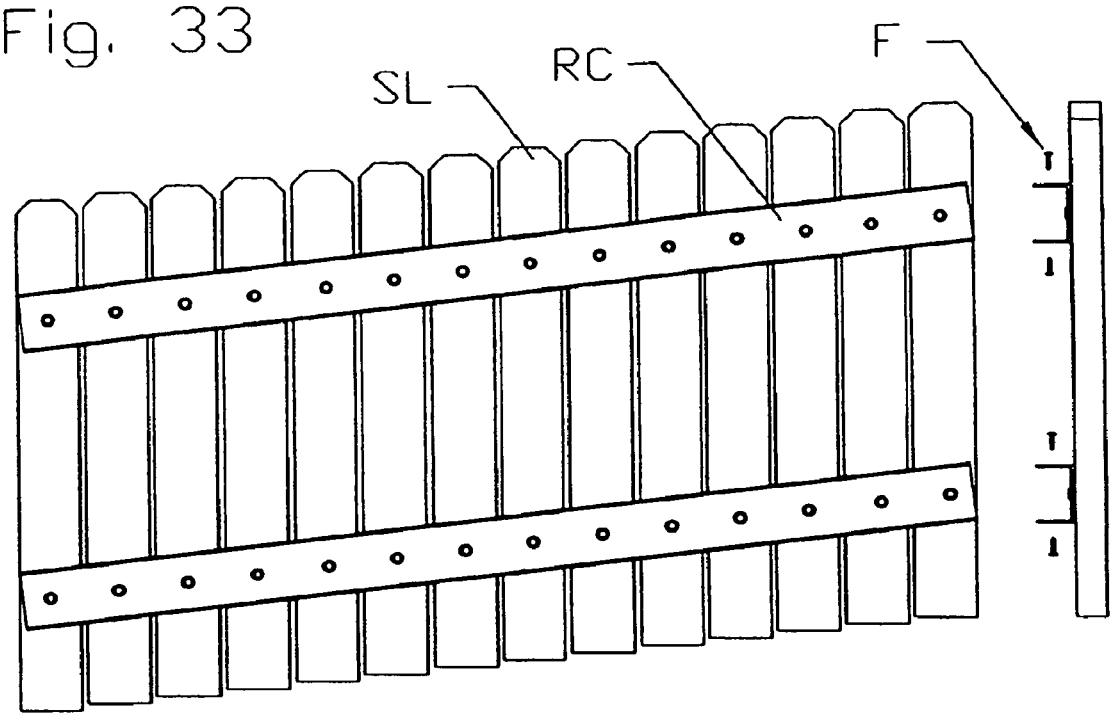
FIG. 33 shows an inner side and end view of a fence section. The side view shown the fence section after it has been deflected to a desired angular position. The rail channel is shown attached to all of the pickets or slats via the rivets. Fasteners are shown in the side view for attaching the rail channels of the fence section to the fence rails.

FIG. 33 shows an inner side and end view of a fence section which includes two rail channels RC. A plurality of pickets or slats SL have been secured to the two rails R using rivets "r". The side view shows the fence section after it has been deflected to a desired angular position. The fence section can be deflected up to a maximum angle, e.g, which can be up 45 degrees, depending on the space or distance between the slats SL. It should be apparent that at the maximum angle, the slats SL contact one another. This distance should be in the range of 1/8" to 2" or more depending on the width of the slats SL, the desired aesthetic appearance of the fence, and the desired maximum angle.

The deflection occurs because the rivets "r" allow the slats SL to move, i.e., rotate, relative to the rails R. The rail channels RC are attached to all of the pickets or slats SL via the rivets "r" which pass through openings in the slats SL. The parallel walls of the rail channel RC are spaced apart by a distance that is slightly greater than a height Rh of the rails R or rail brackets RB and can be in the range of between approximately 2¾" to 2⅞" when the rails R are, e.g., 2×3 wooden rails. Fasteners F (e.g., nails or screws) are shown in the side view for attaching the rail channels RC of the fence section to the fence rails R. As discussed above, integrally formed barbs (not shown) can also be provided on the rail channels RC in place of or in addition to the fastener openings Fo to facilitate securing of the rail channels RC to the rails R. The advantage of using such pre-assembled fence sections is that one can quickly assembly fence with the posts P and rails R using the bracket system of the invention, and thereafter efficiently assembling the fence sections to the rails R to complete fence assembly.

Figure 34:
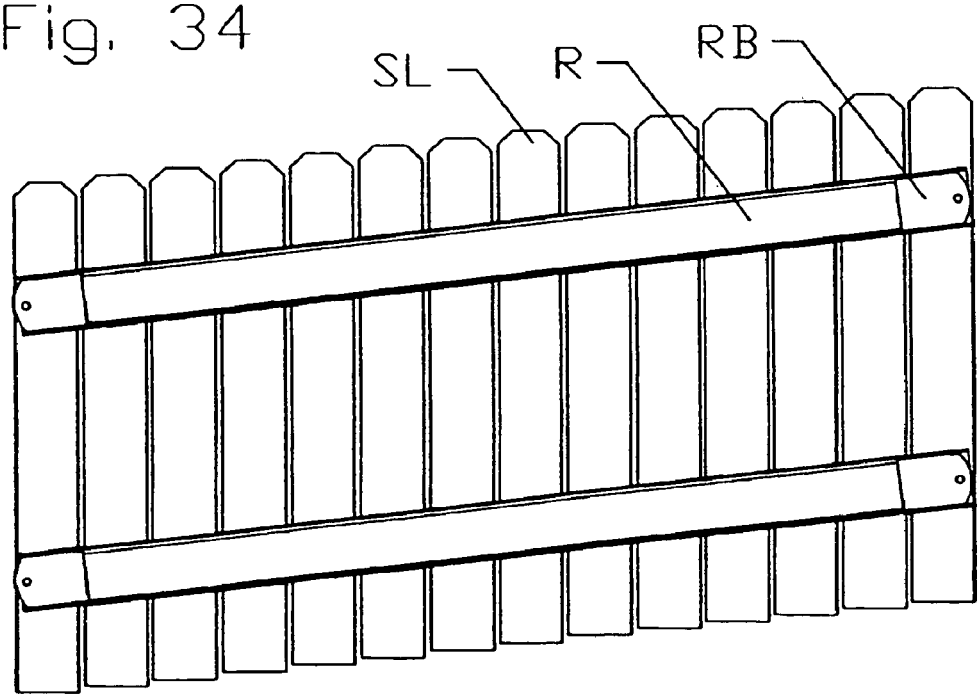
FIG. 34 shows an inner side view of the fence section shown in FIG. 33. The figure illustrates how the rails fit within the rail channels.

FIG. 34 shows an inner side view of the fence section shown in FIG. 33. The figure illustrates how the rails R fit within the rail channels RC.

Figure 35:
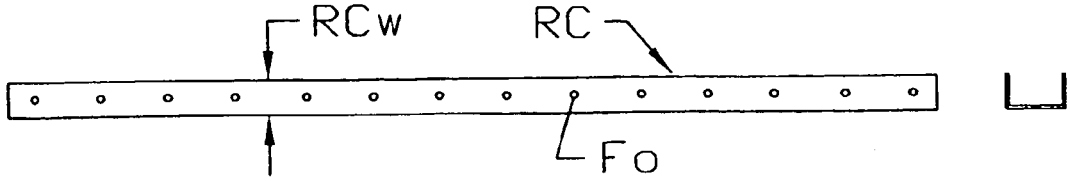
FIG. 35 shows a top side and an end view of a rail channel. The side view shows that the channel is U-shaped and the top side view shows that it is preformed with through holes used to receive fasteners for attaching the rail channel to the fence rail.

FIG. 35 shows a top side and an end view of the rail channel RC shown in FIG. 32*a*. The side view shows that the rail channel RC is U-shaped and the top side view shows that it is preformed with through holes Fo used to receive the fasteners F for attaching the rail channel RC to the fence rail R.

Figure 36:
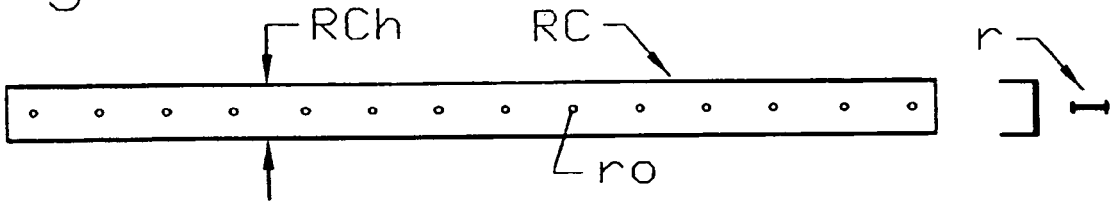
FIG. 36 shows a side and an end view of the rail channel shown in FIG. 35. The side view shows the preformed through holes used to receive the rivets for attaching the rail channel to the slats or pickets and the end view shows a rivet.

FIG. 36 shows a side and an end view of the rail channel RC shown in FIG. 35. The side view shows the preformed through holes "ro" (which can be between ⅛" to 1/14" or more in diameter) used to receive the rivets "r" for attaching the rail channel RC to the slats or pickets SL and the end view shows the rivet "r". Of course, the invention also contemplates using other fasteners in place of the rivets "r" such as, e.g., screws or nails.

Figure 37:
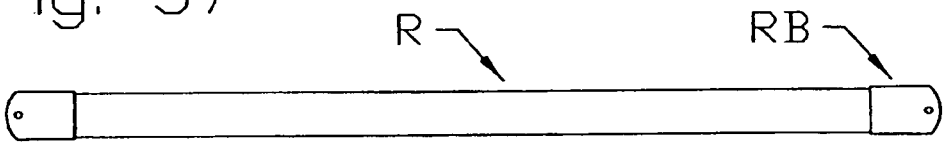
FIG. 37 shows a side view of the fence rail shown in FIGS. 32*b* and 34.

FIG. 37 shows a side view of the fence rail shown in FIGS. 32*b* and 34 with the rail brackets RB slid over the ends of the rails R.

Figure 38:
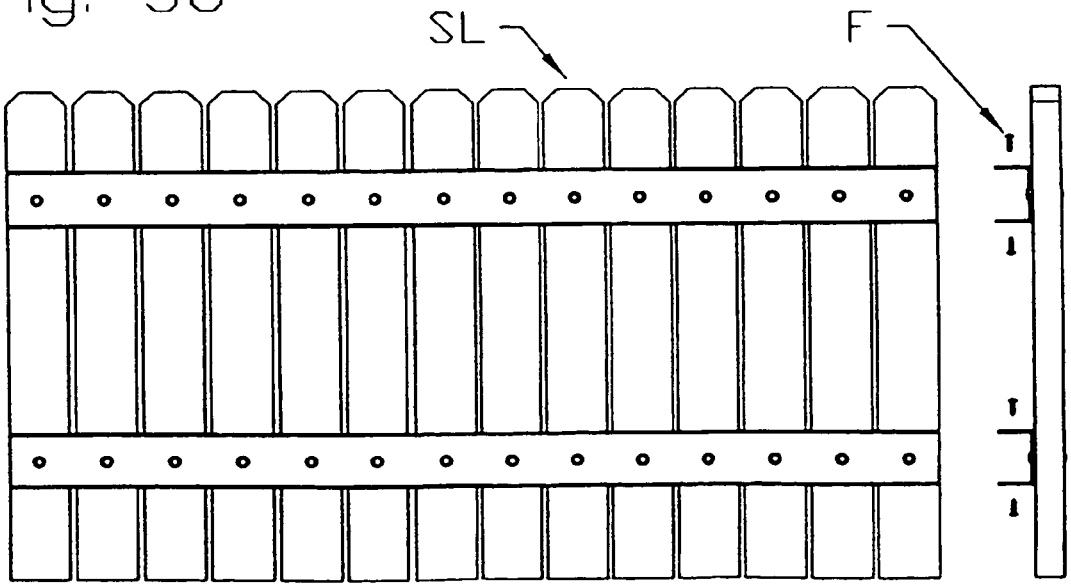
FIG. 38 shows an inner side and end view of a fence section shown in FIG. 33 before it has been deflected to the desired angular position shown in FIG. 33.

FIG. 38 shows an inner side and end view of the fence section shown in FIG. 33 before it has been deflected to the desired angular position shown in FIG. 33. It should be apparent that the distance between the slats SL is at its maximum when the fence section is in the position shown in FIG. 38.

Figure 39:
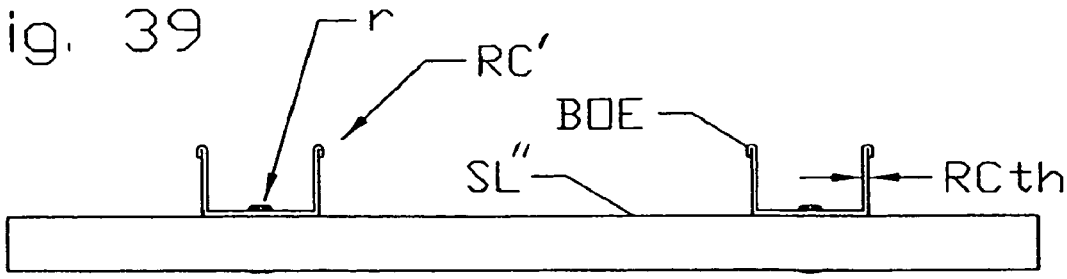
FIG. 39 shows an end view of a fence section similar to the one shown in FIG. 38. The view shows another embodiment of the U-shaped rail channels. The rails channels of this embodiment have longitudinal edges or ends which are folded or bent over to prevent injury.

FIG. 39 shows an end view of a fence section similar to the one shown in FIG. 38. The view shows another embodiment of the U-shaped rail channels RC' which are secured to the slats SL" via rivets "r". The rail channels RC' of this embodiment have longitudinal edges or ends BOE which are folded or bent over to prevent injury. Otherwise, they are essentially the same as those described in FIGS. 33–36.

Figure 40:
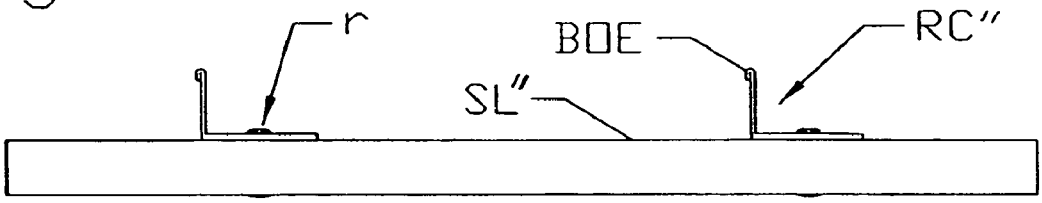
FIG. 40 shows an end view of a fence section similar to the one shown in FIG. 38. The view shows still another embodiment of the rail channel. Unlike the U-shaped rail channels shown in FIG. 39, the rail channels shown here are L-shaped and have one longitudinal edge or end which are folded or bent over to prevent injury.

FIG. 40 shows an end view of a fence section similar to the one shown in FIG. 38. The view shows still another embodiment of the rail channel RC". Unlike the U-shaped rail channels RC" shown in FIG. 39, the rail channels RC" shown here are L-shaped and have one longitudinal edge or end BOE which are folded or bent over to prevent injury. While the wall that has the edge BOE is shown on the left side of the rail channel RC", the invention contemplates that the L-shaped channels RC" can be arranged in other ways such as, e.g., facing one another.

Figure 41A:
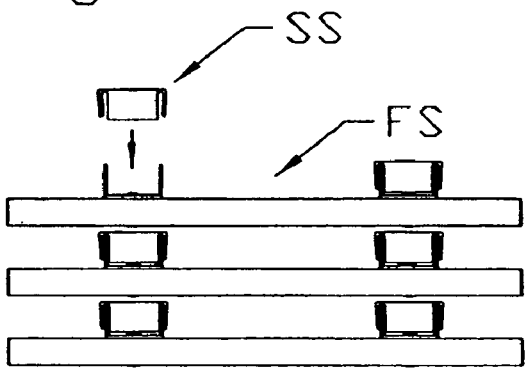
FIGS. 41*a*–*b* show sides views of a stack of fence sections of the type shown in FIG. 38 or 39. To ensure that the U-shaped rail channels are not damaged or deflected out of shape while the fence sections are stacked on top of one another.
Figure 41B:
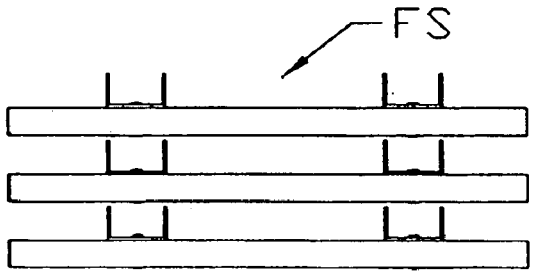

FIGS. 41*a*–b show sides views of a stack of fence sections FS of the type shown in FIG. 38 or 39. To ensure that the U-shaped rail channels RC are not damaged or deflected out of shape while the fence sections FS are stacked on top of one another, FIG. 41*a* shows that 2" by 4" long foam, plastic or wood spacer devices SS can be positioned near the ends of the rail channels RC (e.g., 4 per fence section) to prevent the rail channels RC from deflecting out of shape. Alternatively, no spacers SS need be used to ensure that the rail channels RC are not damaged while the fence sections FC are stacked on top of one another, as shown in FIG. 41*b*.

Figure 42A:
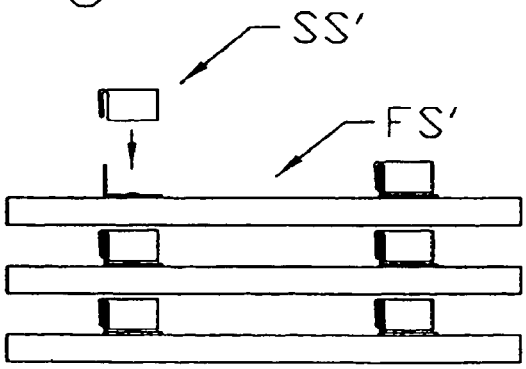
FIGS. 42*a*–*b* show sides views of a stack of fence sections of the type shown in FIG. 40. To ensure that the L-shaped rail channels are not damaged while the fence sections are stacked on top of one another, FIG. 42*a* shown 2" by 4" long spacer devices are used near the ends of the rail channels to prevent the rail channels from deflecting out of shape. Alternatively.
Figure 42B:
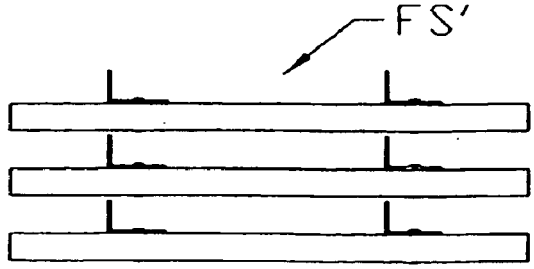

FIGS. 42*a*–*b* show side views of a stack of fence sections of the type shown in FIG. 40. To ensure that the L-shaped rail channels RC' are not damaged while the fence sections FS are stacked on top of one another, FIG. 42*a* shows 2" by 4" long spacer devices are used near the ends of the rail channels RC' to prevent the rail channels RC' from deflecting out of shape. Alternatively, FIG. 42*b* shows that no spacers SS' need be used to ensure that the rail channels RC' are not damaged while stacked on top of one another.

Figure 43:
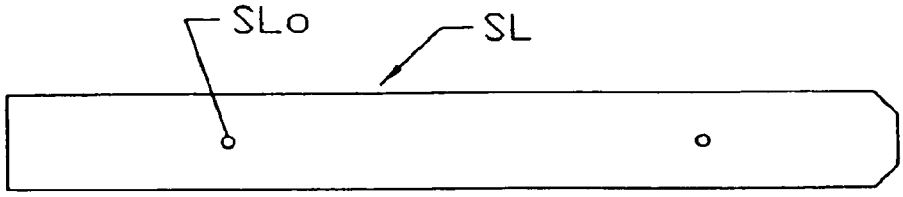
FIG. 43 shows a side view of a slat or picket used in the fence section shown in FIG. 38. Through holes are shown for receiving the rivets that connect the slat or picket to the rail channels.

FIG. 43 shows a side view of a slat or picket SL used in the fence section shown in FIG. 38. Through holes SLo are shown for receiving the rivets "r" that connect the slat or picket SL to the rail channels RC. The slats SL can be any desired cross-sectional size, shape and length and can be solid or tubular. However, in the embodiments described herein, they are, e.g., 4 foot long 1×4 inch wooden slats SL.

Figure 44:
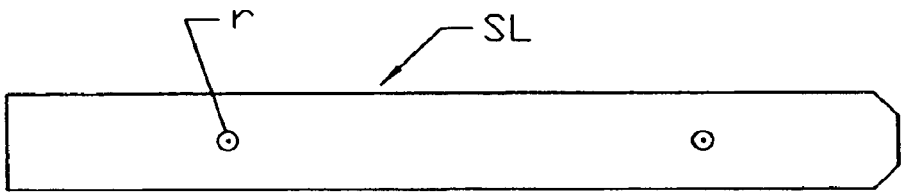
FIG. 44 shows a side view of a slat or picket shown in FIG. 43. The rivets are also shown.

FIG. 44 shows a side view of a slat or picket SL shown in FIG. 43. The rivets "r" are shown installed in the through openings SLo.

Figure 45:
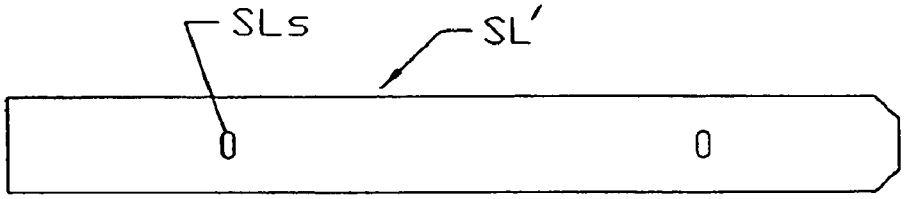
FIG. 45 shows a side view of a slat or picket similar to the one shown in FIG. 43. Instead of the circular holes shown in FIG. 43, slots are used for receiving the rivets that connect the slat or picket to the rail channels.

FIG. 45 shows a side view of a slat or picket SL' similar to the one shown in FIG. 43. Instead of the circular holes shown in FIG. 43, slots SLs are used for receiving the rivets "r" that connect the slat or picket SL' to the rail channels RC.

Figure 46:
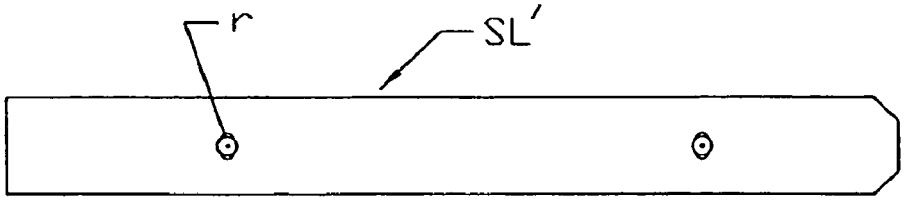
FIG. 46 shows a side view of a slat or picket shown in FIG. 45. The rivets are also shown.

FIG. 46 shows a side view of a slat or picket SL' shown in FIG. 45. The rivets "r" are shown installed on the slots SLs.

Figure 47:
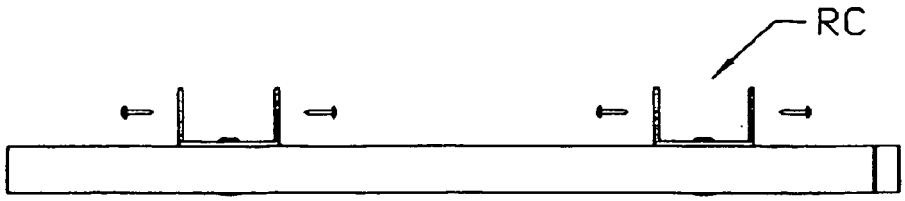
FIG. 47 shows an end view of a fence section similar to the one shown in FIG. 38. The view shows an enlarged view of the U-shaped rail channels.

FIG. 47 shows an end view of a fence section similar to the one shown in FIG. 38. The view shows an enlarged view of the U-shaped rail channels RC and the fasteners F which secure the rail channels RC to the rails R.

Figure 48:
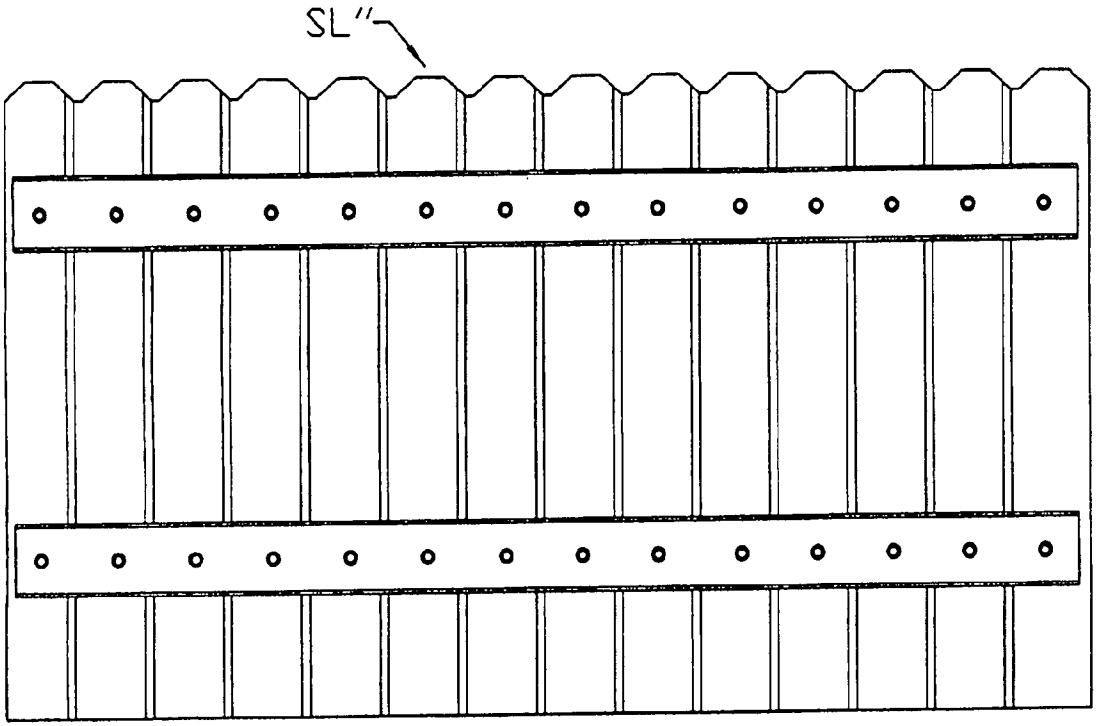
FIG. 48 shows an inside view of another embodiment of a fence section. The fence section has slats or pickets whose side edges overlap one another to provide more privacy. However, the fence section is of the type which can deflect in a manner similar to just as the embodiment shown in FIG. 33.

FIG. 48 shows an inside view of another embodiment of a fence section. The fence section has slats or pickets SL" whose side edges are formed to have projecting positions that overlap one another. This type of fence section can be used to provide more privacy and yet maintains the ability to deflect to an angular position. Thus, the fence section can deflect in a manner similar to the embodiment shown in FIG. 33. The overlapping edges can be formed by routering, milling, cutting, etc., when the slats SL" are made of wood and can be formed integrally with slats SL" when they are formed of plastic by casting, molding, or extrusion. Once formed, the slats SL" can be attached to the rail channels RC in the same manner described above.

Figure 49:
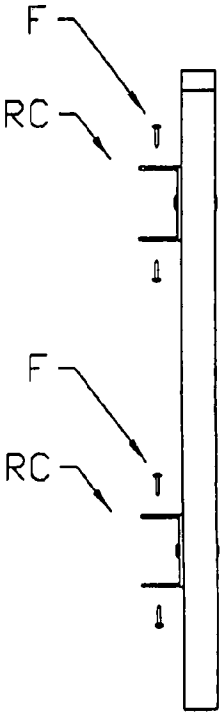
FIG. 49 shows an end view of the fence section shown in FIG. 48. The view shows the U-shaped rail channels and fasteners for connecting the rail channels to the fence rails.

FIG. 49 shows an end view of the fence section shown in FIG. 48. The view shows the U-shaped rail channels RC and the fasteners F which will be used to connect the rail channels RC to the fence rails R. Of course, this embodiment can also use barbs in combination with or in place of the fasteners F.

Figure 50:
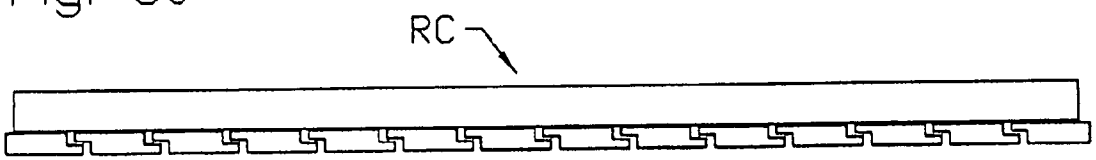
FIG. 50 shows a bottom view of the fence section shown in FIG. 48. The view shows the slats or pickets overlapping one another and yet being spaced apart from one another.

FIG. 50 shows a bottom view of the fence section shown in FIG. 48. The view shows the slats or pickets SL" overlapping one another a small amount and yet being spaced apart from one another. The openings Fo (see FIG. 35) and/or barbs (not shown) are utilized on the rail channel RC.

Figure 51A:
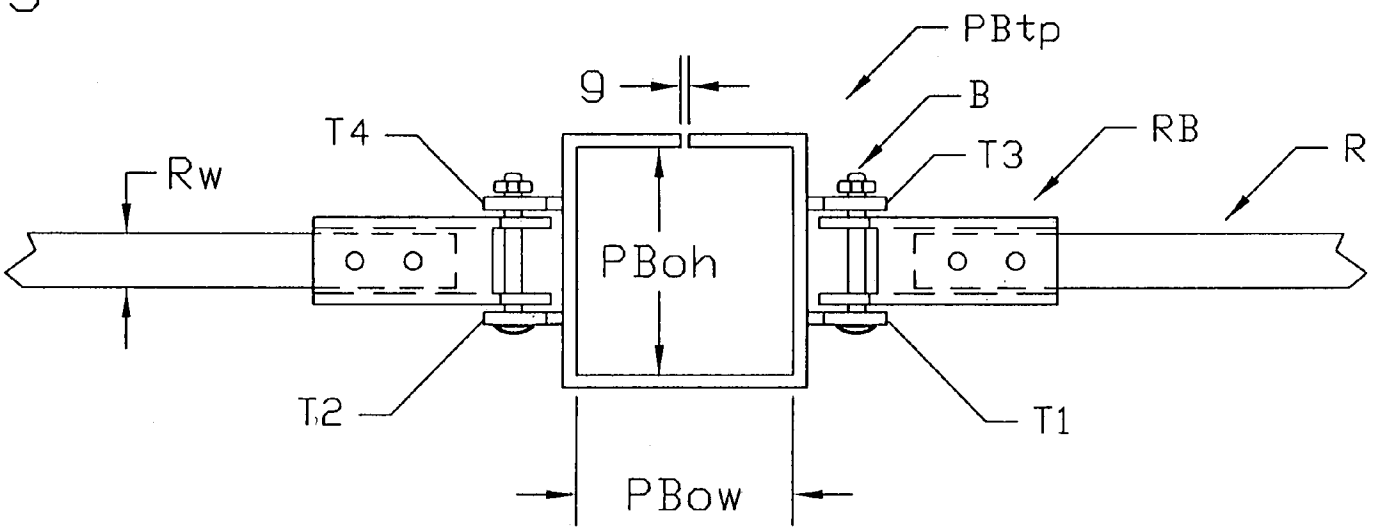
FIG. 51*a* shows a top view of still another embodiment of the bracket system of the invention. The post bracket in this embodiment is similar to the one shown in FIG. 13 except that it is of a two piece design. The rails are shown installed in the rail brackets, but the fence post is not shown installed in the post bracket. The fasteners which would secure the rail brackets to the rails are not shown, but the openings that would receive the fasteners are shown.
Figure 54:
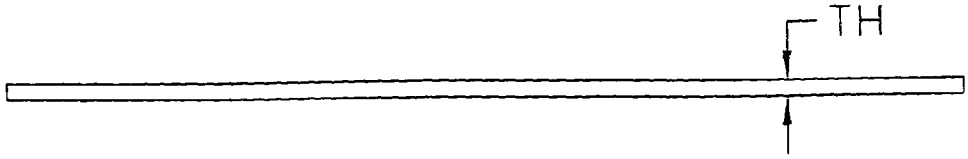
FIG. 54 shows a side view of each of the stock sheet metal parts shown in FIGS. 52 and 53.

FIG. 51*a* shows a top view of still another embodiment of the bracket system of the invention. The post bracket PBtp in this embodiment is similar to the one shown in FIG. 13 except that it is of a two piece design. The rails R are shown installed in the rail brackets RB, but the fence post P is not shown installed in the post bracket PBtp. The fasteners which would secure the rail brackets RB to the rails R are not shown, but the openings "no" that would receive the fasteners are shown. The bracket system uses two-piece post bracket PBtp that has a square-shaped opening that is sized and shaped to slide over a fence post P (not shown). In this case, the fence post would have a 4×4 cross-sectional square shape, which means that the square shaped opening defined by the post bracket PBtb is slightly larger than 3.5 inches by 3.5 inches. It is preferred that the square shaped opening of the post bracket PBtp be approximately 1/16 inches larger, i.e., the opening should have the following dimensions, PBow=3 9/16 inches and PBoh=3 9/16 inches. In this way, the post bracket PBtp can slide up and down on the post P until it is secured thereto by fasteners such as, e.g., nails, barbs or screws (not shown). The post bracket PBtp can be made in any desired way and can be made of any desired material such as plastic or metal. However, it is preferred that it be made of sheet metal and specifically galvanized sheet metal. The each of the two parts of post bracket PBtp should also be made thin, but not so thin that strength is sacrificed to a significant extent. In this regard, it is preferred that the post bracket PBtp have a thickness TH (see FIG. 54) in the range of approximately 1/32 inches to approximately 1/8 inches or more depending on the size of the fence. A particular preferred material and thickness TH is in the range of between 22 gage and 11 gage, with 12 gage (approximately 1/10" thick) galvanized sheet metal being preferred. Of course, the post bracket PBtp can also be made of plastic and formed as unitary structures which when assembled together have a shape that resembles that of FIG. 51*a*, but without gap "g", i.e., each part can be cast, molded or extruded as in the embodiment shown in FIGS. 66*a–b*, and then assembled to form the shape shown in FIG. 51*a* and with or without the gap "g".

Figure 51B:
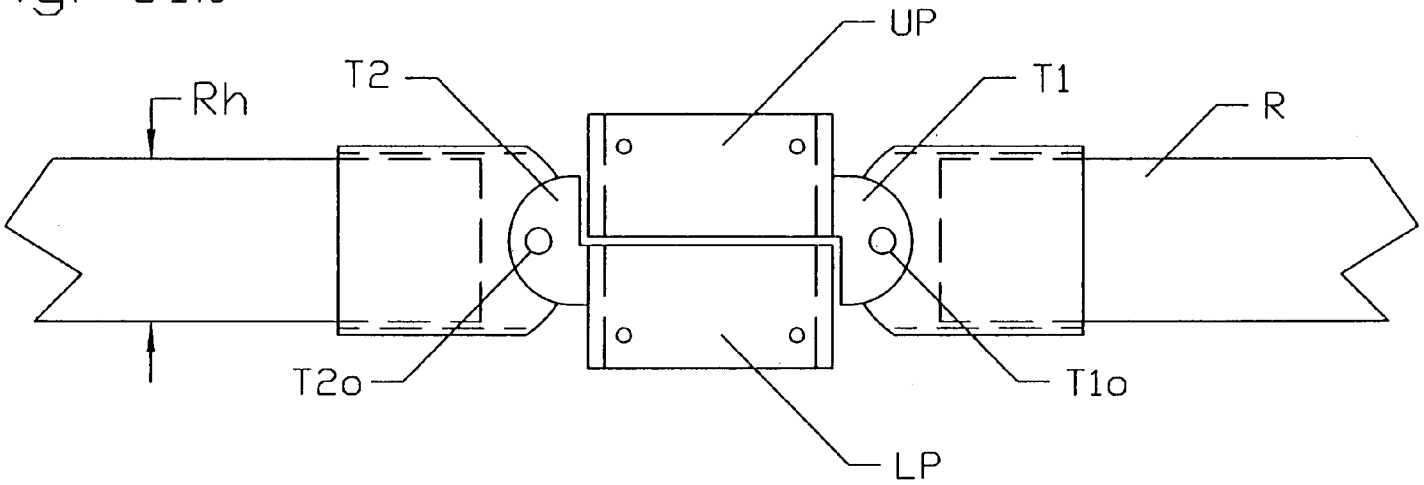
FIG. 51*b* shows a side view of the embodiment shown in FIG. 51*a*, except that the bolts securing the rail brackets to two-piece the post bracket have been removed. The two-piece post bracket has an upper part and a lower part.

Again, with reference to FIGS. 51*a–b*, the post bracket PBtp has a left side projecting portion and a right side projecting portion. The left side projecting portion includes two tabs T2 and T4 which are formed on the lower part LP of the post bracket PBtp. The right side projecting portion includes two tabs T1 and T3 which are formed on the upper part UP of the post bracket PBtp. Each of these tabs T1–T4 are formed from a portion of the sheet material that is bent outwards. Thus, they have a thickness that is the same as the thickness of the remaining part of the post bracket PBtp. As can be seen in FIG. 51*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts B to withstand environmental conditions. It is also preferred that galvanized nuts be used with the bolts B.

A left side rail bracket RB of the type shown in FIGS. 6–9 is connected to the tabs T2 and T4 of the post bracket PBtp via the bolt B. Similarly, a right side rail bracket RB of the type shown in FIGS. 6–9 is connected to the tabs T1 and T3 of the post bracket PBtp via the other bolt B. Each rail bracket RB has one end that receives therein an end of a rail R and another end that connects to the post bracket PBtp. In this regard, each rail bracket RB has two tabs which each have an opening that receives the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB can slide over the end of each rail R until it is secured thereto by fasteners such as, e.g., nails, barbs or screws (not shown). The two rail brackets RB are essentially identical to each other and can be fabricated in any desired way. They can also be made of any desired material such as plastic or metal. However, it is preferred that they be made of sheet metal and specifically galvanized sheet metal of the same type as that used to make the post bracket PBtp. The rail bracket RB should thus be made thin, but not so thin that strength is sacrificed to a significant extent. In this regard, it is preferred that each rail bracket RB have a thickness "th" (see FIG. 7) in the range of approximately 1/32 inches to approximately 1/8 or more inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure having a shape that resembles that of FIG. 8, but without gap "g", i.e., it can be cast, molded or extruded as a one-piece member, but have the shape shown in FIG. 8 and with or without the gap "g". Spacers of the type shown in FIG. 65*a* can also be used in this embodiment.

In FIG. 51*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 and with the two openings in the left-side rail bracket RB. This is evident in FIG. 51*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment tabs T1–T4 are centrally arranged on the left and right walls of the post bracket PBtp. As a result, tabs T1 and T2 are arranged to be generally centered with respect to inner and outer walls of post bracket PBtp. The inner wall of post bracket PBtp includes the two edges of the post bracket PBtp with a space being provided between these two edges. This space is defined by gap "g" and results from the fact that the parts UP and LP of post bracket PBtp are each bent from one piece sheet metal blanks. The gap "g" should be made as small as possible, preferably in the range of between approximately 1/16" and 1/4". The gap "g" can also serve an important purpose in that it allows for a variation in dimension PBow to account for any variations in the cross-sectional size and shape of the post P. This way, any clearances between the post bracket PBtp and the post P can be reduced.

In the embodiment just described (using a 4×4 post P and 2×3 rails R), the tabs T1–T4 may project from each of the opposite sides of the post bracket PBtp in the range of between approximately 1" and 1.5". The bolts B may be 1/4" diameter and may have a length in the range of between approximately 2" and 2.5". The openings T1*o*–T4*o* in the tabs T1–T4, and the openings "spo" in the tabs of the rail brackets RB, should have approximately 5/16" diameter to accommodate the 1/4" bolts B. The rail brackets RB may have a length (measured from the curved edge to the opposite straight edge) in the range of between approximately 2" and 5". The post bracket PBtp may have a width measured across the upper part UP and the lower part LP (similar to W shown with regard to FIG. 11) that is in the range of between approximately 3.5" and 5", with 4" being preferred when PBow and PBoh are each approximately 3 9/16". The distance between the inner parallel surfaces of tabs T2 and T4, as well as between the inner parallel surfaces of tabs T1 and T3, should be in the range of between approximately 1 11/16" and 1¾". The width of the tabs T1–T4 should be in the range of between 1.5" to 3" depending on the width W of the post bracket PBtp. Preferably, the width of the tabs T1–T4 should be in the range of between approximately 25% to approximately 75% of the width W of the post bracket PBtp. The openings No (see FIGS. 52 and 53) of the post bracket PBtp and the openings "no" (see FIG. 6) of the rail brackets RB can be between approximately 1/16" to approximately 3/16" diameter or more to receive fasteners such as nails or screws, and may be counter-sunk or counter-bored, if desired. Integrally formed barbs similar to those used in the embodiment of FIGS. 58*a–b* can also be used on the rail brackets RB and the post bracket PBtp.

Figure 52:
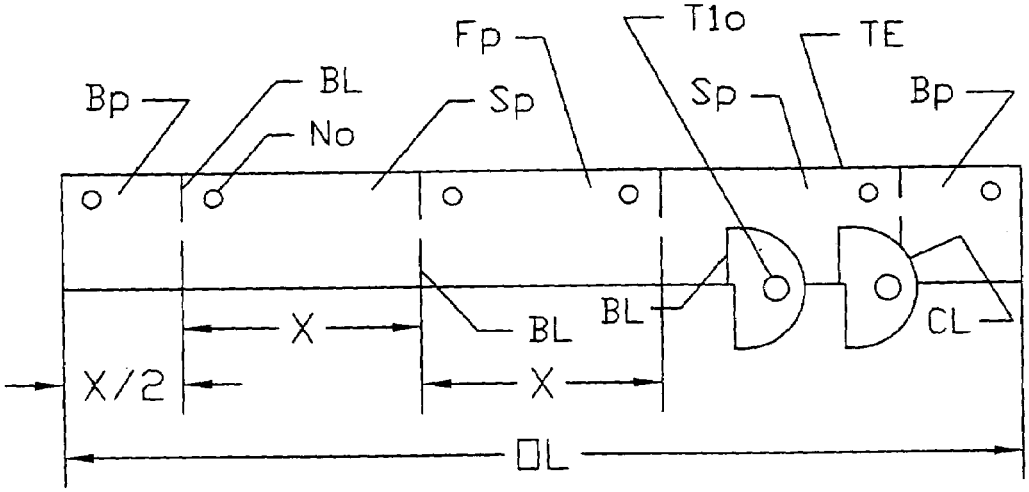
FIG. 52 shows a stock sheet metal part which will form the top part of the post bracket shown in FIGS. 51*a–b*. The figure illustrates the relative shape and size of the sheet metal part as well as the approximate relative position of the holes, bend-lines, and cut-lines.

FIG. 52 illustrates the layout of a piece of sheet metal which can be used to form the upper part UP of post bracket PBtp. The various features are not drawn to scale. However, the general arrangement or positions of the bend lines, holes and cut lines are shown to illustrate their general locations. The sheet metal piece has a generally rectangular shape with an upper or top edge TE and a lower or bottom edge from which tabs T1 and T3 extend. To form the upper part UP of the generally square shaped bracket PBtp shown in FIG. 51*a-b*, the sheet metal piece has five sections which are defined by four bend lines BL that extend from edge TE to the bottom edge. The location of the tabs T1 and T3 generally correspond to their position shown in FIG. 11 so that tabs T1 and T3 can be centered on right side wall of post bracket PBtp. Tabs T2 and T4 are not formed as part of the sheet metal piece that will form the upper part UP. Otherwise, the upper part UP of the post bracket PBtp can be formed in a manner similar to that described above with regard to FIGS. 3–5.

Figure 53:
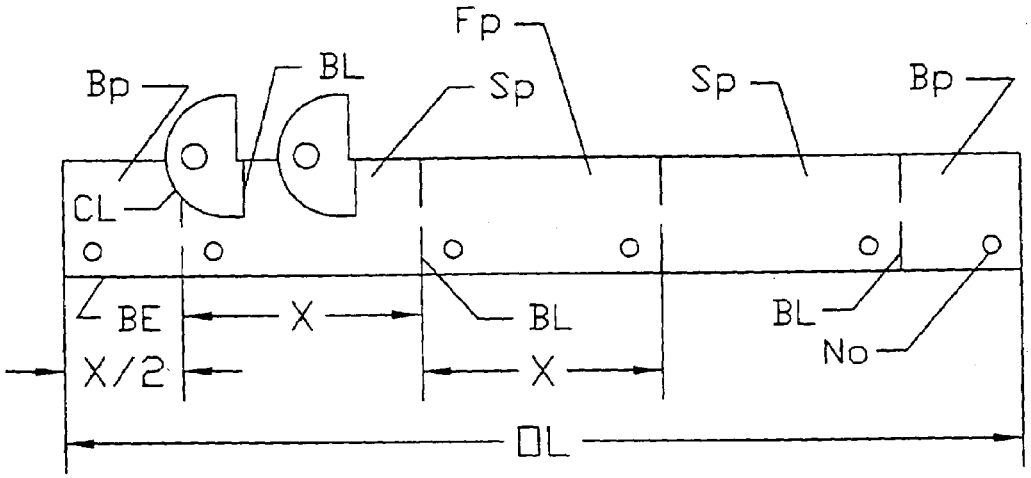
FIG. 53 shows a stock sheet metal part which will form the bottom part of the post bracket shown in FIGS. 51*a–b*. The figure illustrates the relative shape and size of the sheet metal part as well as the approximate relative position of the holes, bend-lines, and cut-lines.

FIG. 53 illustrates the layout of a piece of sheet metal which can be used to form the lower part LP of post bracket PBtp. The various features are not drawn to scale. However, the general arrangement or positions of the bend lines, holes and cut lines are shown to illustrate their general locations. The sheet metal piece has a generally rectangular shape with an upper or top edge and a lower or bottom edge BE. Tabs T2 and T4 extend from the top edge. To form the lower part LP of the generally square shaped bracket PBtp shown in FIG. 51*a-b*, the sheet metal piece has five sections which are defined by four bend lines BL that extend from top edge to the bottom edge BE. The location of the tabs T2 and T4 generally correspond to their position shown in FIG. 11 so that tabs T2 and T4 can be centered on left side wall of post bracket PBtp. Tabs T1 and T3 are not formed as part of the sheet metal piece that will form the lower part LP. Otherwise, the lower part LP of the post bracket PBtp can be formed in a manner similar to that described above with regard to FIGS. 3–5.

In forming the two-piece post bracket PBtp shown in FIGS. 51*a*–b, any number of desired and cost-effective methods and devices can be used. The state of the art in sheet metal fabrication includes devices which can form the openings No and T1*o*–T4*o*, and cut-lines CL by punching, water-jet cutting, laser cutting, plasma cutting, etc. Today's equipment also includes manual cutting and bending devices, in addition to Computer Numerical Control (CNC) punch presses, as well as CNC plasma and laser cutters. One inexpensive way of forming the post bracket shown in FIGS. 51*a-b*, is to use a punch press to form the plates shown in FIGS. 52 and 53 with the holes No and T1*o*–T4*o*, and cut-lines CL being cut in the punch press. One or more secondary operations can then be used to form the bends resulting in the two-piece post bracket shown in FIG. 51*a-b*. It is desirable to make the post bracket PBtp as cheaply as possible, since a typical fence may require dozens of post brackets PBtp, yet strength and ease of use should not be sacrificed to a significant extent. Accordingly, it is believed that forming the post brackets PBtp from a two pieces of sheet metal piece can satisfy these requirements. Of course, an alternative way of forming the bracket shown in FIG. 51*a-b*, can be by molding, casting or extrusion, whether the post bracket PBtp is to be made of metal or plastic, or even plastic coated metal. For example, today's equipment can extrude each of the upper part UP and the lower part LP so that they will have the assembled shape shown in FIG. 51*a*, with or without the gap "g". Thereafter, the tabs T1–T4 and holes No and T1*o*–T4*o* can be formed or shaped with cutting devices by milling, shaping, cutting, punching, and drilling, etc. Finally, it should be apparent that this bracket system embodiment is certainly capable of assuming the configuration shown in e.g., FIG. 64, because each of the lower part LP and the upper part UP can be oriented plus or minus 90 degrees relative to the other.

Figure 55:
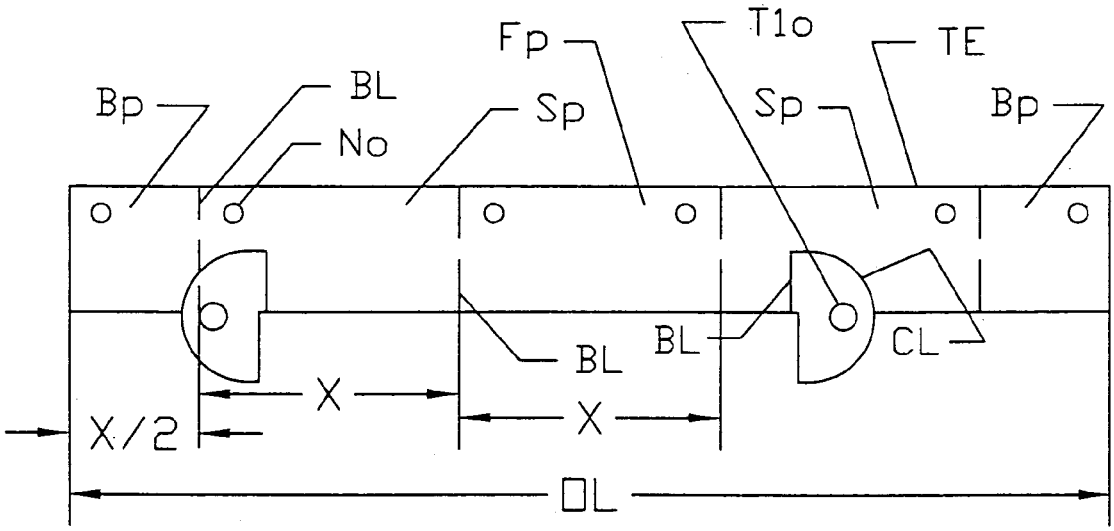
FIG. 55 shows a stock sheet metal part which will form another embodiment (not shown) of a top part of the post bracket used in another two-piece post bracket embodiment. The figure illustrates the relative shape and size of the sheet metal part as well as the approximate relative position of the holes, bend-lines, and cut-lines.

FIG. 55 illustrates the layout of a piece of sheet metal which can be used to form the upper part UP of post bracket PBtp. The various features are not drawn to scale. However, the general arrangement or positions of the bend lines, holes and cut lines are shown to illustrate their general locations. The sheet metal piece has a generally rectangular shape with an upper or top edge TE and a lower or bottom edge from which tabs T4 and T1 extend. To form the upper part UP of the generally square shaped bracket PBtp similar to the one shown in FIG. 51*a-b*, the sheet metal piece has five sections which are defined by four bend lines BL that extend from edge TE to the bottom edge. The location of the tabs T4 and T1 generally correspond to their position shown in FIG. 11 so that tabs T4 and T1 can be centered on respective right and left side walls of post bracket PBtp. Tabs T2 and T3 are not formed as part of the sheet metal piece that will form the upper part UP. Otherwise, the upper part UP of the post bracket PBtp can be formed in a manner similar to that described above with regard to FIGS. 3–5.

Figure 56:
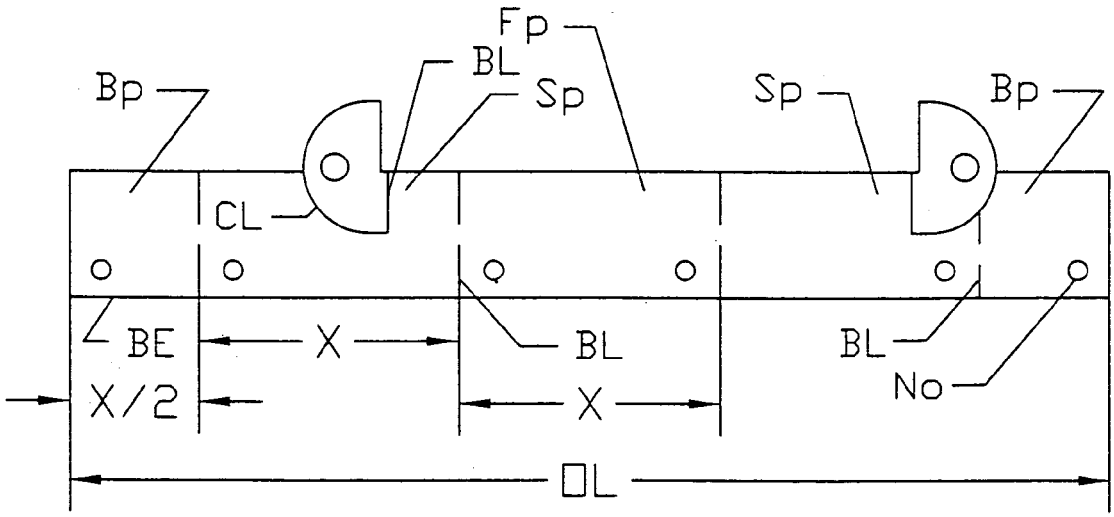
FIG. 56 shows a stock sheet metal part which will form the bottom part of the post bracket used in the two-piece post bracket embodiment described in FIG. 55. The figure illustrates the relative shape and size of the sheet metal part as well as the approximate relative position of the holes, bend-lines, and cut-lines.
Figure 57:
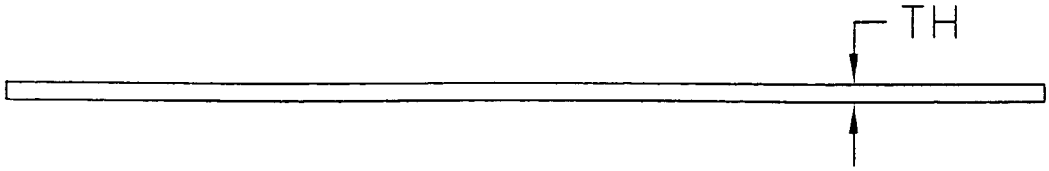
FIG. 57 shows a side view of each of the stock sheet metal parts shown in FIGS. 55 and 56.

FIG. 56 illustrates the layout of a piece of sheet metal which can be used to form the lower part LP of post bracket PBtp. The various features are not drawn to scale. However, the general arrangement or positions of the bend lines, holes and cut lines are shown to illustrate their general locations. The sheet metal piece has a generally rectangular shape with an upper or top edge and a lower or bottom edge BE. Tabs T2 and T3 extend from the top edge. To form the lower part LP of the generally square shaped bracket PBtp similar to the one shown in FIG. 51*a-b*, the sheet metal piece has five sections which are defined by four bend lines BL that extend from edge to the bottom edge BE. The location of the tabs T2 and T3 generally correspond to their position shown in FIG. 11 so that tabs T2 and T3 can be centered respectively on left and right side walls of post bracket PBtp. Tabs T4 and T1 are not formed as part of the sheet metal piece that will form the lower part LP. Otherwise, the lower part LP of the post bracket PBtp can be formed in a manner similar to that described above with regard to FIGS. 3–5.

Figure 58A:
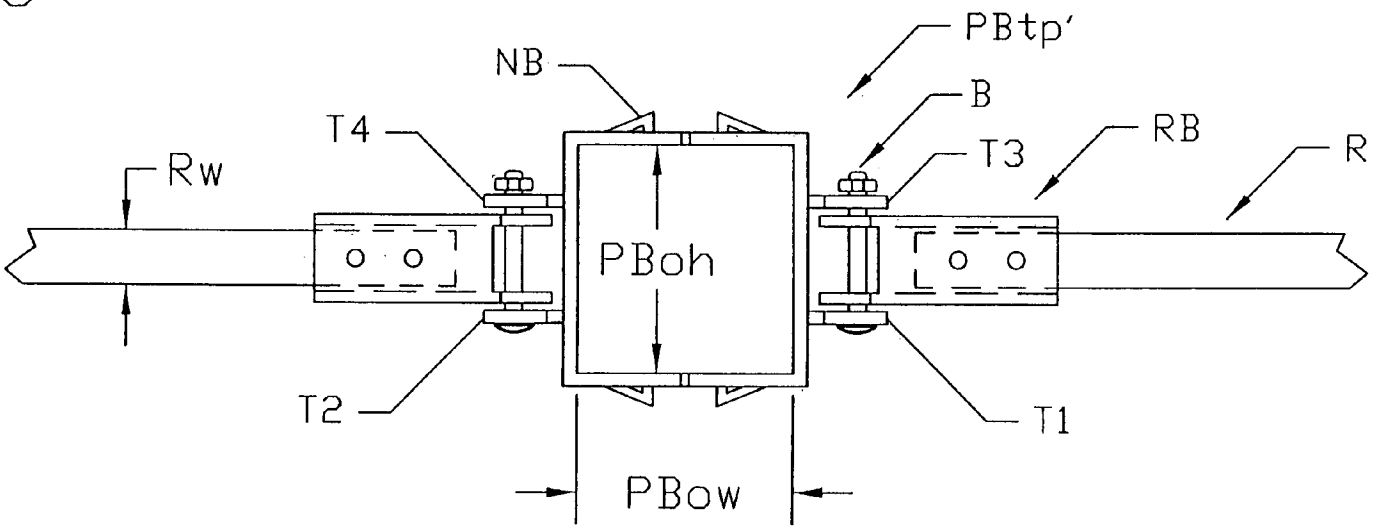
FIG. 58*a* shows a top view of still another embodiment of the bracket system of the invention. The post bracket in this embodiment is similar to the one shown in FIG. 13 except that it is of a two piece design and except that it has integrally formed nailing tongues or barbs and a locking system. The rails are shown installed in the rail brackets, but the fence post is not shown installed in the post bracket. The fasteners which would secure the rail brackets to the rails are not shown, but the openings that would receive the fasteners are shown.

FIG. 58*a* shows a top view of still another embodiment of the bracket system of the invention. The post bracket PBtp' in this embodiment is similar to the one shown in FIG. 13 except that it is of another two piece design. The rails R are shown installed in the rail brackets RB, but the fence post P is not shown installed in the post bracket PBtp'. The fasteners which would secure the rail brackets RB to the rails R are not shown, but the openings "no" that would receive the fasteners are shown. The bracket system uses two-piece post bracket PBtp' that has a square-shaped opening that is sized and shaped to slide over a fence post P (not shown). In this case, the fence post would have a 4×4 cross-sectional square shape, which means that the square shaped opening defined by the post bracket PBtb' is slightly larger than 3.5 inches by 3.5 inches. It is preferred that the square shaped opening of the post bracket PBtp' be approximately 1/16 inches larger, i.e., the opening should have the following dimensions, PBow=3 9/16 inches and PBoh=3 9/16 inches. In this way, the post bracket PBtp' can slide up and down on the post P until it is secured thereto by fasteners such as, e.g., nails and screws (not shown) as well as barbs NB. The post bracket PBtp' can be made in any desired way and can be made of any desired material such as plastic or metal. However, it is preferred that it be made of sheet metal and specifically galvanized sheet metal. Each of the two parts of post bracket PBtp' should also be made thin, but not so thin that strength is sacrificed to a significant extent. In this regard, it is preferred that the post bracket PBtp' have a thickness in the range of approximately 1/32 inches to approximately 1/8 inches or more depending on the size of the fence. A particular preferred material and thickness is in the range of between 22 gage and 11 gage, with 12 gage (approximately 1/10" thick) galvanized sheet metal being preferred. Of course, the post bracket PBtp' can also be made of plastic and formed as unitary structures which when assembled have a shape that resembles that of FIG. 58*a*, but without gap "g", i.e., each part can be cast, molded or extruded as in the embodiment shown in FIGS. 66*a–b*, but have the shape shown in FIG. 58*a* and with or without the gap "g".

Figure 58B:
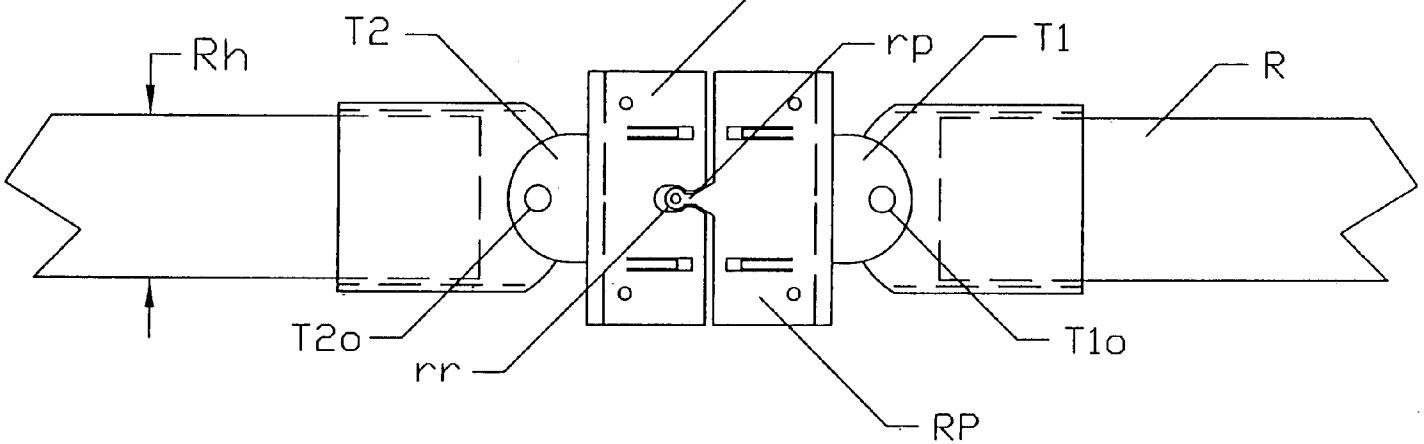
FIG. 58*b* shows a side view of the embodiment shown in FIG. 58*a*, except that the bolts securing the rail brackets to the post bracket have been removed. The two-piece post bracket has a left-side part and a right-side part.

Again, with reference to FIGS. 58*a–b*, the post bracket PBtp' has a left side projecting portion and a right side projecting portion. The left side projecting portion includes two tabs T2 and T4 which are formed on the left side part LP of the post bracket PBtp'. The right side projecting portion includes two tabs T1 and T3 which are formed on the right side part RP of the post bracket PBtp'. Each of these tabs T1–T4 are formed from a portion of the sheet material that is bent outwards. Thus, they have a thickness that is the same as the thickness of the remaining part of the post bracket PBtp'. As can be seen in FIG. 58*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts to withstand environmental conditions. It is also preferred that galvanized nuts be used with the bolts B.

A left side rail bracket RB of the type shown in FIGS. 6–9 is connected to the tabs T2 and T4 of the post bracket PBtp' via the bolt B. Similarly, a right side rail bracket RB of the type shown in FIGS. 6–9 is connected to the tabs T1 and T3 of the post bracket PBtp' via the other bolt B. Each rail bracket RB has one end that receives therein an end of a rail R and another end that connects to the post bracket PBtp'. In this regard, each rail bracket RB has two tabs which each have an opening that receives the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB can slide over the end of each rail R until it is secured thereto by fasteners such as, e.g., nails, barbs or screws (not shown). The two rail brackets RB are essentially identical to each other and can be fabricated in any desired way. They can also be made of any desired material such as plastic or metal. However, it is preferred that they be made of sheet metal and specifically galvanized sheet metal of the same type as that used to make the post bracket PBtp'. The rail bracket RB should thus be made thin, but not so thin that strength is sacrificed to a significant extent. In this regard, it is preferred that each rail bracket RB have a thickness "th" (see FIG. 7) in the range of approximately 1/32 inches to approximately 1/8 or more inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure as described above. Spacers of the type shown in FIG. 65*a* can also be used in this embodiment.

In FIG. 58*b*, the bolts B have been removed to illustrate the position of the respective openings T1*o* and T2*o* of the tabs T1 and T2. However, it should be apparent that opening T2*o* of tab T2 is aligned with the opening T4*o* (not shown) of tab T4 and with the two openings in the left-side rail bracket RB. This is evident in FIG. 58*a* where it is apparent that the bolt B passes through these four openings. Similarly, the two respective openings of the tabs T1 and T3 are aligned with the two openings formed in the right side rail bracket RB so that the bolt B can pass through these four openings. Moreover, in this embodiment tabs T1–T4 are centrally arranged on the left and right walls of the post bracket PBtp'. As a result, tabs T1 and T2 are arranged to be generally centered with respect to inner and outer walls of post bracket PBtp'. Both the inner wall and the outer wall of post bracket PBtp' includes the two edges of the post bracket PBtp' with a space being provided between these two edges. This space is defined by gap "g" and results from the fact that the parts LP and RP of post bracket PBtp' are each bent from a one piece sheet metal blank. The gaps "g" should be made as small as possible, preferably in the range of between approximately 1/16" and 1/4". The gap "g" can also serve an important purpose in that it allows for a variation in dimension PBow to account for any variations in the cross-sectional size and shape of the post P. This way, any clearances between the post bracket PBtp' and the post P can be reduced. To ensure that the left part LP is securely connected to the right part RP, two locking recesses "rr" are provided on the left part LP and two locking projections "rp'are provided on the right part RP. The locking recesses "rr" have the form of a slot and each includes an narrowing which prevents a circular end of the projection "rp" from sliding out of the recess "rr". The projections "rp" each have an opening which allows a fastener to secure the projection "rp" to the post P which also prevents the projection "rp" from deflecting out of the recess "rr".

In the embodiment just described (using a 4×4 post P and 2×3 rails R), the tabs T1–T4 may project from each of the opposite sides of the post bracket PBtp' in the range of between approximately 1" and 1.5". The bolts B may be 1/4" diameter and may have a length in the range of between approximately 2" and 2.5". The openings T1*o*–T4*o* in the tabs T1–T4, and the openings "spo" in the tabs of the rail brackets RB, should have approximately 5/16" diameter to accommodate the 1/4" bolts B. The rail brackets RB may have a length (measured from the curved edge to the opposite straight edge) in the range of between approximately 2" and 5". The post bracket PBtp' may have a width measured across edges TE and BE (see FIGS. 59–60) that is in the range of between approximately 3.5" and 5", with 4" being preferred when PBow and PBoh are each approximately 3 9/16". The distance between the inner parallel surfaces of tabs T2 and T4, as well as between the inner parallel surfaces of tabs T1 and T3, should be in the range of between approximately 1 11/16" and 1¾". The width of the tabs T1–T4 should be in the range of between 1.5" to 3" depending on the width W of the post bracket PBtp'. Preferably, the width of the tabs T1–T4 should be in the range of between approximately 25% to approximately 75% of the width W of the post bracket PBtp'. The openings No (see FIGS. 59 and 60) of the post bracket PBtp' and the openings "no" (see FIG. 6) of the rail brackets RB can be between approximately 1/16" to approximately 3/16" diameter or more to receive fasteners such as nails or screws, and may be counter-sunk or counter-bored, if desired. Integrally formed barbs NB can also be used on the rail brackets RB, in addition to being used on the post bracket PBtp'.

Figure 59:
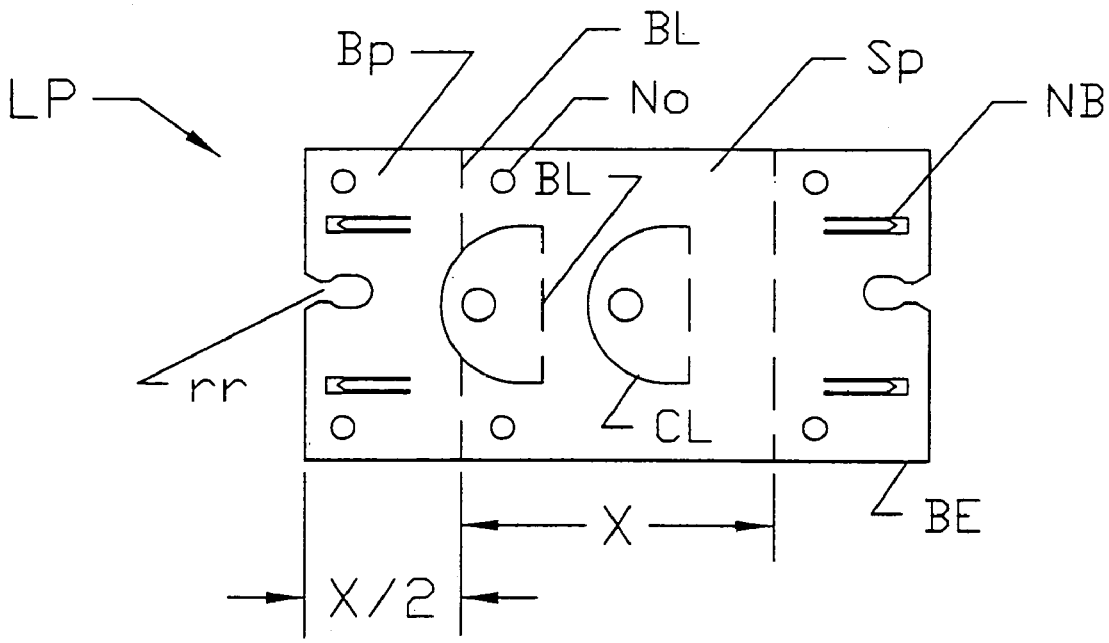
FIG. 59 shows a stock sheet metal part which will form the left-side part of the post bracket shown in FIGS. 58*a–b* The figure illustrates the relative shape and size of the sheet metal part as well as the approximate relative position of the recesses, holes, bend-lines, and cut-lines.

FIG. 59 illustrates the layout of a piece of sheet metal which can be used to form the left part LP of post bracket PBtp'. The various features are not drawn to scale. However, the general arrangement or positions of the bend lines, holes, barbs and cut lines are shown to illustrate their general locations. The sheet metal piece has a generally rectangular shape with an upper or top edge TE and a lower or bottom edge BE. To form the left part LP of the generally square shaped bracket PBtp' shown in FIGS. 58*a*–*b*, the sheet metal piece has three sections which are defined by two bend lines BL that extend from edge TE to the bottom edge BE. The location of the tabs T2 and T4 generally correspond to their position shown in FIG. 11 so that tabs T2 and T4 can be centered on left side wall of post bracket PBtp'. Tabs T1 and T3 are not formed as part of the sheet metal piece that will form the left part LP. Recesses "rr" are also formed in the sheet metal piece. Otherwise, the left part LP of the post bracket PBtp' can be formed in a manner similar to that described above with regard to FIGS. 3–5.

Figure 60:
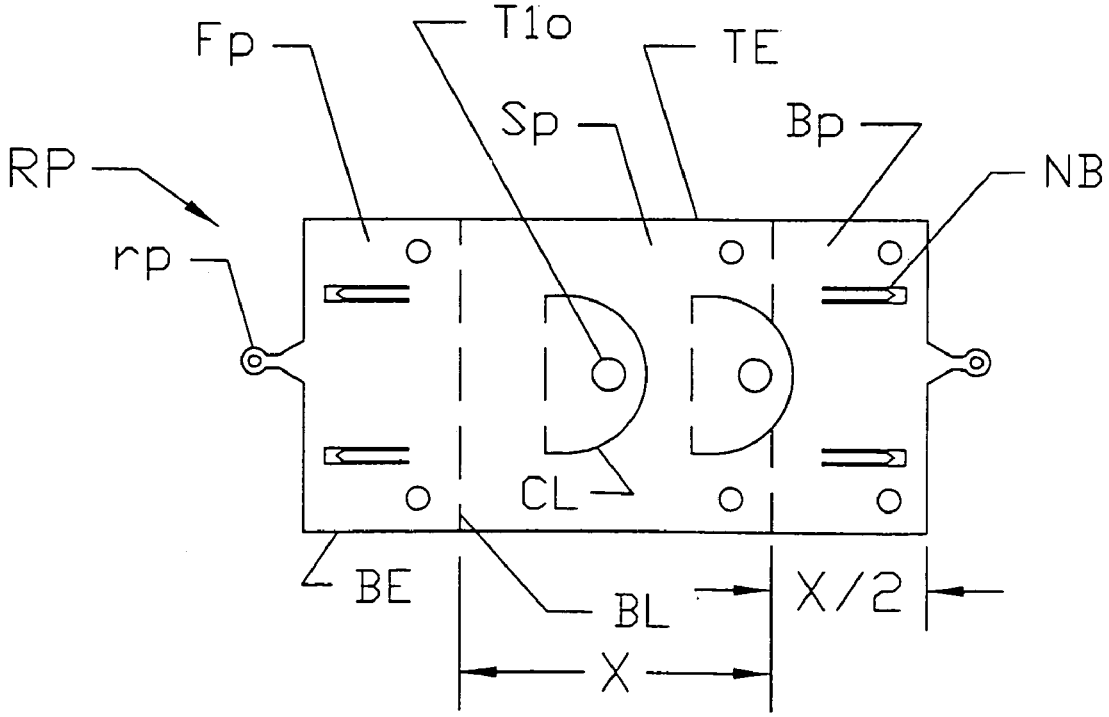
FIG. 60 shows a stock sheet metal part which will form the right-side part of the post bracket used in the embodiment shown in FIGS. 58*a–b* The figure illustrates the relative shape and size of the sheet metal part as well as the approximate relative position of the projections, holes, bend-lines, and cut-lines.

FIG. 60 illustrates the layout of a piece of sheet metal which can be used to form the right part RP of post bracket PBtp'. The various features are not drawn to scale. However, the general arrangement or positions of the bend lines, holes, barbs and cut lines are shown to illustrate their general locations. The sheet metal piece has a generally rectangular shape with an upper or top edge TE and a lower or bottom edge BE. To form the right part RP of the generally square shaped bracket PBtp' shown in FIGS. 58*a*–*b*, the sheet metal piece has three sections which are defined by two bend lines BL that extend from edge TE to the bottom edge BE. The location of the tabs T1 and T3 generally correspond to their position shown in FIG. 11 so that tabs T1 and T3 can be centered on right side wall of post bracket PBtp'. Tabs T2 and T4 are not formed as part of the sheet metal piece that will form the right part RP. Projections "rp" are also formed in the sheet metal piece. Otherwise, the right part RP of the post bracket PBtp' can be formed in a manner similar to that described above with regard to FIGS. 3–5.

In forming the two-piece post bracket PBtp' shown in FIGS. 58*a*–*b*, any number of desired and cost-effective methods and devices can be used. The state of the art in sheet metal fabrication includes devices which can form the openings No, "rr" and T1*o*–T4*o*, and cut-lines CL by punching, water-jet cutting, laser cutting, plasma cutting, etc. Today's equipment also includes manual cutting and bending devices, in addition to Computer Numerical Control (CNC) punch presses, as well as CNC plasma and laser cutters. One inexpensive way of forming the post bracket shown in FIGS. 58*a*–*b*, is to use a punch press to form the plates shown in FIGS. 59 and 60 with the holes "rr" No and T1*o*–T4*o*, barbs NO and cut-lines CL being cut in the punch press. One or more secondary operations can then be used to form the bends resulting in the two-piece post bracket shown in FIGS. 58*a*–*b*. It is desirable to make the post bracket PBtp' as cheaply as possible, since a typical fence may require dozens of post brackets PBtp', yet strength and ease of use should not be sacrificed to a significant extent. Accordingly, it is believed that forming the post brackets PBtp' from a two pieces of sheet metal piece can satisfy these requirements. Of course, an alternative way of forming the bracket shown in FIGS. 58*a*–*b*, can be by molding, casting or extrusion, whether the post bracket PBtp' is to be made of metal or plastic, or even plastic coated metal. For example, today's equipment can extrude each of the left part LP and the right part RP so that they will have the assembled shape shown in FIG. 58*a*, with or without the gap "g". Thereafter, the tabs T1–T4, barbs NO and holes No and T1*o*–T4*o* can be formed or shaped with cutting devices by milling, shaping, cutting, punching, and drilling, etc.

FIG. 61 shows a stock sheet metal part which will form a third embodiment rail bracket RB" which can be used in place of the first embodiment RB. The figure illustrates the relative shape and size of the sheet metal part as well as the position of the holes and bend-lines. This embodiment differs from the one shown in FIGS. 6–9, in that it is longer, e.g., "w" is 1" and 2" longer to accommodate an accordion section AS. The accordion section AS allows the rail bracket RB" to deflect of flex laterally or up and down thereby rendering it flexible. Otherwise, the rail bracket RB" (see FIG. 63) can be made in a manner similar to the one shown in FIGS. 6–9.

FIG. 62 shows a side view of the stock sheet metal part shown in FIG. 61 which can be the same as that of FIG. 7.

FIGS. 63*a*. 63*b*, and 63*c* show top, side and bottom cross-sectional side views of the third embodiment rail bracket RB" that can be made from the sheet stock shown in FIG. 61. The rail bracket RB" is formed with an accordion type section AS that allows the rail bracket RB" to be bent or deflected both laterally or up and down. The formed rail bracket RB" has been pierced with holes, formed with the accordion section AS, and also bent along the bend-lines BL, and can be made in a manner similar to that described above with regard to FIGS. 6–9*c*.

Figure 64:
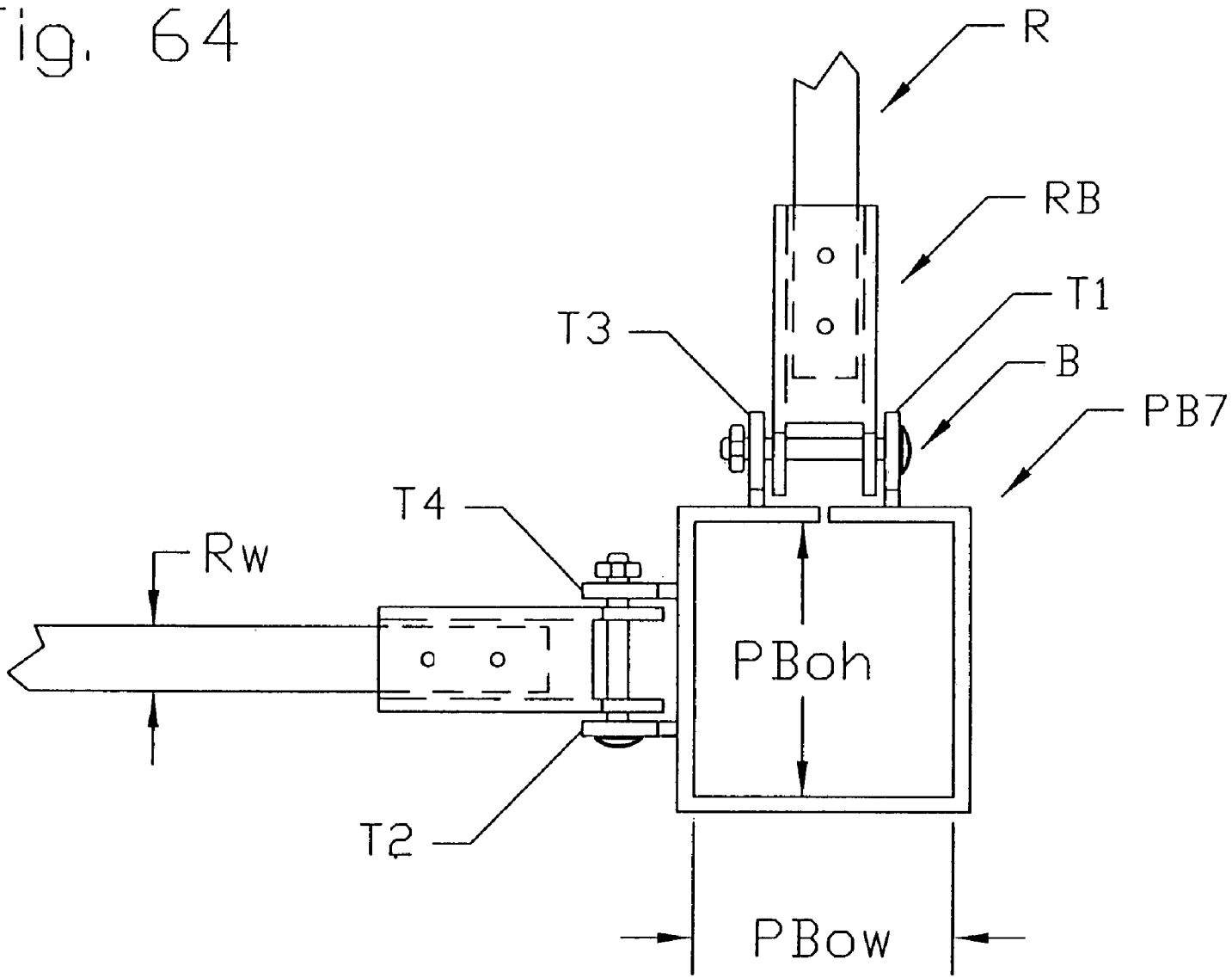
FIG. 64 shows a top view of still another embodiment of the bracket system of the invention. The post bracket in this embodiment is similar to the one shown in FIG. 10*a* except that the right side oppositely arranged tabs are instead arranged to extend from a rear wall of the post bracket. The rails are shown installed in the rail brackets, but the fence post is not shown installed in the post bracket. The fasteners which would secure the rail brackets to the rails are not shown, but the openings that would receive the fasteners are shown.

FIG. 64 shows a top view of still another embodiment of the bracket system of the invention. The post bracket PB7 in this embodiment is similar to the one shown in FIG. 10*a* except that the right side oppositely arranged tabs T1 and T3 are arranged to extend from a rear wall of the post bracket PB7. The rails R are shown installed in the rail brackets RB, but the fence post P is not shown installed in the post bracket PB7. The fasteners or barbs which would secure the rail brackets RB to the rails R are not shown, but the openings "no" that would receive the fasteners are shown. Except for the location of tabs T1 and T3, the post bracket PB7 can be made in a manner similar to that described above with regard to, e.g., FIGS. 10–11. Spacers of the type shown in FIG. 65*a* can also be used in this embodiment.

Figure 65A:
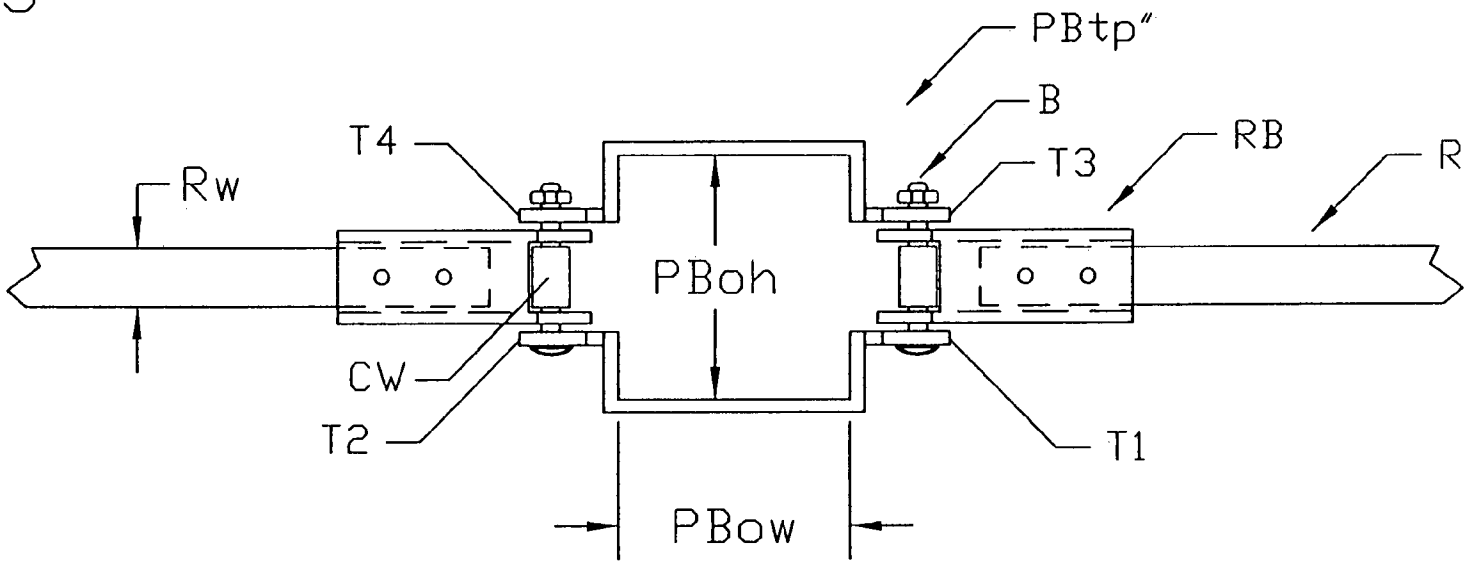
FIG. 65*a* shows a top view of still another embodiment of the bracket system of the invention. The post bracket in this embodiment is similar to the one shown in FIG. 10*a* except that it is of a two piece design. Spacers are used to maintain a distance between the tabs. The rails are shown installed in the rail brackets, but the fence post is not shown installed in the post bracket. The fasteners which would secure the rail brackets to the rails are not shown, but the openings that would receive the fasteners are shown.

FIG. 65*a* shows a top view of still another embodiment of the bracket system of the invention. The post bracket PBtp" in this embodiment is similar to the one shown in FIG. 10*a* except that it is of a two piece design. Spacers CW are used to maintain a distance between the tabs T2 and T4 and between tabs T1 and T3. The rails are shown installed in the rail brackets RB, but the fence post P is not shown installed in the post bracket PBtp". The fasteners which would secure the rail brackets RB to the rails R are not shown, but the openings that would receive the fasteners are shown. Except for the fact that the post bracket is of a two-piece design, the post bracket PBtb" can be made in a manner similar to that described above with regard to, e.g., FIGS. 10–11.

Figure 65B:
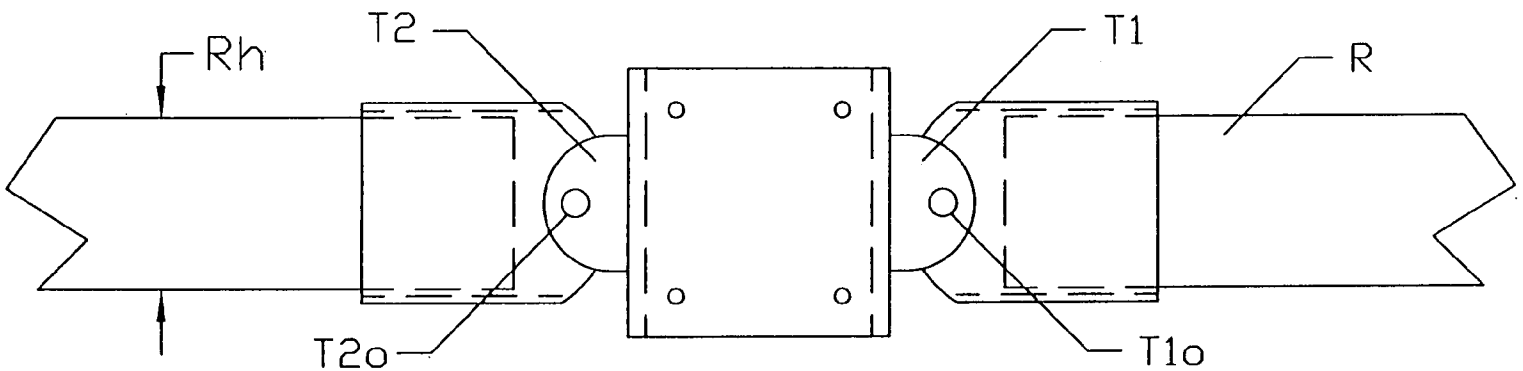
FIG. 65*b* shows a side view of the embodiment shown in FIG. 65*a*, except that the bolts securing the rail brackets to the post bracket have been removed. The two-piece post bracket has a rear-side part and a front-side part.

FIG. 65*b* shows a side view of the embodiment shown in FIG. 65*a*, except that the bolts B securing the rail brackets RB to the post bracket PBtp" have been removed. The two-piece post bracket PBtp" has a rear-side part and a front-side part. The post bracket PBtp" has a left side projecting portion and a right side projecting portion. The left side projecting portion includes two tabs T2 and T4 which are each formed on front and rear parts of the post bracket PBtp". The right side projecting portion includes two tabs T1 and T3 which each are formed on front and rear parts of the post bracket PBtp". Each of these tabs T1–T4 are formed from a portion of the sheet material that is bent outwards. Thus, they have a thickness that is the same as the thickness of the remaining part of the post bracket PBtp". As can be seen in FIG. 58*b*, each tab T1–T4 also includes an opening, e.g., tabs T1 and T2 have openings T1*o* and T2*o*. The openings of left-side tabs T2 and T4 receive a fastener or bolt B. Similarly, the openings of right-side tabs T1 and T3 receive another fastener or bolt B. The bolts B may be of any desired type. However, it is preferred that they be galvanized threaded metal bolts to withstand environmental conditions. It is also preferred that galvanized nuts be used with the bolts B.

A left side rail bracket RB of the type shown in FIGS. 6–9 is connected to the tabs T2 and T4 of the post bracket PBtp" via the bolt B. Similarly, a right side rail bracket RB of the type shown in FIGS. 6–9 is connected to the tabs T1 and T3 of the post bracket PBtp" via the other bolt B. Each rail bracket RB has one end that receives therein an end of a rail R and another end that connects to the post bracket PBtp". In this regard, each rail bracket RB has two tabs which each have an opening that receives the bolt B. The rail brackets RB also have an internal rectangular opening that is sized and shaped to be similar to that of the rail R. In this case, the rectangular opening of each rail bracket RB is made slightly larger (i.e., 1/32" to 1/16" larger) than approximately 1.5 inches by 2.5 inches to accommodate a 2×3 rail R, i.e., a rail R that has a cross-sectional size of Rw=1.5" and Rh=2.5". In this way, each rail bracket RB can slide over the end of each rail R until it is secured thereto by fasteners such as, e.g., nails, barbs or screws (not shown). The two rail brackets RB are essentially identical to each other and can be fabricated in any desired way. They can also be made of any desired material such as plastic or metal. However, it is preferred that they be made of sheet metal and specifically galvanized sheet metal of the same type as that used to make the post bracket PBtp". The rail bracket RB should thus be made thin, but not so thin that strength is sacrificed to a significant extent. In this regard, it is preferred that each rail bracket RB have a thickness "th" (see FIG. 7) in the range of approximately 1/32 inches to approximately 1/8 or more inches depending on the size of the fence. A particular preferred material and thickness is in the range of between 22 gage and 11 gage, with 12 gage (approximately 1/10" thick) galvanized sheet metal being preferred. Of course, the rail brackets RB can also be made of plastic and formed as a unitary structure as described above. Spacers CW are used to maintain distance PBoh.

Figure 66A:
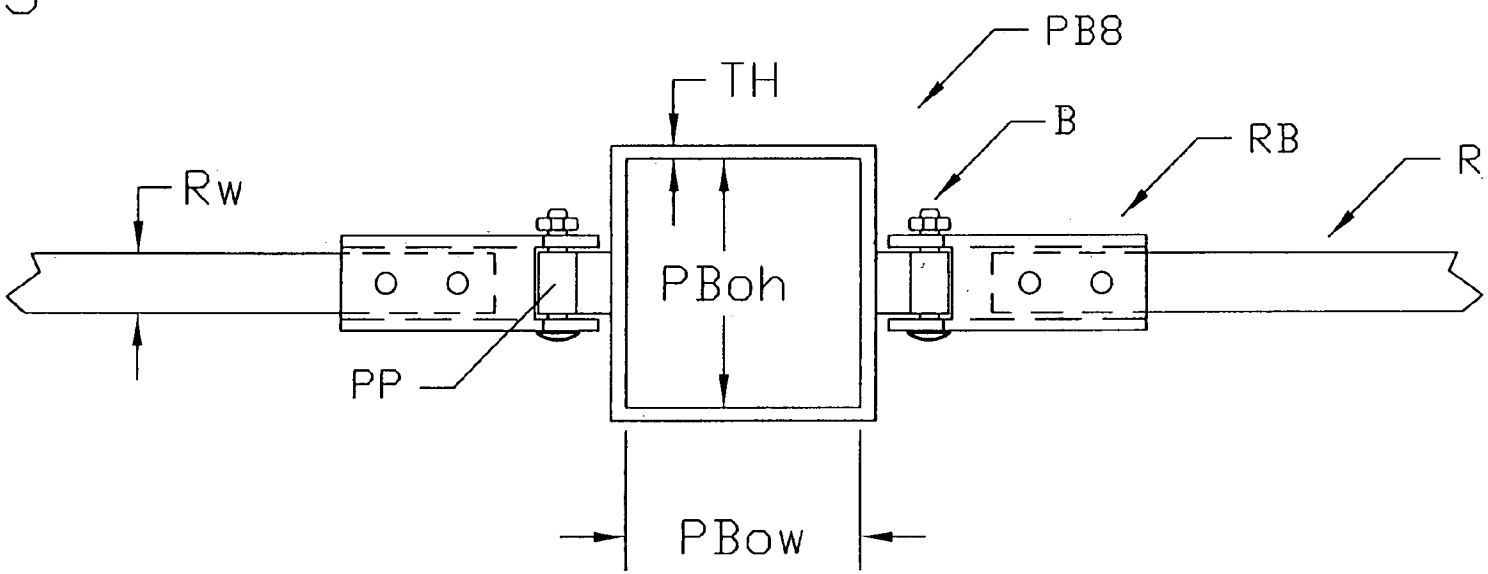
FIG. 66*a* shows a top view of still another embodiment of the bracket system of the invention. The post bracket in this embodiment is formed as a one piece structure by casting, extrusion or molding. The rails are shown installed in the rail brackets, but the fence post is not shown installed in the post bracket. The fasteners which would secure the rail brackets to the rails are not shown, but the openings that would receive the fasteners are shown.
Figure 66B:
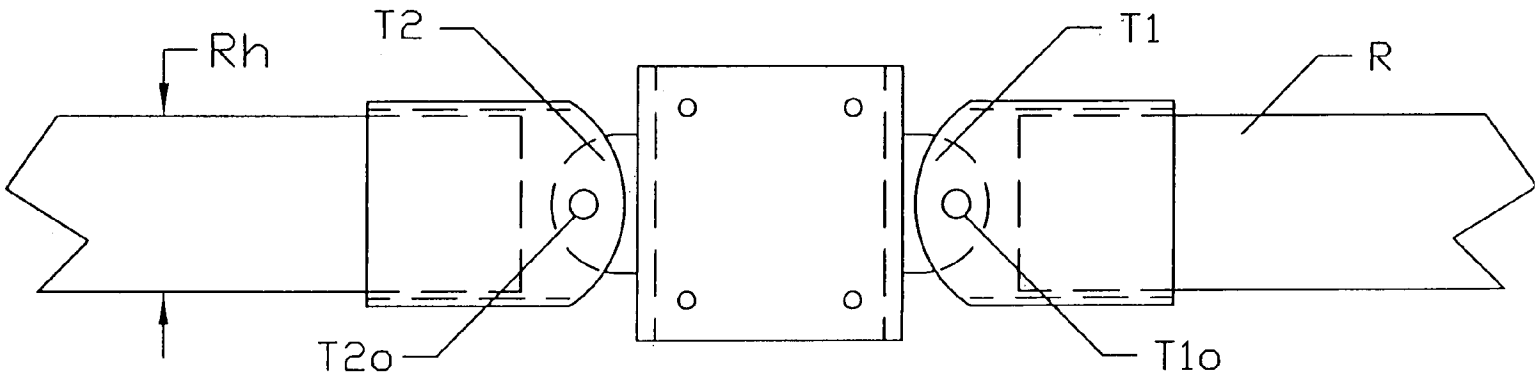
FIG. 66*b* shows a side view of the embodiment shown in FIG. 66*a*, except that the bolts securing the rail brackets to the post bracket have been removed.

FIG. 66*a* shows a top view of still another embodiment of the bracket system of the invention. The post bracket PB8 in this embodiment is formed as a one piece structure by casting, extrusion or molding. The rails R are shown installed in the rail brackets RB, but the fence post P is not shown installed in the post bracket PB8. The fasteners which would secure the rail brackets RB to the rails R are not shown, but the openings "no" that would receive the fasteners are shown. It is believed that forming the post bracket PB8 from one-piece, from e.g., metal or plastic, produces a post bracket PB8 which is inexpensive yet strong. The preferred way of forming the bracket shown in FIGS. 66*a*–*b*, is by molding, casting or extrusion, whether the post bracket PB8 is to be made of metal or plastic, or even plastic coated metal. For example, today's equipment can extrude substantially the post bracket shape shown in FIG. 66*a*. Thereafter, the integrally formed left and right side projections PP (each projection PP replacing the two tabs on each side shown in, e.g., FIG. 10*a*), holes No as well as the bolt holes formed in the projections PP (see FIG. 66*b*) can be shaped with cutting devices by milling, shaping, cutting, punching, and drilling, etc. This embodiment also has particular application an making a cast iron railing wherein the post bracket PB8 can be made relatively small by, e.g., casting.

FIG. 66*b* shows a side view of the embodiment shown in FIG. 66*a*, except that the bolts B securing the rail brackets RB to the post bracket PB8 have been removed.

Figure 67A:
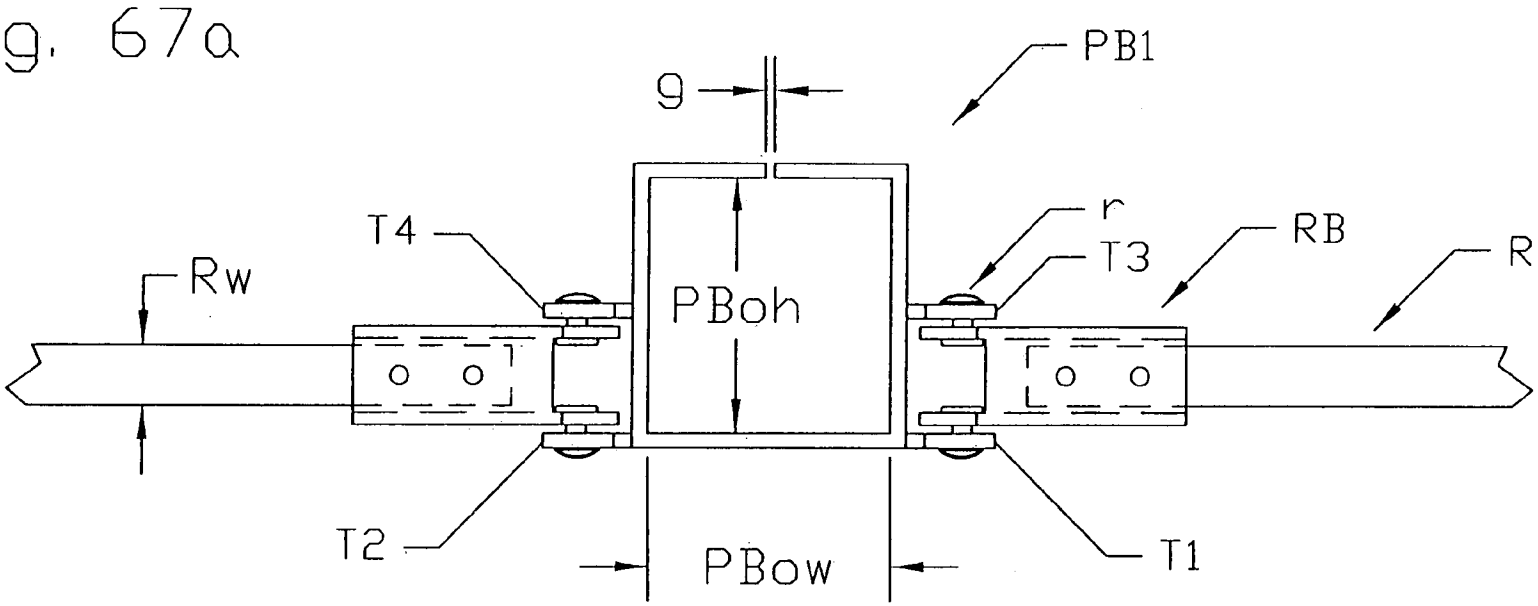
FIG. 67*a* shows a top view of still another embodiment of the bracket system of the invention. In this embodiment, the rail brackets are both permanently fixed and pivotally mounted to the post bracket via rivets. The rails are shown installed in the rail brackets, but the fence post is not shown installed in the post bracket. The fasteners which would secure the rail brackets to the rails are not shown, but the openings that would receive the fasteners are shown.

FIG. 67*a* shows a top view of still another embodiment of the bracket system of the invention. In this embodiment, the rail brackets RB of the type shown in FIGS. 6–9 are permanently fixed and pivotally mounted to the post bracket PB 1 of the type shown in FIGS. 2*a*–*b* via rivets "r". The rails R are shown installed in the rail brackets RB, but the fence post P is not shown installed in the post bracket PB1. The fasteners or barbs which would secure the rail brackets RB to the rails R are not shown, but the openings that would receive the fasteners are shown. Of course, the invention also contemplates the use of rivets "r" in place of bolts B in the embodiments shown in FIGS. 2*a*, 10*a*, 14*a*, 18*a*, 22, 26–29, 51*a*, 58*a*, 64, 65*a* and 66*a*.

Figure 67B:
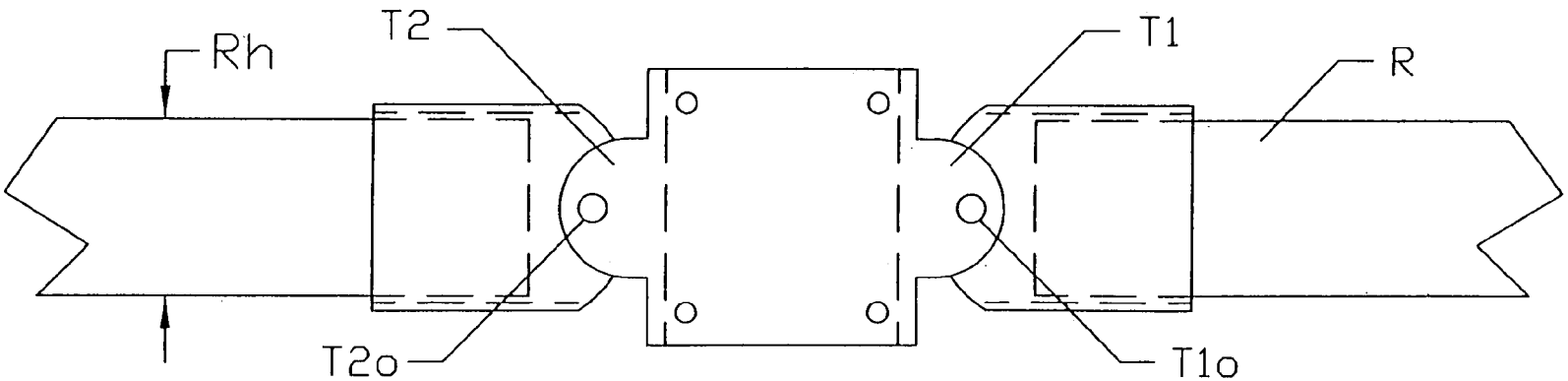
FIG. 67*b* shows a side view of the embodiment shown in FIG. 67*a*, except that the bolts securing the rail brackets to the post bracket have been removed.

FIG. 67*b* shows a side view of the embodiment shown in FIG. 67*a*, except that the rivets "r" securing the rail brackets RB to the post bracket PB1 have been removed to show the tab T1–T4 openings.

Figure 68A:
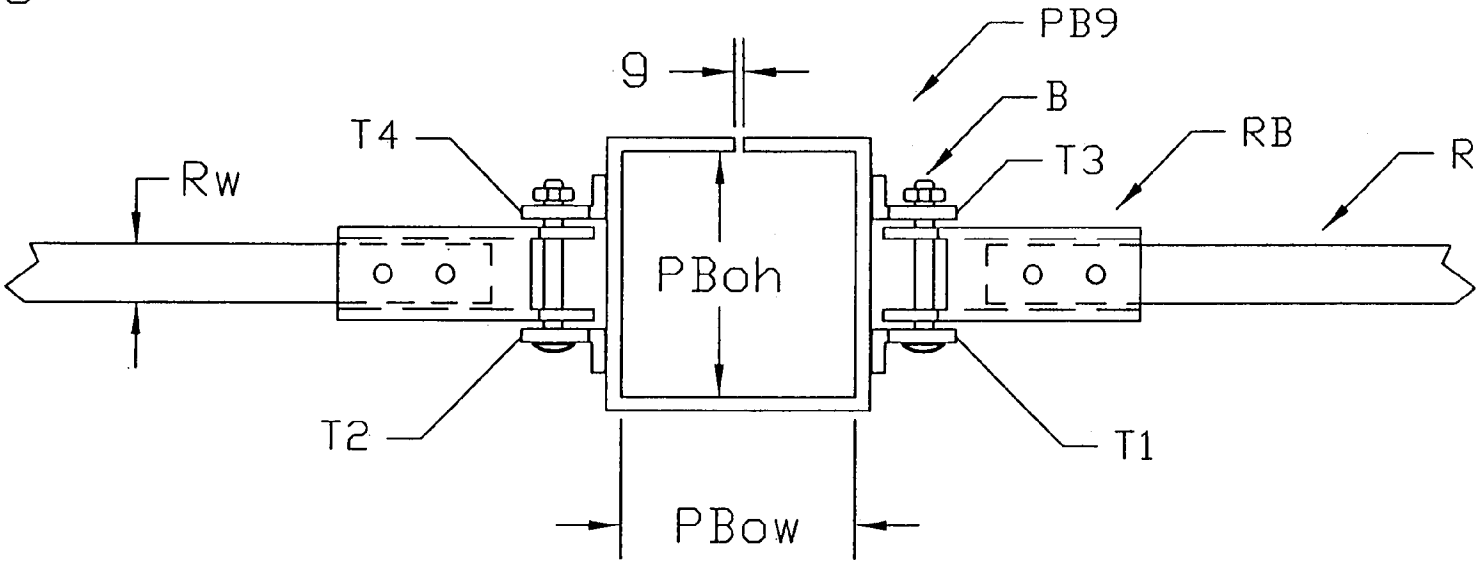
FIG. 68*a* shows a top view of still another embodiment of the bracket system of the invention. In this embodiment, the rail brackets are secured to the post bracket via bolts just like the embodiment shown in FIG. 10*a*. This embodiment differs from that of 10*a* in that the tabs are separately formed and then secured to the post bracket. The rails are shown installed in the rail brackets, but the fence post is not shown installed in the post bracket. The fasteners which would secure the rail brackets to the rails are not shown, but the openings that would receive the fasteners are shown.

FIG. 68*a* shows a top view of still another embodiment of the bracket system of the invention. In this embodiment, the rail brackets RB are secured to the post bracket PB9 via bolts B just like the embodiment shown in FIG. 10*a*. This embodiment differs from that of 10*a* in that the tabs T1–T4 are separately formed and then secured to the post bracket PB9 via, e.g., welding or rivets, with spot welding being preferred when the post bracket is to be made of sheet metal and with ultrasonic welding being preferred when it is to be made of plastic or synthetic resin. In this regard, each tab T1–T4 is bent to form an L-shape with the shorter length portion of the tabs T1–T4 being the part that gets welded to the post bracket PB9. The longer portion of the tabs T 1-T4 is otherwise made to resemble the tabs T1–T4 shown in FIG. 10*a*., i.e., they have the same width, they are spaced apart by the same amount, they have an opening that receives the bolt B, and they have a curved end. This bracket system embodiment is particularly useful in making larger fences or in making fences where additional strength may be required. The rails R are shown installed in the rail brackets RB, but the fence post P is not shown installed in the post bracket PB9. The fasteners which would secure the rail brackets to the rails are not shown, but the openings that would receive the fasteners are shown. Of course, the post bracket PB9 can also be made of sheet metal in the manner described with regard to, e.g., FIGS. 10–13 (with the exception that the tabs T1–T4 would not be cut and bent from the sheet blank shown in FIG. 11). Alternatively, it can be formed as a unitary structure having a shape that resembles that of FIG. 68*a*, with or without gap "g", i.e., it can be cast, molded or extruded as a one-piece member, but have the shape shown in FIG. 68*a* and with or without the gap "g". Thereafter, the tabs T1–T4 can be permanently attached thereto by, e.g., welding. As with the previous embodiments, spacers CW of the type shown in FIG. 65*a* can also be used in this embodiment, if desired.

Figure 68B:
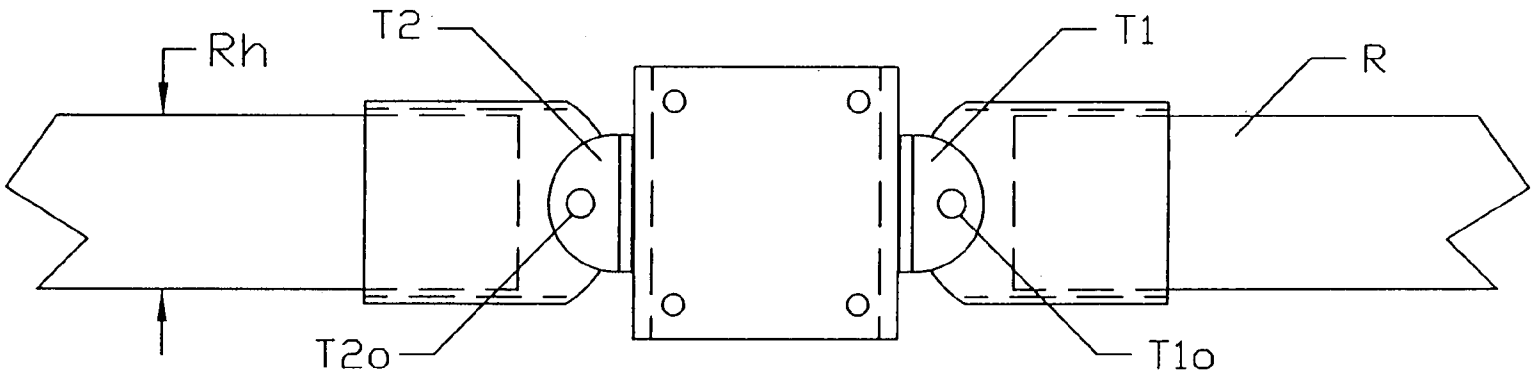
FIG. 68*b* shows a side view of the embodiment shown in FIG. 68*a*, except that the bolts securing the rail brackets to the post bracket have been removed.

FIG. 68*b* shows a side view of the embodiment shown in FIG. 68*a*, except that the bolts B securing the rail brackets RB to the post bracket PB9 have been removed. The rail brackets RP are of the type described with regard to FIGS. 6–9. However, the invention contemplates using any of the rail brackets, e.g., RB, RB', and RB" disclosed herein on this bracket system embodiment.

Figure 69:
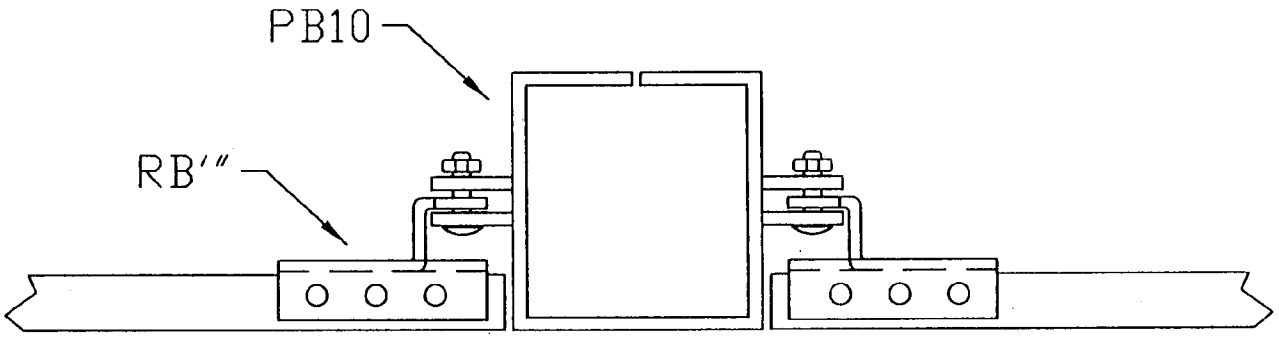
FIG. 69 shows a top view of still another embodiment of the bracket system of the invention. In this embodiment, fourth embodiment rail brackets are secured to a tenth embodiment post bracket via bolts. The rails are shown installed in the rail brackets, but the fence post is not shown installed in the post bracket. The fasteners which would secure the rail brackets to the rails are not shown, but the openings that would receive the fasteners are shown.

FIG. 69 shows a top view of still another embodiment of the bracket system of the invention. In this embodiment, fourth embodiment rail brackets RB'" are secured to a tenth embodiment post bracket PB10 via bolts B'. The rails R are shown installed in the rail brackets RB'", but the fence post P is not shown installed in the post bracket PB10. The fasteners which would secure the rail brackets RB'" to the rails R are not shown, but the openings that would receive the fasteners are shown. The post bracket PB10 can be made in a manner similar to that described with regard to FIG. 26, except that the position of the tabs T1–T4 are located in slightly different positions. Moreover, the spacing between tabs T2 and T4 as well as between T1 and T3 is lessened in this embodiment by the thickness "th" of the rail bracket RB'". The rail brackets RB'" in this embodiment are particularly useful in attaching a conventional fence section to the posts P. In such conventional fence sections the slats SL are attached to the rails R such that no part (i.e., the ends) of the rails R extend past the slats SL. As a result, it is not possible to slide the rail brackets RB, RB' and RB" over the ends of the rails R because the slats SL arranged at the ends of the fence section prevent it. However, using the rail bracket RB'" shown in FIG. 69, such a conventional fence section can be attached to the posts P by utilizing the post bracket PB10.

Figure 70:
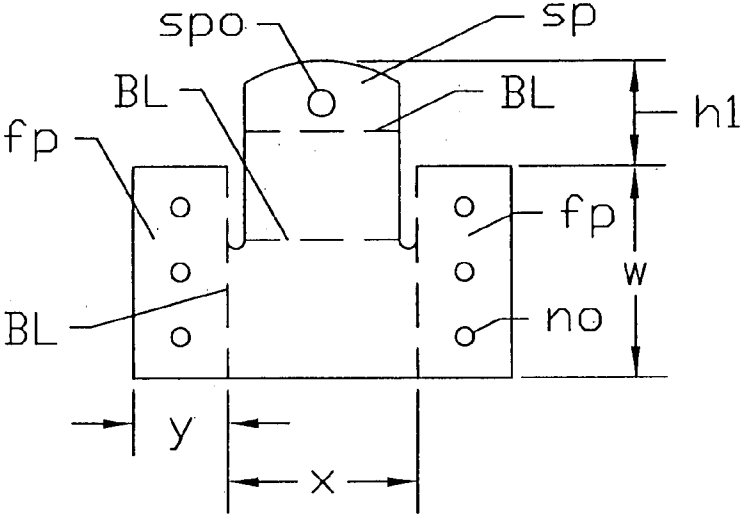
FIG. 70 shows a stock sheet metal part which will form the fourth embodiment rail bracket used in the bracket system shown in FIG. 69. The figure illustrates the relative shape and size of the sheet metal part as well as the approximate relative position of the holes, slots and bend-lines.

FIG. 70 shows a stock sheet metal part which will form the fourth embodiment rail bracket RB'" used in the bracket system shown in FIG. 69. The figure illustrates the relative shape and size of the sheet metal part as well as the approximate relative position of the holes "no" and "spo", slots and bend-lines BL. The various features are not drawn to scale. However, the general arrangement or positions of the bend lines and holes are shown to illustrate their general locations. The sheet metal piece has a generally rectangular shape with an upper or top edge from which one tab portion extends and a lower or bottom edge. To form the generally rectangular shaped rail bracket RB'" shown in FIG. 69, the sheet metal piece shown in FIG. 70 has three sections which are defined by two bend lines BL which extend from the top edge to the bottom edge. Beginning from the left side, left section "fp" is defined by the left side edge of the rectangular sheet metal piece and the first bend-line BL. Left section or panel "fp" will form approximately the top wall of the rail bracket RB'". As a result, the length of this section "fp" (measured between left edge and the first bend-line BL) is approximately "y", where "y" is the length of section "fp". As can be seen in FIG. 70, left-side back section or panel "fp" has three openings "no" which can receive fasteners for securing the rail bracket RB'" to a rail R. These through openings "no" are arranged in the area of the center of the left section "fp". Of course, the openings "no" can be arranged anywhere on the rail bracket RB'" and in any desired configuration, and need not even be arranged on the left section "fp". They can even have any desired shape such as the shape of slots instead of circular holes.

The next section is middle section or side panel "sp" which will form an inner side wall of the rail bracket RB'". The first and second bend-lines BL that define left section "sp" have a length "x". As can be seen in FIG. 70, left section "sp" has a tab portion with a curved edge that extends from a top edge of the sheet metal piece by a distance "h1". The tab also has a through opening "spo" formed therein. Middle section "sp" does not have any openings "no" for receiving fasteners that secure the rail bracket RB'" to a rail R. However, such through openings "no" can be arranged, if desired, anywhere on the section "sp". Of course, as with the openings No of the post bracket (not shown), the openings "no" can be arranged anywhere on the rail bracket RB'" and in any desired configuration. They can even have the shape of slots instead of circular holes.

The next section is the front section or panel "fp" which will form the lower side wall of the rail bracket RB'". As can be seen in FIG. 70, front section "fp" has three openings "no" which can receive fasteners for securing the rail bracket RB'" to a rail R. These through openings "no" are arranged in the area of the center of the front section "fp". Of course, the openings "no" can be arranged anywhere on the rail bracket RB'" and in any desired configuration, and need even not be arranged on the front section "fp". They can even have the shape of slots instead of circular holes. The second bend-lines BL and right edge that define front section "fp" have a length "y". In this way, after left and right sections "fp" are bent along the first and second bend-lines BL and after the tab of section "sp" is bent along the two bend-lines BL, the tab will be arranged in the position shown in FIG. 69.

Figure 71:
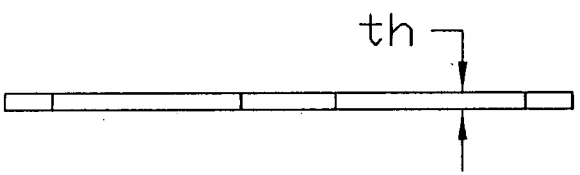
FIG. 71 shows a side view of the stock sheet metal part shown in FIG. 70.

The dimension "x", "y", "w" and "h1" can be configured to match the requirements of a particular fence and may depend on the thickness "th" (see FIG. 71) of the sheet metal piece. However, for a fence that uses 2×3 wooden rails and with a sheet metal thickness of approximately 1/10", these dimensions can be "w" being about 2 to 4", with 3" being preferred, with "h1" being between approximately 1¼" and approximately 1½", with "y" being between approximately 1 9/16", and with "x" being about 2 9/16". The overall length (measured between left and right edges) of the sheet metal part will, of course, depend on the bend radii used in the two section bends (with radii of between 1/64" and ⅛" being preferred), the sheet metal thickness "th", and the dimensions Rw and Rh. This information can be developed using standard formulas and bending machinery which account for bend allowances. Such information is well known to those who work with sheet metal fabrication.

In forming the rail bracket RB'" shown in FIG. 69, any number of desired and cost-effective methods and devices can be used. The state of the art in sheet metal fabrication includes devices which can form the openings "no" and "spo" by punching, water-jet cutting, laser cutting, plasma cutting, etc. Today's equipment also includes manual cutting and bending devices in addition to Computer Numerical Control (CNC) punch presses, as well as CNC plasma and laser cutters. One inexpensive way of forming the rail bracket RB'" shown in FIG. 69, is to use a punch press to form the plate shown in FIG. 70 with the overall shape and holes "no" and "spo" being cut in the punch press. One or more secondary operations can then be used to form the bends resulting in the rail bracket RB'" shown in FIG. 69. It is desirable to make the rail bracket RB'" as cheaply as possible, since a typical fence may require dozens of rail brackets RB'''', yet strength and ease of use should not be sacrificed to a significant extent. Accordingly, it is believed that forming the rail brackets RB'''' from a one-piece sheet metal piece satisfies these requirements. Of course, an alternative way of forming the bracket shown in FIG. 69, can be by molding, casting, etc., whether the rail bracket RB'''' is to be made of metal or plastic, or even plastic coated metal. For example, today's equipment can mold substantially the shape shown in FIG. 69. Thereafter, if necessary, the tabs and holes "no" and "spo" can be formed or shaped with cutting devices by milling, shaping, cutting, punching, and drilling, etc.

Figure 72:
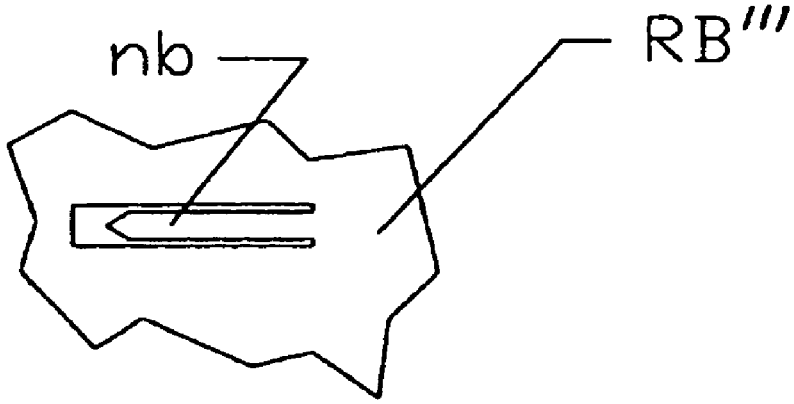
FIG. 72 shows a securing barb "nb" on a rail bracket RB.

FIG. 72 shows a securing barb "nb" on a rail bracket RB''''. The rail brackets RB can also have a plurality of barbs "nb" in addition to openings "no".

It is noted that the term fence as used herein broadly encompasses gates, railings and other similar devices, whether made of wood, metal or plastic, and in no way is to be construed as limiting of the present to any particular type of fence. It is also noted that the invention contemplates that to the extent that metal parts are used, they should be galvanized or coated with a protective coating. They can even be painted to match the posts P, rails R and slats SL. Moreover, while the invention has been specifically described using 2×3 rails R and 4×4 wooden posts. It should be apparent that the bracket systems disclosed herein can be used with rails R and post P of almost any size and shape whether made of wood, plastic or metal, and in no way is to be construed as limiting of the present to any particular type of rails R, posts P or slats SL.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method of assembling a fence that includes posts and rails, the method comprising:

providing a plurality of posts, a plurality of post brackets, first and second rail brackets, and a plurality of rails, each post bracket comprising a one-piece sheet metal member having an opening sized to receive therein one of the posts, a first projecting portion extending in one direction, a second projecting portion extending in another direction, two spaced apart edges, and at least one of:

fastener openings each configured to receive a fastener for securing the post brackets to the posts, and barbs for securing the post brackets to the posts, the first rail bracket comprising a one-piece sheet metal member having a projecting portion, at least three rail engaging sides, and at least one of:

fastener openings each configured to receive a fastener for securing the first rail bracket to one of the rails, and barbs for securing the first rail bracket to the one of the rails, and the second rail bracket comprising a one-piece sheet metal member having a projecting portion, at least three rail engaging sides, and at least one of:

fastener openings each configured to receive a fastener for securing the second rail bracket to another of the rails, and barbs for securing the second rail bracket to the other of the rails;

placing the plurality of posts in a ground so that the posts are spaced apart;

sliding at least two of the plurality of post brackets over or onto each post;

sliding the first rail bracket over or onto an end of the rail;

sliding the second rail bracket over or onto an end of the other rail;

positioning the projecting portion of the first rail bracket out past the end of the rail;

positioning the projecting portion of the second rail bracket out past the end of the other rail;

movably connecting or mounting the projecting portion of the first rail bracket to the first projecting portion of one of the post brackets;

movably connecting or mounting the projecting portion of the second rail bracket to the second projecting portion of the one of the post brackets;

securing each post bracket to each post with the barbs or fasteners, or both barbs and fasteners, inserted into the fastener openings of each post bracket;

securing the first rail bracket to the rail with the barbs or fasteners, or both barbs and fasteners, inserted into the fastener openings of the first rail bracket; and securing the second rail bracket to the other rail with the barbs or fasteners, or both barbs and fasteners, inserted into the fastener openings of the second rail bracket.

2. The method of claim 1, wherein each of the first and second projecting portions of each post bracket comprises at least one projecting tab having a width that is less than an overall width of each post bracket.

3. The method of claim 1, wherein each of the first and second projecting portions comprises two projecting tabs and wherein the one of the post brackets has a generally uniform thickness of between approximately 1/20 inches and 1/5 inches.

4. The method of claim 1, wherein each of the first and second projecting portions comprises a connecting opening, and wherein each projecting portion of the first and second rail brackets comprises a connecting opening.

5. The method of claim 1, wherein the first and second rail brackets are removably coupled to the first and second projecting portions.

6. The method of claim 1, wherein the first and second rail brackets are pivotally mounted to the first and second projecting portions.

7. The method of claim 1, wherein the first and second rail brackets are movably mounted to the first and second projecting portions via first and second fasteners.

8. The method of claim 1, wherein each of the first and second projecting portions comprises two projecting tabs that each have connecting opening.

9. The method of claim 8, wherein the projecting portion of each of the first and second rail brackets comprises a connecting opening which can receive therein a fastener.

10. The method of claim 1, further comprising connecting pickets or slats to the rails.

11. The method of claim 1, further comprising connecting pickets or slats to the rails, wherein a single fastener connects one of the pickets or slats to one of the rails.

12. The method of claim 1, further comprising connecting pickets or slats to at least two channel members and wherein each of the at least two channel members is securable to one of the rails.

13. The method of claim 12, wherein each of the pickets or slats are connected to each of the channel members via a single fastener, whereby the channel members can move relative to the pickets or slats.

14. The method of claim 1, wherein the rail and the other rail comprise wood rails.

15. The method of claim 1, further comprising securing a fence section to each of the one rail and the other rail, wherein the fence section comprises pickets or slats connected to at least two channel members.

16. The method of claim 15, wherein each of the at least two channel members comprise one of a U-shaped channel member and an L-shaped channel member.

17. The method of claim 1, further comprising securing a fence section to the rail and the other one rail, wherein the fence section comprises pickets or slats movably connected to at least two channel members.

18. A method of assembling a fence that includes posts and rails, the method comprising:

providing a plurality of wood posts, a plurality of bent sheet metal post brackets, first and second bent sheet metal rail brackets, and a plurality of rails, wherein first and second projecting portions of each post bracket extend in different directions;

placing the plurality of wood posts in a ground in a spaced apart manner;

sliding at least two of said plurality of bent sheet metal post brackets over or onto each wood post;

sliding said first bent sheet metal rail bracket over or onto an end of a rail;

positioning a projecting portion of said first bent sheet metal rail bracket out past the end of the rail;

sliding said second bent sheet metal rail bracket over or onto an end of another rail;

positioning a projecting portion of said second bent sheet metal rail bracket out past the end of the other rail;

connecting or mounting the projecting portion of said first bent sheet metal rail bracket to the first projecting portion of one of said plurality of post brackets with a first connecting fastener;

connecting or mounting the projecting portion of said second bent sheet metal rail bracket to the second projecting portion of the one of said plurality of post brackets with a second connecting fastener;

securing each post bracket to each wood post with the barbs or fasteners, or both barbs and fasteners, inserted through fastener openings of each post bracket;

securing the first rail bracket to the rail with the barbs or fasteners, or both barbs and fasteners, inserted through fastener openings of the first rail bracket;

securing the second rail bracket to the other rail the barbs or fasteners, or both barbs and fasteners, inserted through fastener openings of the second rail bracket.

* * * * *